US011499382B2

(12) United States Patent
Friestad et al.

(10) Patent No.: US 11,499,382 B2
(45) Date of Patent: Nov. 15, 2022

(54) ELEVATOR FOR LIFTING TUBULARS OF VARIOUS SIZES, THE ELEVATOR HAVING A LOCKING MECHANISM

(71) Applicant: CANRIG ROBOTIC TECHNOLOGIES AS, Sandnes (NO)

(72) Inventors: Jan Friestad, Kleppe (NO); Kenneth Mikalsen, Sandnes (NO); Ørjan H. Larsen, Sandnes (NO); Bjørnar Lingjerde, Sandnes (NO)

(73) Assignee: Canrig Robotic Technologies AS, Sandnes (NO)

( * ) Notice: Subject to any disclaimer, the term of this patent is extended or adjusted under 35 U.S.C. 154(b) by 0 days.

(21) Appl. No.: 17/229,603

(22) Filed: Apr. 13, 2021

(65) Prior Publication Data

US 2021/0230951 A1 Jul. 29, 2021

Related U.S. Application Data

(62) Division of application No. 16/674,537, filed on Nov. 5, 2019, now Pat. No. 11,002,088.

(60) Provisional application No. 62/756,428, filed on Nov. 6, 2018.

(51) Int. Cl.
*E21B 19/06* (2006.01)
*E21B 19/07* (2006.01)

(52) U.S. Cl.
CPC ..... *E21B 19/06* (2013.01); *E21B 19/07* (2013.01)

(58) Field of Classification Search
CPC ..... E21B 19/06; E21B 19/08; E21B 19/155; E21B 41/00; E21B 19/07
See application file for complete search history.

(56) References Cited

U.S. PATENT DOCUMENTS 3,495,864 A 2/1970 Jones et al.
4,715,456 A 12/1987 Poe, Jr. et al.
8,267,450 B2 9/2012 Aarhus et al.
8,608,216 B2 12/2013 Lunde
(Continued)

FOREIGN PATENT DOCUMENTS

AU 2012233027 A1 10/2012
CA 854590 A 10/1970
(Continued)

OTHER PUBLICATIONS

International Search Report from PCT Application No. PCT/EP2019/080086, dated Mar. 27, 2020, 2 pgs.
(Continued)

*Primary Examiner* — Taras P Bemko
(74) *Attorney, Agent, or Firm* — Abel Schillinger, LLP

(57) ABSTRACT

A system including an elevator to move a tubular, the elevator including two or more remotely operable latches that can configure the elevator to handle various tubular diameters. Each jaw can include a locking mechanism that engages a portion of the housing adjacent a spacer ring in the elevator when the first jaw is in the engaged position and configured to transfer a closing force to the housing. A portion of the latches can be laterally offset from each other and another portion can overlap adjacent latches. The elevator can be explosive (EX) Zone 1 certified with an electronics enclosure contained within a sealed chamber. The elevator can use rotary actuators to operate the latches and rotate the housing of the elevator. The elevator can use a circular pressure sensor to determine weight of a tubular.

4 Claims, 31 Drawing Sheets

(56) References Cited

U.S. PATENT DOCUMENTS

| | | | |
|---|---|---|---|
| 9,303,469 | B1 | 4/2016 | Keast |
| 9,863,194 | B2 | 1/2018 | Larkin |
| 10,480,291 | B2 | 11/2019 | Wiedecke et al. |
| 2005/0269072 | A1 | 12/2005 | Folk et al. |
| 2010/0200221 | A1 | 8/2010 | Sipos |
| 2012/0200101 | A1 | 8/2012 | Lunde |
| 2012/0261528 | A1 | 10/2012 | Stoldt et al. |
| 2018/0135363 | A1 | 5/2018 | Orr et al. |
| 2019/0136669 | A1 | 5/2019 | Wiedecke et al. |
| 2020/0141193 | A1 | 5/2020 | Friestad et al. |
| 2020/0141194 | A1 | 5/2020 | Friestad et al. |
| 2020/0141195 | A1 | 5/2020 | Friestad et al. |

FOREIGN PATENT DOCUMENTS

| | | | |
|---|---|---|---|
| CN | 104929536 | A | 9/2015 |
| EP | 2216496 | A2 | 8/2010 |
| WO | 2002061231 | A2 | 8/2002 |
| WO | 2008127740 | A2 | 10/2008 |
| WO | 2011053149 | A1 | 5/2011 |
| WO | 2013033848 | A1 | 3/2013 |
| WO | 2013075033 | A1 | 5/2013 |
| WO | 2018068099 | A1 | 4/2018 |
| WO | 2020094562 | A1 | 5/2020 |
| WO | 2020094566 | A1 | 5/2020 |
| WO | 2020094567 | A1 | 5/2020 |

OTHER PUBLICATIONS

Partial International Search Report from PCT Application No. PCT/EP2019/080086, dated Feb. 2, 2020, 1 pg.

International Search Report from PCT Application No. PCT/EP2019/080096, dated Mar. 27, 2020, 1 pgs.

Partial International Search Report from PCT Application No. PCT/EP2019/080096, dated Feb. 2, 2020, 1 pg.

International Search Report from PCT Application No. PCT/EP2019/080097, dated Mar. 27, 2020, 2 pgs.

SECTION 17-17

SECTION 19-19

SECTION 27-27

SECTION 28B-28B

ELEVATOR FOR LIFTING TUBULARS OF VARIOUS SIZES, THE ELEVATOR HAVING A LOCKING MECHANISM

CROSS-REFERENCE TO RELATED APPLICATIONS

This application is a divisional of and claims priority to U.S. patent application Ser. No. 16/674,537, filed on Nov. 5, 2019 by Jan FRIESTAD et al., and entitled "ELEVATOR FOR LIFTING TUBULARS OF VARIOUS SIZES, THE ELEVATOR HAVING A LOCKING MECHANISM." which claims priority under 35 U.S.C. § 119(e) to U.S. Provisional Application No. 62/756,428, entitled "ELEVATOR FOR LIFTING TUBULARS OF VARIOUS SIZES, THE ELEVATOR HAVING A LOCKING MECHANISM," by Jan FRIESTAD et al., filed Nov. 6, 2018, which is assigned to the current assignee hereof and is incorporated herein by reference in their entireties.

TECHNICAL FIELD

The present invention relates, in general, to the field of drilling and processing of wells. More particularly, present embodiments relate to a system and method for manipulating tubulars during subterranean operations.

BACKGROUND

Top drives are typically utilized in well drilling and maintenance operations, such as operations related to oil and gas exploration. In conventional subterranean (e.g., oil and gas) operations, a wellbore is typically drilled to a desired depth with a tubular string, which can include drill pipe and a drilling bottom hole assembly (BHA). Casing strings can be assembled and installed in the newly drilled portion of the wellbore. During the subterranean operation, a tubular string (e.g., tubular string, casing string, production string, completion string, etc.) may be supported and hoisted about a rig by a hoisting system for eventual positioning down hole in a well. The top drive along with an elevator and a pipe handling system may be used to manipulate tubular segments and tubular strings to extend the tubular string into the wellbore or retrieve the tubular string from the wellbore.

When the tubular string is being extended into the wellbore, a pipe handling system may manipulate tubulars (e.g., single, double, or triple stands) from a pipe storage area (e.g., vertical or horizontal tubular storage) to the top drive via assistance of an elevator. The tubular can be connected to the top drive, which may manipulate the tubular to be positioned over and then connect the tubular to a tubular stub extending from the wellbore. When the tubular string is being retrieved from (or "tripped" out of) the wellbore, a tubular string can be hoisted by the top drive unit and tubular segments (e.g., single, double, or triple stands) can be disconnected from a proximal end of the tubular string via the top drive and manipulated to a pipe storage area (e.g., vertical or horizontal tubular storage) via assistance by the elevator and the pipe handling system.

However, due to the various diameters of tubulars that may be needed during the subterranean operation, the elevator is normally reconfigured during the operation by replacing latching jaws in the elevator with jaws configured to accommodate different size tubulars. This reconfiguration is normally performed manually by rig operators. This manual process of reconfiguring the elevator when different size tubulars are needed takes up valuable rig time and reducing this impact on rig time can be beneficial.

SUMMARY

In accordance with an aspect of the disclosure, a system can include an elevator configured to move a tubular, the elevator including: a housing defining a central bore configured to receive the tubular therein; a first latch including first and second jaws, with each of the first and second jaws being coupled to the housing and configured to be moveable between an engaged position and a disengaged position, and when the first and second jaws are in the engaged position, engagement portions of the first and second jaws are positioned in the central bore on opposite sides of, with respect to each other, a central axis of the central bore and define an opening of a first diameter; and a second latch including third and fourth jaws, with each of the third and fourth jaws coupled to the housing and configured to be moveable between an engaged position and a disengaged position, and when the third and fourth jaws are in the engaged position, engagement portions of the third and fourth jaws are positioned in the central bore on opposite sides of, with respect to each other, the central axis of the central bore and define an opening of a second diameter which is different than the first diameter, where the first jaw is fixedly attached to a first drive shaft and the first drive shaft is rotationally attached to the housing, where the third jaw is fixedly attached to a third drive shaft and the third drive shaft is rotationally attached to the housing, and where the first and third drive shafts independently rotate the first and third jaws, respectively, about a first axis.

In accordance with another aspect of the disclosure, a system for conducting subterranean operations can include: an elevator configured to move a tubular, the elevator including: a housing defining a central bore configured to receive the tubular therein, the central bore having a central axis; and a link interface system configured to rotate the housing up to greater than 90 degrees about a housing axis.

In accordance with another aspect of the disclosure, a system for conducting subterranean operations can include: an elevator configured to move a tubular, the elevator including: a housing defining a central bore configured to receive the tubular therein; a first latch including first and second jaws, with each of the first and second jaws being coupled to the housing and configured to be moveable between an engaged position and a disengaged position, and when the first and second jaws are in the engaged position, engagement portions of the first and second jaws are positioned in the central bore; a second latch including third and fourth jaws, with each of the third and fourth jaws coupled to the housing and configured to be moveable between an engaged position and a disengaged position, and when the third and fourth jaws are in the engaged position, engagement portions of the third and fourth jaws are positioned in the central bore; and an electronics enclosure within the housing, with the electronics enclosure configured to be ATEX certified or IECEx certified according to ex zone 1 requirements.

In accordance with another aspect of the disclosure, a system for conducting subterranean operations can include: an elevator configured to move a tubular, the elevator including: a housing defining a central bore configured to receive the tubular therein; a first latch including first and second jaws, with each of the first and second jaws being coupled to the housing and configured to be moveable between an engaged position and a disengaged position, and when the first and second jaws are in the engaged position, engagement portions of the first and second jaws are positioned in the central bore on opposite sides of, with respect to each other, a central axis of the central bore and define an opening of a first diameter; a second latch including third and fourth jaws, with each of the third and fourth jaws coupled to the housing and configured to be moveable between an engaged position and a disengaged position, and when the third and fourth jaws are in the engaged position, engagement portions of the third and fourth jaws are positioned in the central bore on opposite sides of, with respect to each other, the central axis of the central bore and define an opening of a second diameter which is different than the first diameter; and an electronics controller disposed in an electronics enclosure within the housing and configured to control the elevator to handle the tubular.

In accordance with another aspect of the disclosure, a system for conducting subterranean operations can include: an elevator configured to move a tubular, the elevator including: a housing defining a central bore configured to receive the tubular therein; a first latch including first and second jaws, with each of the first and second jaws being coupled to the housing and configured to be moveable between an engaged position and a disengaged position, and when the first and second jaws are in the engaged position, engagement portions of the first and second jaws are configured to form a first frustoconically shaped portion positioned in the central bore and surrounding a central axis of the central bore, where the first frustoconically shaped portion defines an opening of a first diameter; and a second latch including third and fourth jaws, with each of the third and fourth jaws coupled to the housing and configured to be moveable between an engaged position and a disengaged position, and when the third and fourth jaws are in the engaged position, engagement portions of the third and fourth jaws are configured to form a second frustoconically shaped portion positioned in the central bore and surrounding the central axis of the central bore, where the second frustoconically shaped portion defines an opening of a second diameter which is different than the first diameter, where the first frustoconically shaped portion includes a first gap between the first and second jaws when the first latch is in the engaged position, and where the second frustoconically shaped portion includes a second gap between the third and fourth jaws when the second latch is in the engaged position, and where the first and second gaps are parallel to the central axis, and the first gap is circumferentially offset, relative to the central axis, from the second gap.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

Present embodiments provide an elevator that provides remote actuation of multiple latches to accommodate various diameter tubulars (including tubular stands and tubular strings) and to rotate the elevator relative to a pair of links (or bails) to align the elevator to the tubulars. The elevator comprises rotary actuators for manipulating the latches between engaged and disengaged positions, where a tubular would be latched (or engaged, retained, etc.) when the appropriate latches are in the engaged position and released when the latches are in the disengaged position. The elevator may also comprise a rotary actuator for rotating the elevator relative to the links. The aspects of various embodiments are described in more detail below.

Figure 1:
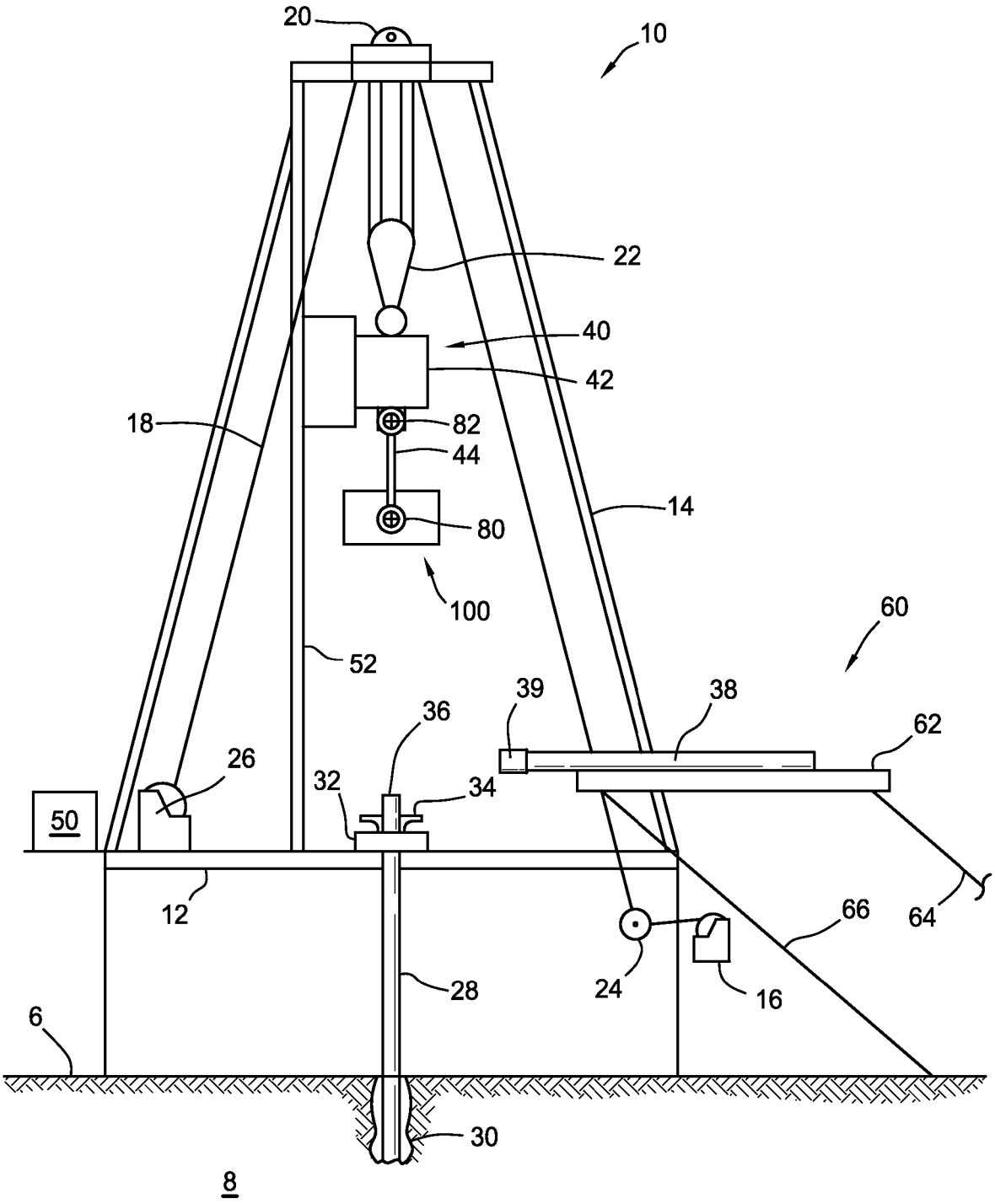
FIGS. 1-3 are representative schematics of a rig being utilized for a subterranean operation (e.g., drilling a wellbore) with a top drive and an elevator, in accordance with certain embodiments.

FIG. 1 is a schematic view of a rig 10 in the process of a subterranean operation in accordance with certain embodiments which require providing tubulars to and removing tubulars from a top drive of the rig 10. In this example, the rig 10 is in the process of drilling a well, but the current embodiments are not limited to a drilling operation. The rig 10 can also be used for other operations that require manipulating tubulars. The rig 10 features an elevated rig floor 12 and a derrick 14 extending above the rig floor 12. A supply reel 16 supplies line 18 to a crown block 20 and traveling block 22 configured to hoist various types of drilling equipment above the rig floor 12. The line 18 is secured to a deadline tiedown anchor 24, and a drawworks 26 regulates the amount of line 18 in use and, consequently, the height of the traveling block 22 at a given moment. Below the rig floor 12, a tubular string 28 extends downward into a wellbore 30 formed in the earthen formation 8 through the surface 6 and is held stationary with respect to the rig floor 12 by a rotary table 32 and slips 34 (e.g., power slips). A portion of the tubular string 28 extends above the rig floor 12, forming a stump 36 to which another length of tubular 38 (e.g., a joint of drill pipe) may be added.

A tubular drive system 40, hoisted by the traveling block 22, can collect the tubular 38 from a pipe handling system 60 and position the tubular 38 above the wellbore 30. In the illustrated embodiment, the tubular drive system 40 includes a top drive 42, an elevator 100, and a pair of links that couple the elevator to the top drive 42. The tubular drive system 40 can be configured to measure forces acting on the tubular drive system 40, such as torque, weight, and so forth. These measurements can be communicated to a controller 50 used to control various rig systems during the subterranean operation. For example, the tubular drive system 40 may measure forces acting on the top drive 42 via sensors, such as strain gauges, gyroscopes, pressure sensors, accelerometers, magnetic sensors, optical sensors, or other sensors, which may be communicatively linked to the controller 50. The tubular drive system 40, once coupled with the tubular 38, may hoist the tubular 38 from the pipe handling system 60, then lower the coupled tubular 38 toward the stump (or stickup) 36 and rotate the tubular 38 such that it connects with the stump 36 and becomes part of the tubular string 28. FIG. 1 further illustrates the tubular drive system 40 coupled to a torque track 52. The torque track 52 functions to counterbalance (e.g., counter react) moments (e.g., overturning and/or rotating moments) acting on the tubular drive system 40 and further stabilize the tubular drive system 40 during a tubular string running or other operation.

The rig 10 further includes a control system 50, which is configured to control the various systems and components of the rig 10 that grip, lift, release, and support the tubular 38 and the tubular string 28 during a tubular string running or tripping operation. For example, the control system 50 may control operation of the top drive, the elevator, and the power slips 34 based on measured feedback (e.g., from the tubular drive system 40 and other sensors) to ensure that the tubular 38 and the tubular string 28 are adequately gripped and supported by the tubular drive system 40 and/or the power slips 34 during a tubular string running operation. The control system 50 may control auxiliary equipment such as mud pumps, the robotic pipe handler 60, and the like.

In the illustrated embodiment, the control system 50 can include one or more microprocessors and memory storage. For example, the controller 50 may be an automation controller, which may include a programmable logic controller (PLC). The memory is a non-transitory (not merely a signal), computer-readable media, which may include executable instructions that may be executed by the control system 50. The controller 50 receives feedback from the tubular drive system 40 and/or other sensors that detect measured feedback associated with operation of the rig 10. For example, the controller 50 may receive feedback from the tubular drive system 40 and/or other sensors via wired or wireless transmission. Based on the measured feedback, the controller 50 can regulate operation of the tubular drive system 40 (e.g., increasing rotation speed, increasing weight on bit, etc.). The controller 50 can also communicate via wired or wireless transmission to control or monitor the tubular drive system 40 or the elevator 100. Status information regarding the configuration of the elevator 100 (e.g., configuration of the latches, link interface position, orientation of the elevator 100, position of the elevator 100, weight of a tubular held by the elevator 100, error conditions for the elevator 100, environment characteristics of elevator 100 interior, etc.)

The rig 10 may also include a pipe handling system 60 configured to transport tubulars 38 (e.g., single stands, double stands, triple stands) from a horizontal storage to the derrick 14. The pipe handling system 60 can include a horizontal platform 62 that can be raised or lowered (arrows 68 in FIG. 2) along elevator supports 64, 66. The pipe handler 60 is shown delivering the tubular 38 to the rig floor in a horizontal position. However, other pipe handlers may be used that deliver the tubulars to the rig floor at any orientation from near and below horizontal orientations to vertical orientations. The elevator 100 can remotely and/or automatically rotate the elevator 100 about the axis 80 to align a central bore of the elevator 100 to the tubulars 38 over a wide range of orientations. The links 44 can also be rotated about axis 82 to increase mobility of the elevator 100 for receiving tubulars 38. The tubulars 38 can include a box end 39 with a radially enlarged outer diameter relative to an outer diameter of the tubular 38. The tubulars 38 can also have a portion proximate the box end 39 that has a radially reduced diameter relative to both the outer diameters of the tubular 38 and the box end 39. The outer diameters of the tubular 38 and the box end 39 can be substantially equal or substantially different from each other. The tubular 38 can have a portion 37 proximate the box end 39 that is radially reduced relative to the box end.

Figure 2:
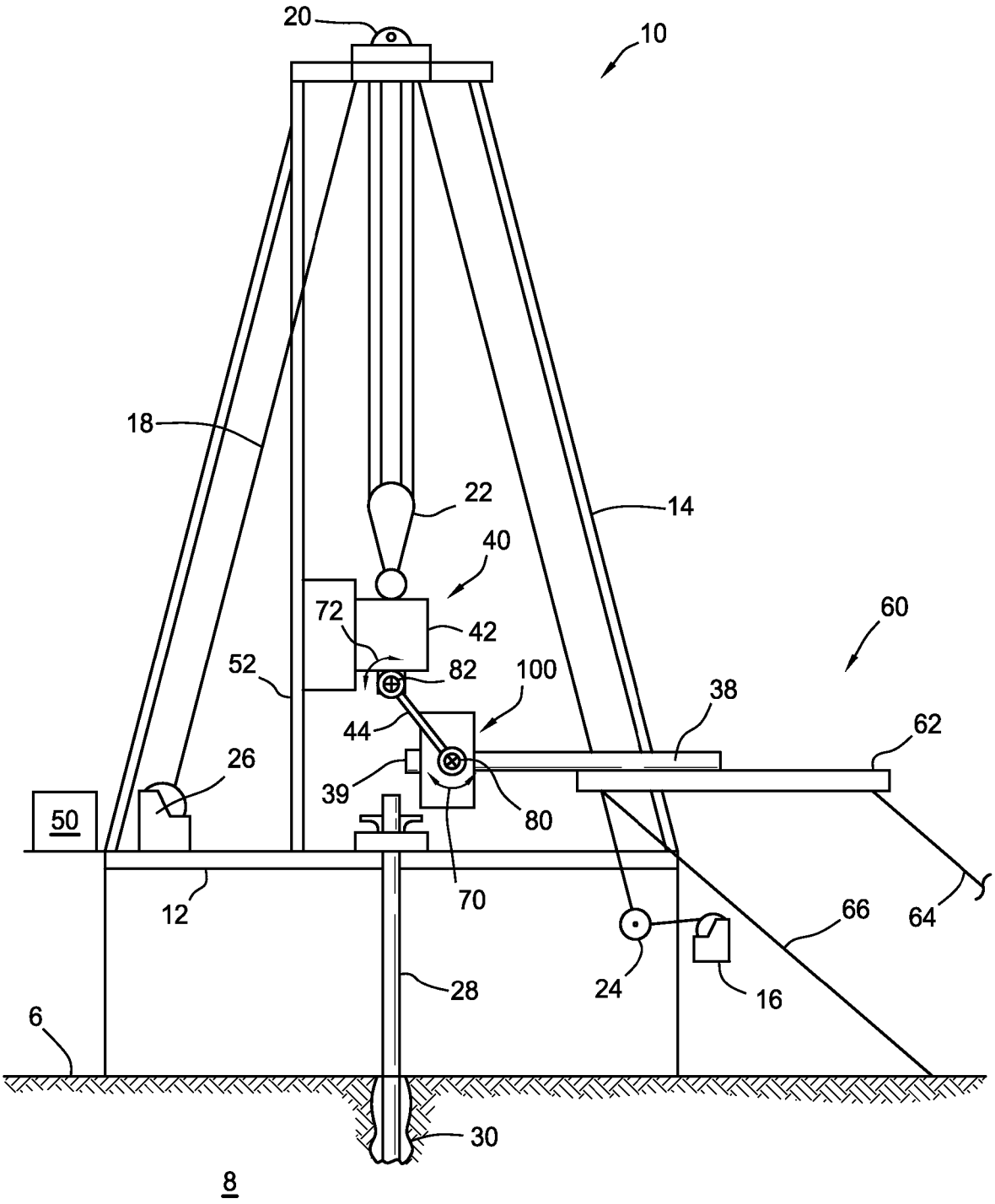

FIG. 2 is another schematic view of the rig 10 shown in FIG. 1, except that the top drive 42 has been lowered and the elevator 100 rotated to receive the tubular 38 from the pipe handler 60. One or more latches in the elevator can engage the tubular 38 (e.g., by engaging the box end 39) thereby preventing the tubular 38 from exiting the elevator 100 until the latches are disengaged. As seen in FIG. 2, the elevator can rotate 70 about the axis 80 relative to the links 44 and the links 44 can rotate 72 about the axis 82.

Figure 3:
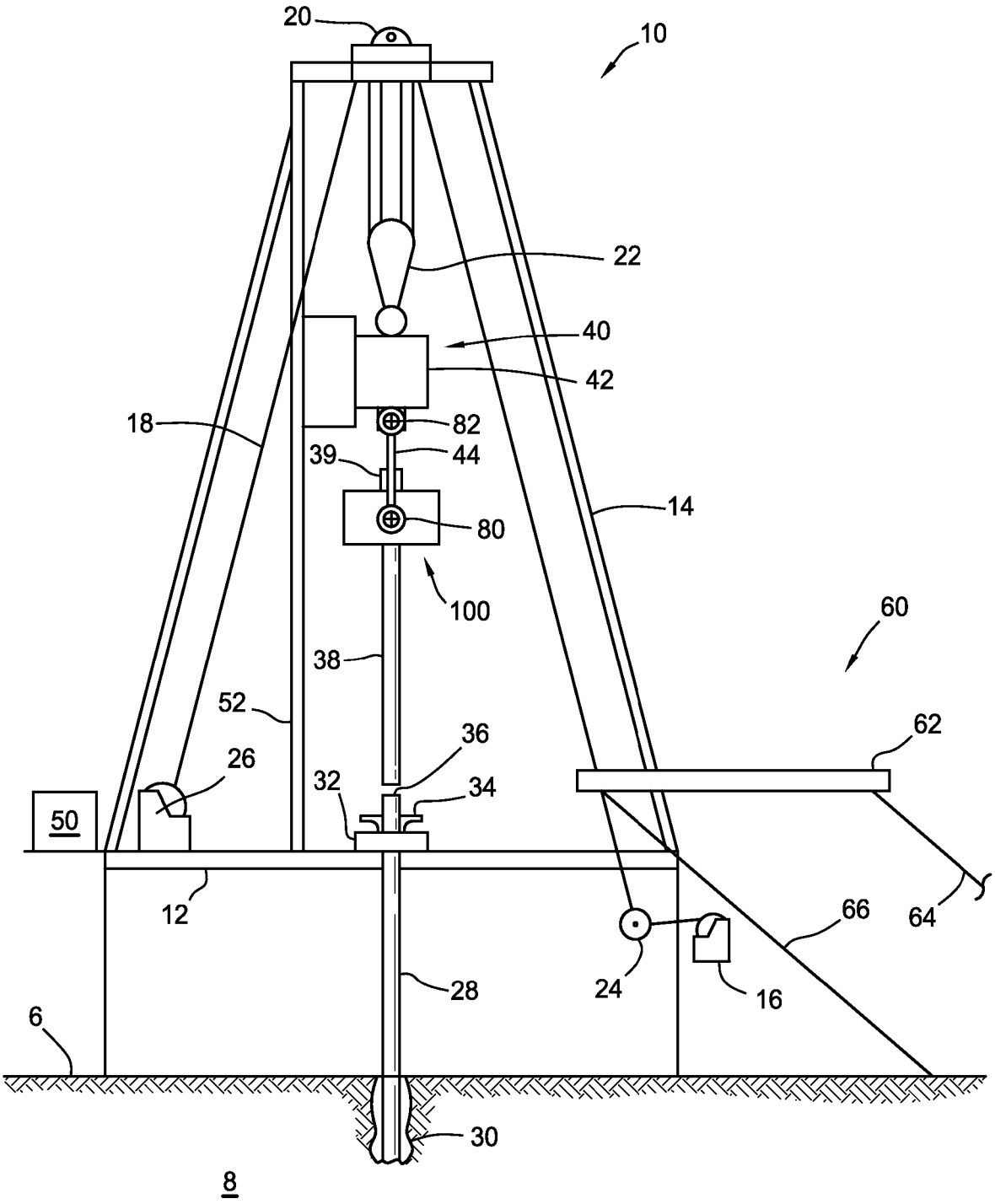

FIG. 3 is another schematic view of the rig 10 shown in FIG. 2, except that the top drive 42 has been raised to hoist the tubular 38 and align it with the stub 36 for connection of the tubular 38 to the tubular string 28. Once the tubular 38 is aligned to the stub 36, the tubular drive system 40 can lower the tubular 38 to the stub 36 for connection to the tubular string 28 by rig equipment and/or personnel. It should be understood, that while the elevator 100 and the tubular drive system 40 are shown in FIGS. 1-3 as facilitating a connection of a tubular 38 to the tubular string 28 during an operation to trip the tubular string 28 into the wellbore 30, the elevator 100 and the tubular drive system 40 are well suited to support other rig operations, such as tripping the tubular string 28 out of the wellbore 30 (e.g., reversing the operations shown in FIGS. 1-3), and supporting the weight of the tubular string 28 during rig 10 operations.

It should be noted that the illustrations of FIGS. 1-3 are intentionally simplified to focus on the operation of the tubular drive system 40 and the elevator 100, which is described in greater detail below. Many other components and tools may be employed during the various periods of formation and preparation of the wellbore 30. Similarly, as will be appreciated by those skilled in the art, the orientation and environment of the wellbore 30 may vary widely depending upon the location and situation of the formations of interest. For example, rather than a generally vertical bore, the wellbore 30, in practice, may include one or more deviations, including angled and horizontal runs. Similarly, while shown as a surface (land-based) operation, the wellbore 30 may be formed in water of various depths, in which case the topside equipment may include an anchored or floating platform.

Figure 4:
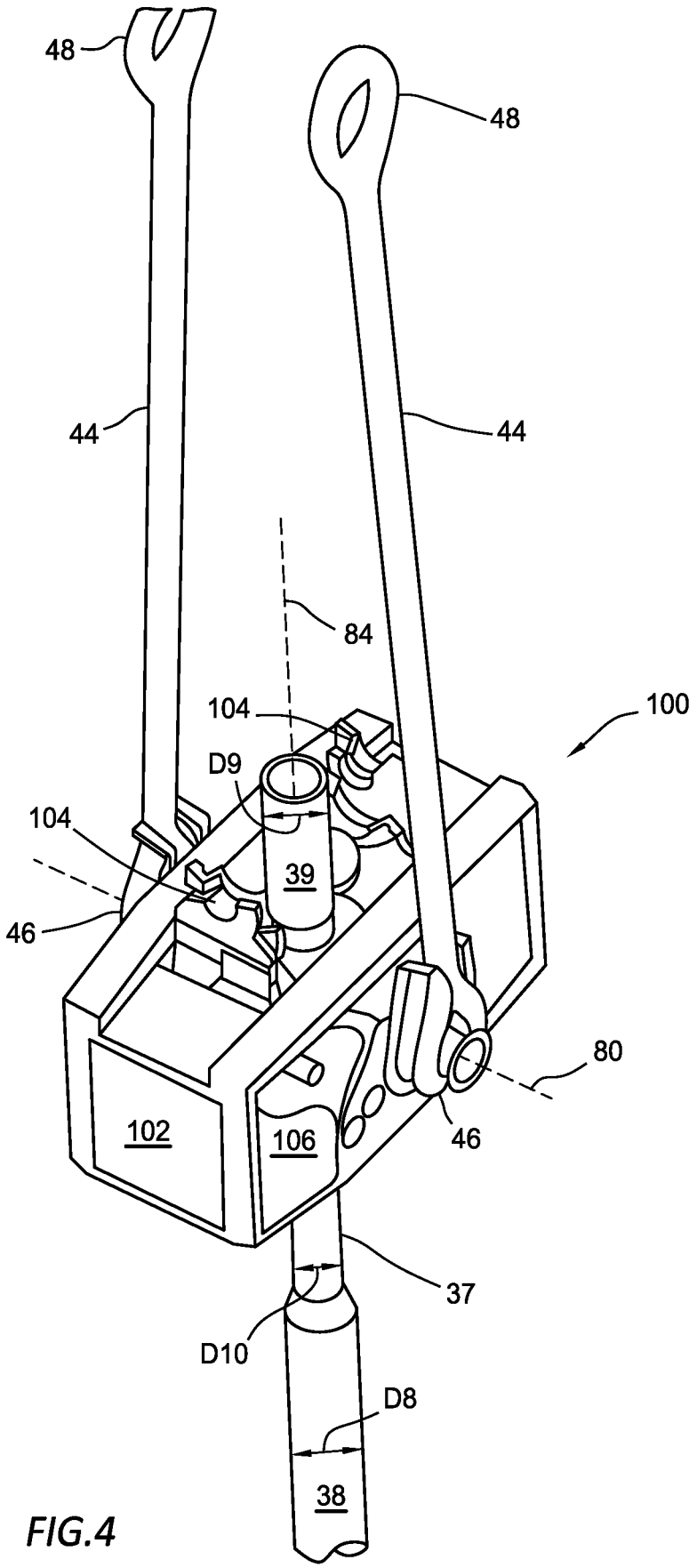
FIG. 4 is a representative perspective view of an elevator, in accordance with certain embodiments.

FIG. 4 is a perspective view of an elevator 100 rotatably attached to ends 46 of a pair of links 44. The ends 48 of the links 44 can be rotatably attached to the top drive 40, thereby linking the elevator 100 to the top drive 42. The elevator 100 can rotate relative to the links 44 about the axis 80 as needed to facilitate handling tubulars (e.g., the tubular 38 or the tubular string 28). The housing 102 of the elevator 100 can include a sealed chamber 106 that is sealed from the fluids and debris associated with the harsh environment of the rig 10. FIG. 4 shows one of the side panels removed which would be installed during operation of the elevator 100. The elevator 100 can also include multiple latches 104 that can adapt the elevator 100 to tubulars 38 with various diameters. This example tubular 38 has a box end 39 with a diameter D9, a portion 37 with a reduced diameter D10, with the remainder of the tubular 38 having a diameter D8.

The latches 104 are configured to support various tubular diameters. If tubulars 38 (having the largest diameter supported by the elevator 100) are to be handled, then all latches 104 would be pivoted to a disengaged position to allow the box end 39 of the large diameter tubular 38 to be inserted through a central bore (with axis 84) of the elevator 100 (with a minimal diameter that is larger than the maximum diameter of the box end 39) until the reduced diameter portion 37 is positioned in the central bore. The elevator 100 can then be controlled to pivot one or more of the latches 104 into an engaged position which reduces the minimal diameter of the central bore. In this example, only one of the latches 104 may be pivoted to an engaged position adjacent the reduced diameter portion 37. The engaged latch 104 allows the reduced diameter portion 37 to freely travel through the elevator 100. However, the engaged latch 104 prevents the box end with diameter D9 from passing through the elevator 100 because the inner diameter of the engaged latch 104 is less than the outer diameter D9 of the box end 39. The tubular drive system 40 can then raise and lower the tubular 38 since the engaged latch 104 engages the box end 39 and prevents it from passing through the elevator 100. As smaller diameter tubulars 38 are needed, more latches 104 can be pivoted to an engaged position to engage the smaller diameters D9 of the box ends 39 of the smaller tubulars 38. Additional latches pivoted to an engaged position forms a smaller inner diameter of an opening through the latches 104 that engage the smaller tubulars 38. FIG. 4 shows one latch in an engaged position, with three other latches 104 (each including a pair of jaws) in a disengaged position.

Figure 5:
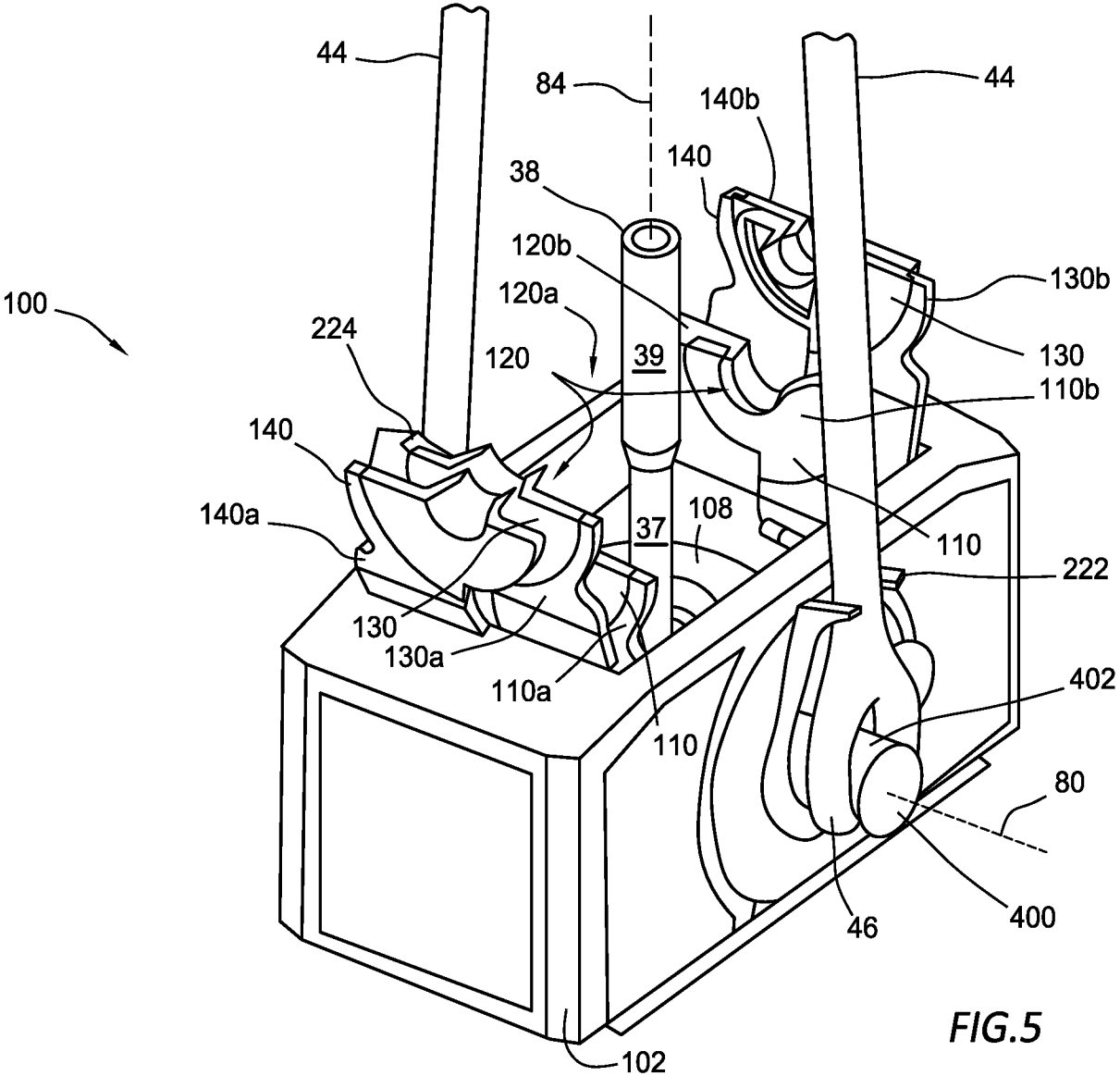
FIG. 5 is a representative perspective view of an elevator with four latches for handling tubulars, the latches being in disengaged positions, in accordance with certain embodiments.

FIG. 5 is a perspective view of an elevator 100 with four latches for handling tubulars 38 (which includes handling tubular strings 28). The elevator 100 includes the housing 102, a link interface 222, 224 for pivoting the housing about the axis 80, and multiple latches 110, 120, 130, 140 for managing a diameter of the opening through the elevator 100. A spacer ring 108 is positioned in the central bore of the elevator 100 and defines the maximum diameter of a tubular 38 that is allowed to pass through the elevator 100. The latches 110, 120, 130, 140 successively reduce the maximum diameter of tubulars 38 that are allowed to pass through the elevator 100. Each latch 110, 120, 130, 140 includes a pair of jaws that are rotatably attached to the housing 102. The first latch 110 includes jaws 110*a*, 110*b*. The second latch 120 includes jaws 120*a*, 120*b* (please note that the jaw 120*a* is not shown and the reference numeral is indicating a general position of the jaw 120*a*. The third latch 130 includes jaws 130*a*, 130*b*. The fourth latch 140 includes jaws 140*a*, 140*b*. The latches 110, 120, 130, 140 are shown in a disengaged position with the jaw pairs pivoted away from the tubular 38 in the central bore. Each jaw in the jaw pairs are positioned on opposite sides of the central bore. Therefore, the jaws 110*a*, 120*a*, 130*a*, 140*a*, can be positioned on a left side of the central bore (relative to the link interface 222) with the jaws 110*b*, 120*b*, 130*b*, 140*b*, positioned on the right side of the central bore. The first latch 110 (with jaws 110*a*, 110*b*) is pivoted to an engaged position to capture the largest diameter tubulars 38 within the elevator 100. The latches 120, 130, 140 are successively pivoted to an engaged position to capture smaller and smaller diameter tubulars 38. A link retainer 400 can be removably attached to retain a link 44 to an elevator support 402 once the elevator support 402 has been inserted through an opening in the link 44. When installed, the link retainer 400 can prevent removal of the link from the elevator 100 until the link retainer is disengaged. A more detailed discussion of the link retainer 400 is given below in reference to FIGS. 20-24.

Figure 6:
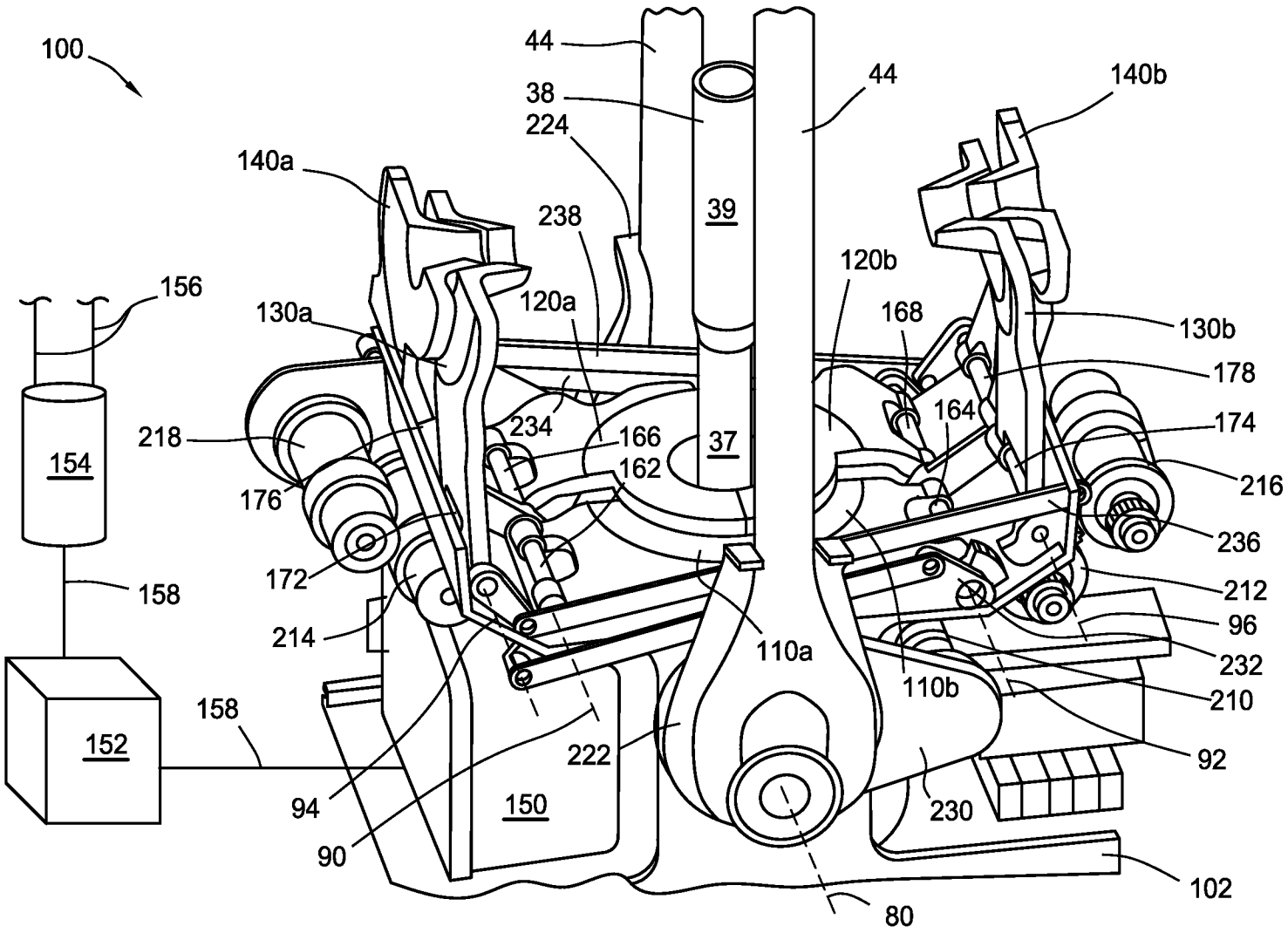
FIG. 6 is a representative cut-away perspective view of an elevator with four latches for handling tubulars, the latches being in various engaged or disengaged positions, in accordance with certain embodiments.

FIG. 6 is a cut-away perspective view of an elevator 100 with four latches for handling tubulars 38. The outer portions of the housing 102 have been removed for discussion purposes. The housing 102 can be ATEX and/or IECEx certified per the EX Zone 1 requirements. ATEX is an abbreviation for "Atmosphere Explosible". IECEx stands for the certification by the International Electrotechnical Commission for Explosive Atmospheres. ATEX is the name commonly given to two European Directives for controlling explosive atmospheres: 1) Directive 99/92/EC (also known as 'ATEX 137' or the 'ATEX Workplace Directive') on minimum requirements for improving the health and safety protection of workers potentially at risk from explosive atmospheres. 2) Directive 94/9/EC (also known as 'ATEX 95' or 'the ATEX Equipment Directive') on the approximation of the laws of Member States concerning equipment and protective systems intended for use in potentially explosive atmospheres. Therefore, as used herein "ATEX certified" indicates that the article (such as the elevator 100) meets the requirements of the two stated directives ATEX 137 and ATEX 95 for explosive (EX) Zone 1 environments. IECEx is a voluntary system which provides an internationally accepted means of proving compliance with IEC standards. IEC standards are used in many national approval schemes and as such, IECEx certification can be used to support national compliance, negating the need in most cases for additional testing. Therefore, as used herein, "IECEx certified" indicates that the article (such as the elevator 100) meets the requirements defined in the IEC standards for EX Zone 1 environments.

Therefore, the enclosure 150 within the sealed chamber 106 of the elevator 100 is configured to meet the standards to be ATEX and IECEx certified according to EX Zone 1 requirements. A hydraulic generator 154 can receive pressurized hydraulic fluid via lines 156 to drive the generator 154, which can produce electrical energy for powering electrical circuitry (such as electronic processors, and programmable logic controllers PLCs) and storing electrical energy in an electrical storage device 152. The storage device 152 is shown connected to the enclosure 150, but the storage device 152 can also be disposed within the enclosure 150 with the generator coupled to the enclosure 150 and the storage device 152 via conductors 158. The storage device 152 can be a battery that stores the electrical energy, but it can also be a capacitor assembly that couples capacitive devices together in the capacitor assembly to provide electrical energy storage that can operate the elevator for at least 5 seconds if the elevator 100 losses power (e.g., generator fails, loss of pressurized hydraulic fluid to generator, etc.). The at least 5 seconds of Uninterruptable Power Supply UPS capability provided by the storage device 152 assumes that no connection operations occur during the power outage. The storage device 152 can provide power to operate the elevator 100 for up to 10 seconds, up to 15 seconds, up to 20 seconds, up to 25 seconds, up to 30 seconds, up to 40 seconds, up to 50 seconds, up to 60 seconds, up to 2 minutes, up to 15 minutes, up to 30 minutes, or greater than 30 minutes. The capacitor assembly can provide significant improvement in obtaining ATEX and IECEx certifications for the elevator 100, since a battery requires additional testing per the EX Zone 1 requirements (or standards).

Referring again to FIG. 6, the example elevator 100 shows the first and second latches 110, 120 in the engaged position with the third and fourth 130, 140 in the disengaged position. Rotary actuators 212, 214, 216, 218 are coupled to respective latches 110, 120, 130, 140. The rotary actuators operate to rotate the jaw pairs of each latch 110, 120, 130, 140 into and out of an engaged position. Some of the linkages that couple the rotary actuators to the respective latches 110, 120, 130, 140 are not shown, but one of ordinary skill in the art will recognize the absent linkages necessary to operate the jaw pairs of each latch 110, 120, 130, 140. The rotary actuator 212 is coupled to the jaws 110*a*, 110*b* through linkage 232. The jaws 110*a*, 110*b* are rotatably attached to the housing through respective drive shafts. Rotating the drive shafts rotate the respective jaws relative to the housing 102 and relative to the central bore of the elevator 100. The linkage 232 is coupled to the drive shafts of the jaws 110*a*, 110*b* such that when the rotary actuator 212 is operated, the linkage causes the jaw 110*a* to rotate about its respective drive shaft in a direction that is opposite a direction the jaw 110*b* rotates about its respective drive shaft. Therefore, to operate the latch to an engaged position, the rotary actuator 212 can operate the linkage 232 such that the jaws 110*a*, 110*b* rotate toward each other until they are in the engaged position and engaging the spacer ring 108 (see FIGS. 5 and 8A). To operate the latch to a disengaged position, the rotary actuator 212 can operate the linkage 232 such that the jaws 110*a*, 110*b* rotate away from each other until they are positioned in the disengaged position as shown in FIG. 5.

The rotary actuator 214 is coupled to the jaws 120*a*, 120*b* through linkage 234. The jaws 120*a*, 120*b* are rotatably attached to the housing through respective drive shafts. Rotating the drive shafts rotate the respective jaws relative to the housing 102 and relative to the central bore of the elevator 100. The linkage 234 is coupled to the drive shafts of the jaws 120*a*, 120*b* such that when the rotary actuator 214 is operated, the linkage causes the jaw 120*a* to rotate about its respective drive shaft in a direction that is opposite a direction the jaw 120*b* rotates about its respective drive shaft. Therefore, to operate the latch to an engaged position, the rotary actuator 214 can operate the linkage 234 such that the jaws 120*a*, 120*b* rotate toward each other until they are in the engaged position and engaging a portion of the jaws 110*a*, 110*b*. To operate the latch to a disengaged position, the rotary actuator 214 can operate the linkage 234 such that the jaws 120*a*, 120*b* rotate away from each other until they are positioned in the disengaged position as shown in FIG. 5.

Similarly, the rotary actuator 216 can operate to rotate the jaws 130*a*, 130*b* into and out of an engaged position through the linkage 236. The rotary actuator 218 can operate to rotate the jaws 140*a*, 140*b* into and out of an engaged position through the linkage 238.

A first drive shaft 162 is fixedly attached to the jaw 110*a*, a second drive shaft 164 is fixedly attached to the jaw 110*b*, a third drive shaft 166 is fixedly attached to the jaw 120*a*, and fourth drive shaft 168 is fixedly attached to the jaw

120*b*. The first and third drive shafts 162, 166 are rotatably attached to the housing 102 along an axis 90 and rotate the respective jaws about the axis 90. The first and third drive shafts 162, 166 are also adjacent each other along the axis 90, and laterally spaced apart along the axis 90. Therefore, a portion of the jaw 120*a* adjacent the third drive shaft 166 does not overlap the jaw 110*a* when the jaws 110*a* and 120*a* are in the engaged position. However, an engagement portion of the jaw 120*a* overlaps and engages an engagement portion of the jaw 110*a* when the jaws 110*a* and 120*a* are in the engaged position.

Similarly, the second and fourth drive shafts 164, 168 are rotatably attached to the housing 102 along the axis 92 and rotate the respective jaws about the axis 92. The second and fourth drive shafts are also adjacent each other along the axis 92 and are laterally spaced apart along the axis 92. A portion of the jaw 120*b* adjacent the fourth drive shaft 168 does not overlap the jaw 110*b* when the jaws 110*b* and 120*b* are in the engaged position. However, an engagement portion of the jaw 120*b* overlaps and engages an engagement portion of the jaw 110*b* when the jaws 110*b* and 120*b* are in the engaged position.

The rotary actuator 216 is coupled to the jaws 130*a*, 130*b* through linkage 236. The jaws 130*a*, 130*b* are rotatably attached to the housing through respective drive shafts. Rotating the drive shafts rotate the respective jaws relative to the housing 102 and relative to the central bore of the elevator 100. The linkage 236 is coupled to the drive shafts of the jaws 130*a*, 130*b* such that when the rotary actuator 216 is operated, the linkage causes the jaw 130*a* to rotate about its respective drive shaft in a direction that is opposite a direction the jaw 130*b* rotates about its respective drive shaft. Therefore, to operate the latch to an engaged position, the rotary actuator 216 can operate the linkage 236 such that the jaws 130*a*, 130*b* rotate toward each other until they are in the engaged position and engaging a portion of the jaws 120*a*, 120*b*. To operate the latch to a disengaged position, the rotary actuator 216 can operate the linkage 236 such that the jaws 130*a*, 130*b* rotate away from each other until they are positioned in the disengaged position as shown in FIGS. 5 and 6.

The rotary actuator 218 is coupled to the jaws 140*a*, 140*b* through linkage 234. The jaws 140*a*, 140*b* are rotatably attached to the housing through respective drive shafts. Rotating the drive shafts rotate the respective jaws relative to the housing 102 and relative to the central bore of the elevator 100. The linkage 238 is coupled to the drive shafts of the jaws 140*a*, 140*b* such that when the rotary actuator 218 is operated, the linkage causes the jaw 140*a* to rotate about its respective drive shaft in a direction that is opposite a direction the jaw 140*b* rotates about its respective drive shaft. Therefore, to operate the latch to an engaged position, the rotary actuator 218 can operate the linkage 238 such that the jaws 140*a*, 140*b* rotate toward each other until they are in the engaged position and engaging a portion of the jaws 130*a*, 130*b*. To operate the latch to a disengaged position, the rotary actuator 218 can operate the linkage 238 such that the jaws 140*a*, 140*b* rotate away from each other until they are positioned in the disengaged position as shown in FIG. 5.

A first drive shaft 162 is fixedly attached to the jaw 110*a*, a second drive shaft 164 is fixedly attached to the jaw 110*b*, a third drive shaft 166 is fixedly attached to the jaw 120*a*, a fourth drive shaft 168 is fixedly attached to the jaw 120*b*, a fifth drive shaft 172 is fixedly attached to the jaw 130*a*, a sixth drive shaft 174 is fixedly attached to the jaw 130*b*, a seventh drive shaft 176 is fixedly attached to the jaw 140*a*, and an eighth drive shaft 178 is fixedly attached to the jaw 140*b*.

The first and third drive shafts 162, 166 are rotatably attached to the housing 102 along an axis 90 and rotate the respective jaws about the axis 90. The first and third drive shafts 162, 166 are also adjacent each other along the axis 90, and laterally spaced apart along the axis 90. A portion of the jaw 120*a* adjacent the third drive shaft 166 does not overlap the jaw 110*a* when the jaws 110*a* and 120*a* are in the engaged position. However, an engagement portion of the jaw 120*a* overlaps and engages an engagement portion of the jaw 110*a* when the jaws 110*a* and 120*a* are in the engaged position.

The second and fourth drive shafts 164, 168 are rotatably attached to the housing 102 along the axis 92 and rotate the respective jaws about the axis 92. The second and fourth drive shafts 164, 168 are also adjacent each other along the axis 92, and are laterally spaced apart along the axis 92. A portion of the jaw 120*b* adjacent the fourth drive shaft 168 does not overlap the jaw 110*b* when the jaws 110*b* and 120*b* are in the engaged position. However, an engagement portion of the jaw 120*b* overlaps and engages an engagement portion of the jaw 110*b* when the jaws 110*b* and 120*b* are in the engaged position.

The fifth and seventh drive shafts 172, 176 are rotatably attached to the housing 102 along an axis 94 and rotate the respective jaws about the axis 94. The fifth and seventh drive shafts 172, 176 are also adjacent each other along the axis 94, and laterally spaced apart along the axis 94. A portion of the jaw 140*a* adjacent the seventh drive shaft 176 does not overlap the jaw 130*a* when the jaws 130*a* and 140*a* are in the engaged position. However, an engagement portion of the jaw 140*a* overlaps and engages an engagement portion of the jaw 130*a* when the jaws 130*a* and 140*a* are in the engaged position.

The sixth and eighth drive shafts 174, 178 are rotatably attached to the housing 102 along the axis 96 and rotate the respective jaws about the axis 96. The second and fourth drive shafts are also adjacent each other along the axis 96 and are laterally spaced apart along the axis 96. A portion of the jaw 140*b* adjacent the fourth drive shaft 178 does not overlap the jaw 130*b* when the jaws 130*b* and 140*b* are in the engaged position. However, an engagement portion of the jaw 140*b* overlaps and engages an engagement portion of the jaw 130*b* when the jaws 130*b* and 140*b* are in the engaged position.

Figure 7:
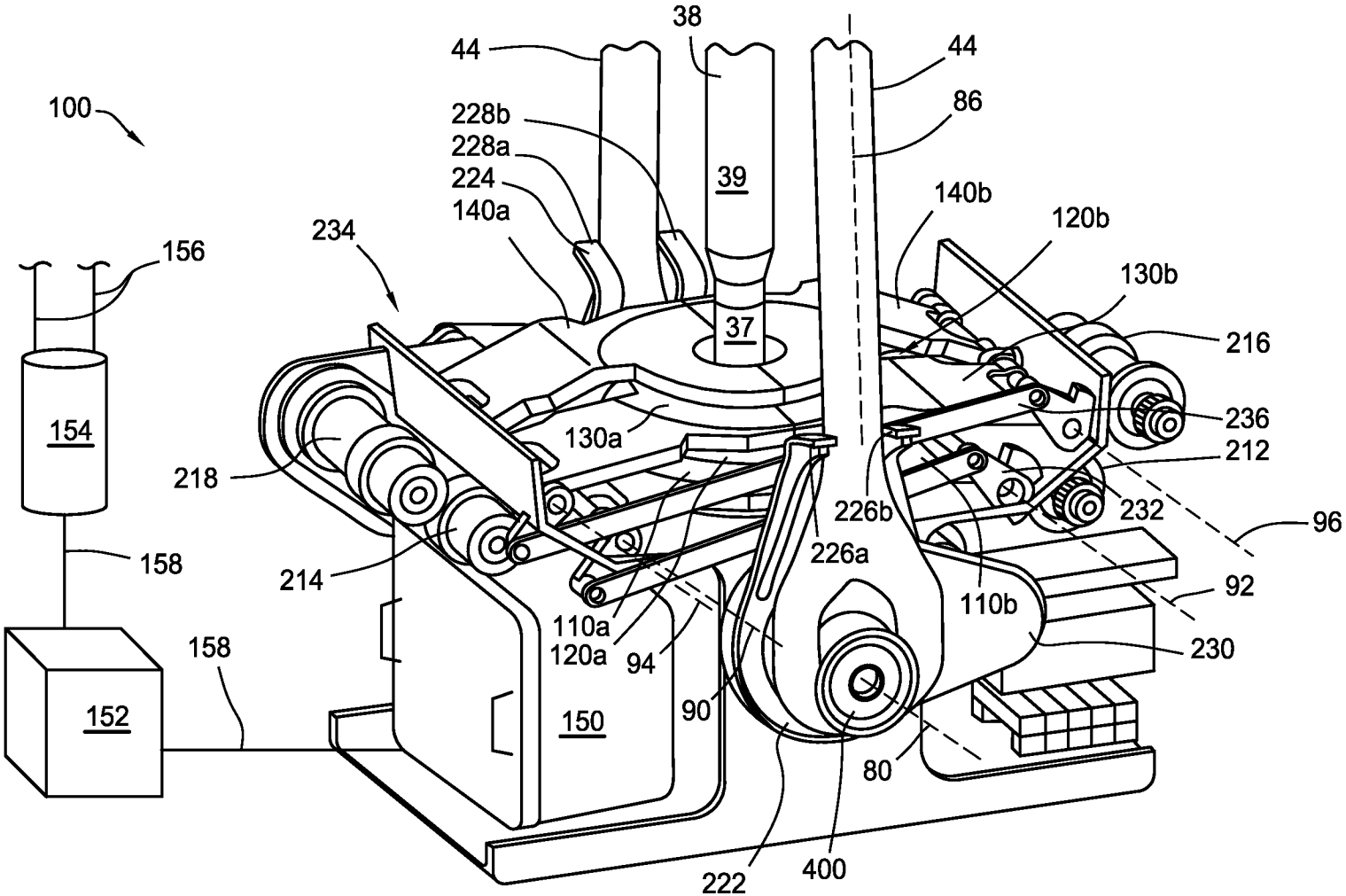
FIG. 7 is a representative cut-away perspective view of an elevator with four latches for handling tubulars, the latches being in engaged positions, in accordance with certain embodiments.

When operating the latches 110, 120, 130, 140, the first latch 110 is rotated into an engaged position before the other latches 120, 130, 140. The second latch 120 can be rotated into an engaged position after the first latch 110 is actuated to the engaged position and before the other latches 130, 140 are actuated. The third latch 130 can be rotated into an engaged position after the first and second latches 110, 120 are actuated to the engaged position and before the other latch 140 is actuated. The fourth latch 140 can be rotated into an engaged position after the first, second, and third latches 110, 120, 130 are actuated to the engaged position. With all four latches in the engaged position, (as seen in FIG. 7) the elevator 100 is configured with a minimal diameter opening through the engaged latches 110, 120, 130, 140. With each successive closure of the latches 110, 120, 130, 140, the minimum diameter of the opening through the latches decreases. Conversely, as the latches are sequentially rotated from the engaged positions to disengaged positions in reverse order, the minimum diameter of the opening through the latches increases. This allows the elevator 100 to be reconfigured to handle tubulars 38 with a wide range of diameters. The elevator can be automatically reconfigured by the controller 50 and/or processors in the enclosure 150 based on sensor date, and/or manually configured by the controller 50 and/or the processors in the enclosure 150 based on user inputs.

Referring now to FIG. 7, in addition to the rotary actuators 212, 214, 216, 218 that operate the latches 110, 120, 130, 140, respectively, the elevator 100 can also include a rotary actuator 210 that operates to rotate the elevator housing 102 relative to the links 44. The rotary actuator 210 can be fixedly attached to the housing 102 and a drive shaft of the actuator 210 is coupled to the link interfaces 222, 224 by linkage 230. As the rotary actuator 210 rotates its drive shaft drives the coupling 230 and operates to rotate the link interfaces 222, 224, which rotate together relative to the housing 102. The link interface 222 can include a pair of angled flanges 226*a*, 226*b* disposed on opposite sides of a first link 44, and the link interface 224 can include a pair of angled flanges 228*a*, 228*b* disposed on opposite sides of a second link 44. When the link interfaces 222, 224 are rotated relative to the housing 102 in response to actuation by the rotary actuator 210, the angled flanges 226*a*, 226*b*, 228*a*, 228*b* engage the first and second links 44 and thereby rotate the elevator 100 relative to the links 44. The link interface system 220 (which includes the items shown in FIG. 14A) can rotate the elevator +/−95 degrees from a position that is perpendicular to a longitudinal axis 86 of the links 44. This equates to a possible rotation of at least 190 degrees when the elevator 100 is rotated through its full rotation. Please note that the link interface system 220 is described in more detail below with reference to FIG. 14A.

Figure 8A:
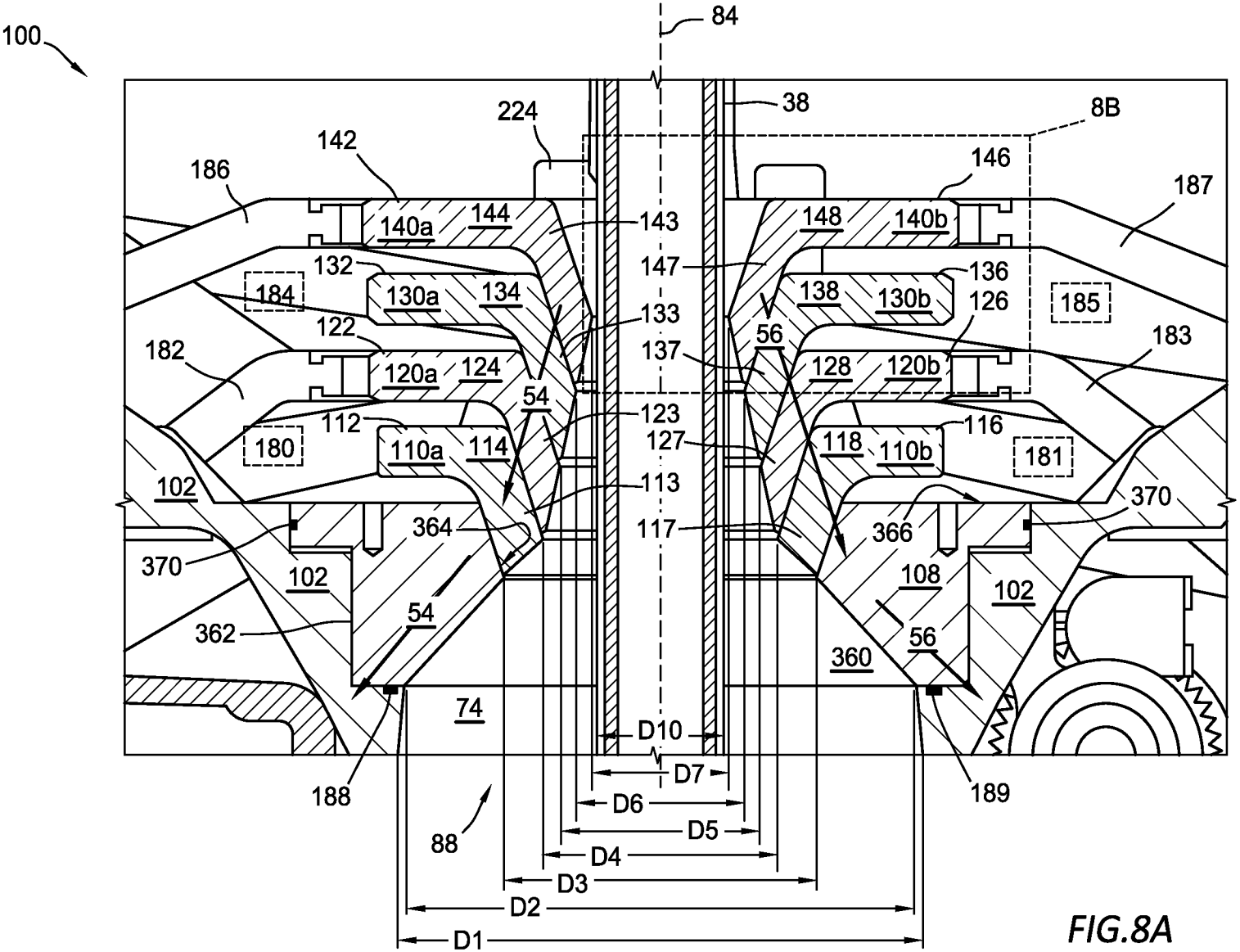
FIG. 8A is a representative cross-sectional view of an elevator with four latches for handling tubulars, the latches being in engaged positions, in accordance with certain embodiments.

FIG. 8A is a center cross-sectional view of an elevator 100 similar to the one shown in FIG. 7. The cross-section is generally at the center of the elevator 100 and perpendicular to the axis 80. FIG. 8A illustrates how the latches 110, 120, 130, 140 engage each other when in the engaged position to distribute the compressive forces caused when hanging the tubular 38 from the elevator 100. When the tubular 38 (or tubular string 28) engages the jaws 140*a*, 140*b* of the latch 140, compression forces 54, 56 are transmitted diagonally down through the stacked latches as indicated by the arrows 54, 56 to the housing 102. This stack of the latches 110, 120, 130, 140 can reduce lateral forces acting on the latches 110, 120, 130, 140 and allows the latches 110, 120, 130, 140 to be a lighter weight design thereby reducing an overall weight of the elevator 100. As the latches are sequentially rotated into a disengaged position, then the diameter of the opening through the elevator 100 can increase allowing larger tubulars 38 to be handled by the elevator 100. As the latches 110, 120, 130, 140 are sequentially disengaged, the latches that remain in the engaged position carries the load of the tubular 38 and transmits the load diagonally down through the remaining engaged latches as indicated by the arrows 54, 56 to the housing 102.

The central bore 74 of the housing 102 can have a tapered bore with a maximum diameter D1 and a minimum diameter D2. The tapered bore is not a requirement, but the taper can assist in guiding an end of the tubular 38 into the central bore 74. It should be understood that the central bore 74 may not be tapered, such that diameter D1 is equal to diameter D2. However, it is preferred that the central bore 74 is tapered. A spacer ring 108 can be positioned between the housing 102 and the latches 110, 120, 130, 140 to provide a compression interface between the housing 102 and the latches 110, 120, 130, 140. The spacer ring 108 can include an inner surface 360, an outer surface 362, a top surface 366, and an engagement surface 364. The inner surface 360 can be tapered toward the center axis 84 which also guides the tubulars 38 into a variable diameter opening through the elevator 100 created by the latches 110, 120, 130, 140. The spacer ring 108 transmits the compression force from the latches 110, 120, 130, 140 to the housing 102. The compression forces 54, 56 can be transmitted to the housing 102 through compression sensors 188, 189 that can measure the compression force applied to the elevator 100 by the tubular 38. It should be understood that any number of compression sensors 188, 189 can be used as needed to measure the compression force applied by the tubular 38.

This elevator 100, with the housing in a substantially horizontal orientation, can be configured to support a tubular that weighs up to 1180 metric tons (~1300 short tons), or up to 1134 metric tons (~1250 short tons), or up to 1189 metric tons (~1200 short tons), or up to 907 metric tons (~1000 short tons), or up to 680 metric tons (~750 short tons), or up to 454 metric tons (~500 short tons), or up to 318 metric tons (~350 short tons), or up to 227 metric tons (~250 short tons). The elevator 100 can be configured to manipulate a tubular 38 between horizontal and vertical orientations with the tubular 38 weighing up to 3000 kg (~3 short tons). Therefore, when one or more of the latches 110, 120, 130, 140 of the elevator 100 are engaged with a tubular 38 positioned on a horizontally oriented tubular handling system (e.g., system 60), the elevator 100 can engage the tubular 38, hoist the tubular 38 from the horizontal orientation on the handling system (e.g., system 60), and rotate with the tubular 38 to a vertical orientation to enable connection of the tubular 38 to the tubular string 28. The elevator 100 is also configured to manipulate the tubular 38 when it is disconnected from the tubular string 28 from a vertical orientation to a horizontal orientation on the handling system. Seals 370 can seal between the housing 102 and the spacer ring 108 to minimize (or prevent) fluids and debris from entering the space between the housing 102 and the spacer ring 108. The sensors 188, 189 may also incorporate seals that minimize (or prevent) fluids and debris from entering the space between the housing 102 and the spacer ring 108. It is preferred to minimize fluid and debris from entering this space, thereby reducing possible in accurate readings from the sensors 188, 189. It should be understood that other benefits are possible with sealing this space from the fluids and debris.

The elevator 100 can accept tubulars 38 with a maximum diameter that is incrementally less than the diameter D3 of the opening in the spacer ring 108, the opening being defined at the intersection of the engagement surface 364 and the inner surface 360. It should be understood that the inner surface 360 of the spacer ring 108 can be parallel to the tubular 38 instead of being tapered, as shown in FIG. 8A. Therefore, the diameter D3 can be equal to the diameter D2. Also, the central bore 74 can have an inner surface that is parallel with the tubular 38 with the diameter D2 being equal to the diameter D1. The box end 39 of the tubular 38 should have enough clearance between the opening of the spacer ring 108 and the tubular 38 to allow ease of movement of the tubular 38 through the opening. Once the box end 39 (not shown in FIG. 8A) is received through the opening of the spacer ring (and thus the opening of the elevator 100), the first latch 110 can be rotated from a disengaged position to an engaged position.

Each jaw 110*a*, 110*b* of the first latch 110 includes an engagement portion 114, 118, which includes a lateral portion 112, 116 and a tapered portion 113, 117. Each jaw 120*a*, 120*b* of the second latch 120 includes an engagement portion 124, 128, which includes a lateral portion 122, 126 and a tapered portion 123, 127. Each jaw 130*a*, 130*b* of the third latch 130 includes an engagement portion 134, 138, which includes a lateral portion 132, 136 and a tapered portion 133, 137. Each jaw 140*a*, 140*b* of the fourth latch 140 includes an engagement portion 144, 148, which includes a lateral portion 142, 146 and a tapered portion 143, 147. The lateral portions of each latch overlap the lateral portions of the other latches that are in an engaged position. The tapered portions of each latch engage the tapered portions of adjacent latches when the latches are in the engaged position, as shown in FIG. 8A.

Jaws 110*a*, 110*b* can be rotated into position by the actuator 212 that acts on the drive shafts 162, 164, respectively. The jaws 110*a*, 110*b* can include an attachment portion 180, 181, and an engagement portion 114, 118, respectively. The attachment portions 180, 181 are not shown in FIG. 8A, because they are present in the other half of the elevator 100 not shown in the current cross-sectional view. However, the relative positions of the attachment portions are indicated by the reference numerals 180, 181. The attachment portions 180, 181 are the portions of the jaws 110*a*, 110*b* that attach the jaws to the respective drive shafts 162, 164. The engagement portions 114, 118 are the portions of the jaws 110*a*, 110*b* that engage the spacer ring 108 when in the engaged position. The lateral portions 112, 116 connect the tapered portions 113, 117 to the attachment portions 180, 181 to form the respective jaws 110*a*, 110*b*. The tapered portions 113, 117 transfer compression forces 54, 56 to the spacer ring 108 through the engagement surface 364. A bottom surface of the tapered portions 113, 117 can be tapered to match the taper of the inner surface 360 of the spacer ring 108.

Jaws 120*a*, 120*b* can be rotated into position by the actuator 214 that acts on the drive shafts 166, 168, respectively. The jaws 120*a*, 120*b* can include an attachment portion 182, 183, and an engagement portion 124, 128, respectively. The attachment portions 182, 183 are the portions of the jaws 120*a*, 120*b* that attach the jaws to the respective drive shafts 166, 168. The engagement portions 124, 128 are the portions of the jaws 120*a*, 120*b* that engage the engagement portions 114, 118 of the first latch 110 when in the engaged position. The lateral portions 122, 126 connect the tapered portions 123, 127 to the attachment portions 182, 183 to form the respective jaws 120*a*, 120*b*. The tapered portions 123, 127 transfer compression forces 54, 56 to the spacer ring 108 through the tapered portions 113, 117 and the engagement surface 364 of the spacer ring 108. A bottom surface of the tapered portions 123, 127 can be tapered to facilitate entry of the tubular 38 into the elevator opening.

Jaws 130*a*, 130*b* can be rotated into position by the actuator 216 that acts on the drive shafts 172, 174, respectively. The jaws 130*a*, 130*b* can include an attachment portion 184, 185, and an engagement portion 134, 138, respectively. The attachment portions 184, 185 are not shown in FIG. 8A, because they are present in the other half of the elevator 100 not shown in the current cross-sectional view. However, the relative positions of the attachment portions are indicated by the reference numerals 184, 185. The attachment portions 184, 185 are the portions of the jaws 130*a*, 130*b* that attach the jaws to the respective drive shafts 172, 174. The engagement portions 134, 138 are the portions of the jaws 130*a*, 130*b* that engage the engagement portions 124, 128 of the second latch 120 when in the engaged position. The lateral portions 132, 136 connect the tapered portions 133, 137 to the attachment portions 184, 185 to form the respective jaws 130*a*, 130*b*. The tapered portions 133, 137 transfer compression forces 54, 56 to the spacer ring 108 through tapered portions 113, 117, 123, 127 and the engagement surface 364 of the spacer ring 108. A bottom surface of the tapered portions 133, 137 can be tapered to facilitate entry of the tubular 38 into the elevator opening.

Jaws 140*a*, 140*b* can be rotated into position by the actuator 218 that acts on the drive shafts 176, 178, respectively. The jaws 140*a*, 140*b* can include an attachment portion 186, 187, and an engagement portion 144, 148, respectively. The attachment portions 186, 187 are the portions of the jaws 140*a*, 140*b* that attach the jaws to the respective drive shafts 176, 178. The engagement portions 144, 148 are the portions of the jaws 140*a*, 140*b* that engage the engagement portions 134, 138 of the third latch 130 when in the engaged position. The lateral portions 142, 146 connect the tapered portions 143, 147 to the attachment portions 186, 187, via the joints 149*a*, 149*b* (see FIG. 9), to form the respective jaws 140*a*, 140*b*. The tapered portions 143, 147 transfer compression forces 54, 56 to the spacer ring 108 through tapered portions 113, 117, 123, 127, 133, 137, and the engagement surface 364 of the spacer ring 108. A bottom surface of the tapered portions 143, 147 can be tapered to facilitate entry of the tubular 38 into the elevator opening.

The tapered portions of each pair of jaws can form a frusticonically shaped portion of the respective latch when the latch is in the engaged position. Therefore, the tapered portions 113, 117 can form a frusticonically shaped portion of the latch 110 that engages a frusticonically shaped inner surface 364 of the spacer ring 108. The tapered portions 123, 127 can form a frusticonically shaped portion of the latch 120 that engages the frusticonically shaped portion of the latch 110. The tapered portions 133, 137 can form a frusticonically shaped portion of the latch 130 that engages the frusticonically shaped portion of the latch 120. The tapered portions 143, 147 can form a frusticonically shaped portion of the latch 140 that engages the frusticonically shaped portion of the latch 130.

As can be seen in FIG. 8A, the later portions of the jaws can be substantially parallel to each other and can overlap each other when the jaws are in the engaged position. The attachment portions of the jaws can provide the interface between the lateral portions that are at different longitudinal positions along the central axis 84 and pairs of drive shafts that are positioned at the same longitudinal position. For example, the drive shafts 162, 166 (see FIG. 6) rotate about the same axis 90 and are therefore at the same longitudinal position along the central axis 84. The drive shafts 164, 168 (see FIG. 6) rotate about the same axis 92 and are therefore at the same longitudinal position along the central axis 84. In the embodiments of FIGS. 6-8A, the axes 90 and 92 are at the same longitudinal position along the axis 84. Similarly, the axes 94 and 96 are at a same longitudinal position along the axis 84. However, the longitudinal position of the axes 90 and 92 can be different than the longitudinal position of the axes 94 and 96.

Additionally, the axes 90 and 92 are positioned on opposite sides of the central axis 84 and can be spaced away from the central axis 84 by substantially a same first distance. However, in other embodiments, a distance between the axis 90 and the central axis 84 can be different than a distance between the axis 92 and the central axis 84. The axes 94 and 96 are positioned on opposite sides of the central axis 84 and can be spaced away from the central axis 84 by substantially a same second distance. However, in other embodiments, the distance between the axis 94 and the central axis 84 can be different than the distance between the axis 96 and the central axis 84. The same first distance from the axes 90 or 92 to the central axis 84 is preferably less than the same second distance from the axes 94 or 96 to the central axis 84.

As stated above, the central bore 74 of the housing 102 can have a tapered bore with a maximum diameter D1 and a minimum diameter D2. The spacer ring 108 can have a minimum diameter D3, which defines a minimum diameter of the opening 88 through the latches and defines the maximum diameter of a tubular 38 that can be received into the elevator 100 when all latches 110, 120, 130, 140 are in the disengaged position. When the latch 110 is in the engaged position, the minimum diameter of the opening 88 through the latches is diameter D4. Diameter D4 defines the maximum diameter of a tubular 38 that can be received into the elevator 100 when the latch 110 is engaged and the latches 120, 130, 140 are disengaged. Diameter D4 also defines the minimum diameter D9 of a box end 39 that can be retained by the latch 110 when the latch 110 is engaged. When the latch 120 is in the engaged position, the minimum diameter of the opening 88 through the latches is diameter D5. Diameter D5 defines the maximum diameter of a tubular 38 that can be received into the elevator 100 when the latches 110, 120 are engaged and the latches 130, 140 are disengaged. Diameter D5 also defines the minimum diameter D9 of a box end 39 that can be retained by the latch 120 when the latch 120 is engaged. When the latch 130 is in the engaged position, the minimum diameter of the opening 88 through the latches is diameter D6. Diameter D6 defines the maximum diameter of a tubular 38 that can be received into the elevator 100 when the latches 110, 120 are engaged and the latches 130, 140 are disengaged. Diameter D6 also defines the minimum diameter D9 of a box end 39 that can be retained by the latch 130 when the latch 130 is engaged.

When the latch 140 is in the engaged position, the minimum diameter of the opening 88 through the latches is diameter D7. Diameter D7 defines the minimum diameter D9 of a box end 39 that can be retained by the latch 140, and thus the elevator 100, when the latch 140 is engaged. In each configuration of the latches 110, 120, 130, 140, the box end 39 of the tubular 38 should be larger than the minimum diameter of the opening 88 and the radially reduced portion 37 of the tubular 38 should be smaller than the minimum diameter of the opening. For example, when all latches 110, 120, 130, 140 are in the engaged position, the diameter D9 of the box end 39 is larger than the diameter D7, while the diameter D10 is smaller than the diameter D7. Therefore, when the latch 140 is disengaged, the tubular 38 can be inserted through the opening 88 of the elevator 100 since the diameter D9 of the box end 39 is smaller than diameter D6 of engaged latch 130. When the box end 39 is passed through the elevator 100, the latch 140 can then be engaged to decrease the diameter of the opening 88 from diameter D6 to diameter D7, which will prevent the box end 39 from passing back through the elevator 100, since the diameter D7 is smaller than the diameter D9. This operation would perform similarly for larger and larger diameter tubulars 38 when the appropriate latches are engaged with the others disengaged, depending upon the desired configuration.

Figure 8B:
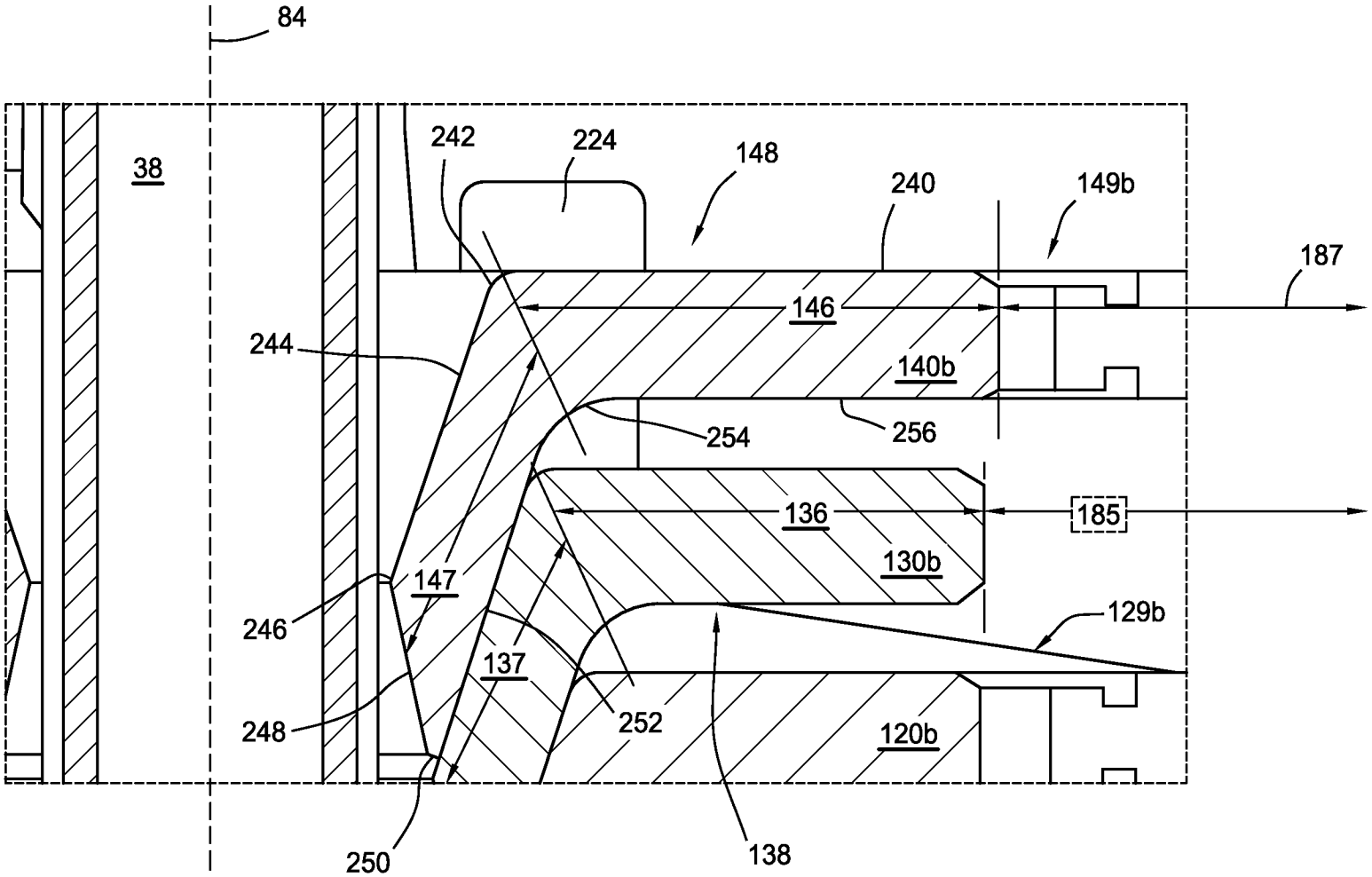
FIG. 8B is a representative detailed cross-sectional view of a portion of the elevator in FIG. 8A, in accordance with certain embodiments.

FIG. 8B is a more detailed view of the region 8B in FIG. 8A. FIG. 8B provides a better view of portions of jaws 130*b*, 140*b* in the engaged position. Each jaw of the elevator 100 includes similar portions and surfaces as those shown for the jaw 140*b*. Jaw 140*b* includes an attachment portion 187 that connects the engagement portion 148 to its respective drive shaft. The attachment portion 187 can be mechanically coupled to the engagement portion 148 by the mechanical joint 149*b*. The mechanical joint 149*b* allows some mechanical play between the engagement portion 148 and the attachment portion 187 such that forces applied to the latch 140 when the latch 140 is engaged with a tubular are prevented (or at least minimized) from being transmitted through the engagement portion 148 to the attachment portion 187 and to the housing 102 through the respective drive shaft. This can ensure that substantially all of the forces applied by the tubular 38 to the elevator 100 are transmitted to the spacer ring 108 and to the compression sensors 188, 189 (or circular weight sensor 480, see FIGS. 25-28B). Similar joints can be included in each of the jaws 110, 120, 130, 140 of the elevator 100. The engagement portion 148 can include a lateral portion 146 and a tapered portion 147, where the lateral portion 146 couples the attachment portion 187 to the tapered portion 147, via the joint 149*b*. The tapered portion 147 is indicated as the portion of the jaw 140*b* bounded by the arrows extending from a distal surface 248 to a point where the tapered portion 147 transitions to the lateral portion 146. The lateral portion 146 is indicated as the portion of the jaw 140*b* bounded by the arrows extending from the transition point between the tapered portion 147 and the lateral portion 146 to a transition point (i.e., the joint 149*b*) between the lateral portion 146 and the attachment portion 187 portion.

As stated above, the tapered portions of each pair of jaws can form a frusticonically shaped portion of the respective latch when the latch is in the engaged position. FIG. 8B shows the portions for a single jaw 130*b* of the jaw pair 130*a*, 130*b* that makes up the latch 130. The tapered portion 137 of the jaw 130*b* can form a circumferential part of the frusticonically shaped portion of the latch 130. FIG. 8B also shows the portions for a single jaw 140*b* of the jaw pair 140*a*, 140*b* that makes up the latch 140. The tapered portion 147 of the jaw 140*b* can form a circumferential part of the frusticonically shaped portion of the latch 140. The tapered portion 147 engages the tapered portion 137 when the latches 140, 130 are in the engaged position.

The jaw 140*b* includes a top surface 240 of the lateral portion 146 that transitions to a concave inner surface 244 of the tapered portion 147 at a transition surface 242. The inner surface 244 transitions to a distal surface 248 at an engagement edge 246. The concave inner surface 244 tapers toward the central axis 84 from the transition surface 242 to the engagement edge 246. The concave inner surfaces 244 and engagement edges 246 of each jaw are configured to engage the tubular 38 (e.g., box end 39) and can allow for various tubular diameters within a range between the minimum diameters of the adjacent latches without reconfiguring the latches. The concave inner surface 244 can allow for varied manufacturing tolerances of the tubulars 38. When the box end 39 engages any point along the concave inner surface 244, the weight of the tubular is transmitted through the engagement portions of the engaged latches to the spacer ring 108. The distal surface 248 is also concave shaped and forms a tapered surface that is tapered at a different angle from the central axis 84 than the concave surface 244.

The distal surface 248 can taper away from the central axis 84 from the engagement edge 246 to a bottom edge 250. The distal surface 248 transitions to a convex shaped outer surface 252 at the bottom edge 250. The outer surface 252 is configured to complimentarily engage a concave inner surface 244 of the jaw 130*b*. The outer surface 252 transitions to a bottom surface 256 of the lateral portion 146 at a transition surface 254. In this embodiment, the lateral portions 146, 136 of the jaws 140*b*, 130*b*, respectively, are substantially parallel to each other and longitudinally spaced apart. The longitudinal space between the lateral portions 146, 136 directs the compression forces 56 to be transmitted through the tapered portions 147, 137 with minimal compression forces, that are applied by an engaged tubular to the elevator 100, to be directed through the lateral portions 146, 136, through the joints 149*b*, 139*b*, through the attachment portions 187, 185, respectively, and to the housing through the respective drive shafts. The joints 149*b*, 139*b* allow mechanical play between the lateral portions 146, 136 and the engagement portions 148, 138 to prevent (or at least minimize) transmission of the compression forces to the housing through the attachment portions 148, 138. However, the lateral portions 146, 136 can engage each other in other embodiments, thereby allowing more of the compression forces 56 to be transmitted through the lateral portions 146, 136.

Figure 8C:
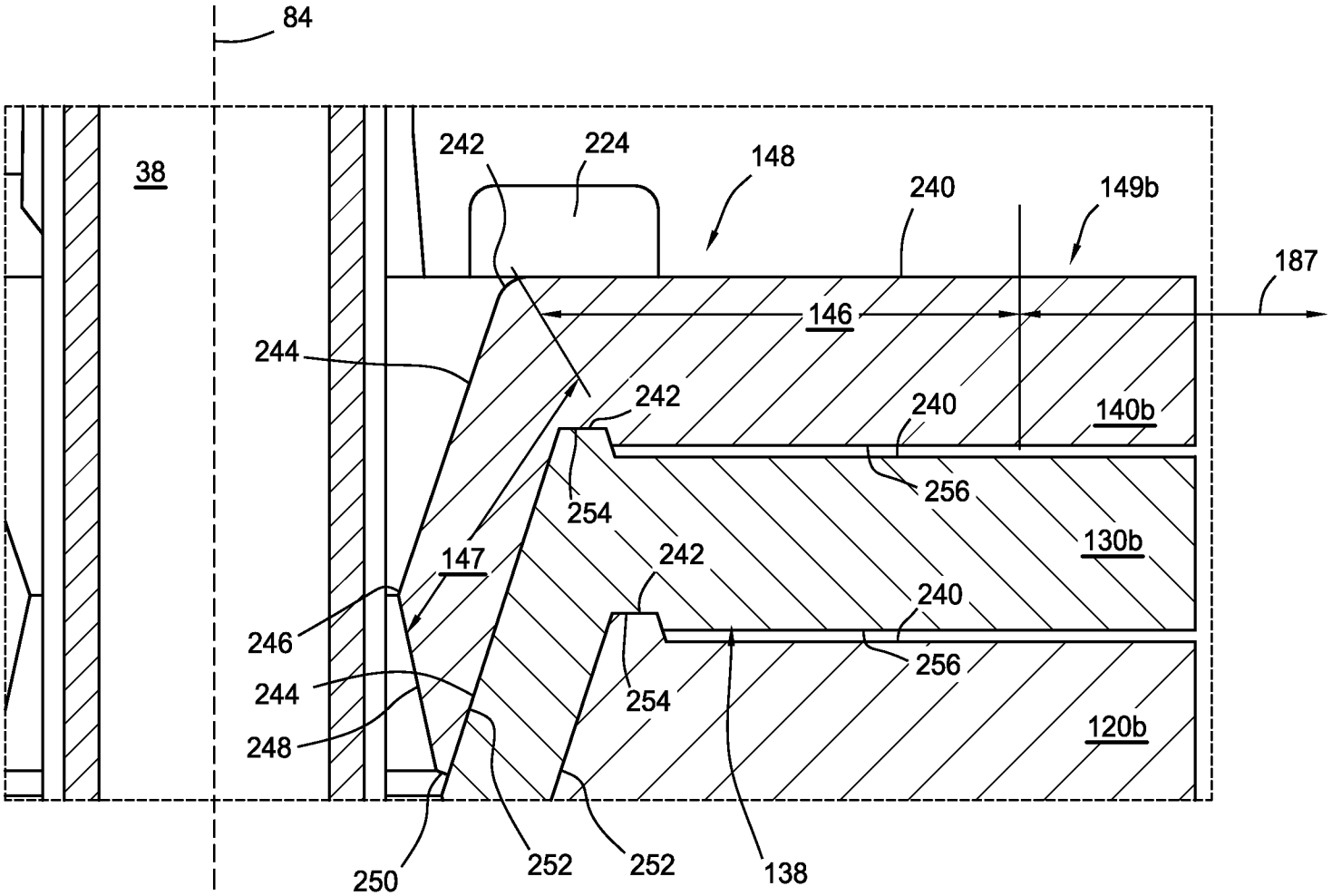
FIG. 8C is a representative detailed cross-sectional view of the portion of the elevator shown in FIG. 8B with an alternative configuration of latches, in accordance with certain embodiments.

FIG. 8C is a detailed cross-sectional view of an alternate configuration of the elevator 100 when viewing the region 8B in FIG. 8A. The jaws 140*b* and 130*b* are similar to those shown in FIG. 8B, except that the lateral portions may be thicker and the tapered portions 147, 137 can have additional engagement surfaces. The top surface 240 of the lateral portion 146 transitions to the concave shaped inner surface 244 of the tapered portion 147 at the transition surface 242 which can be similar to the transition surface 242 of the jaw 140*b* shown in FIG. 8B. However, the transition surface 242 of the jaw 130*b* is noticeably different than the transition surface 242 of the jaw 130*b* in FIG. 8B. The transition surface 254 of the jaw 140*b* forms a circumferential recess in the bottom of the jaw 140*b*. The transition surface 242 of the jaw 130*b* forms a circumferential ridge that engages the circumferential recess 254 of the jaw 140*b*. The engagement of the jaws 140*b* and 130*b* can provide additional engagement surfaces between the adjacent jaws 140*b* and 130*b*. It should be noted that the transition surface 254 of the jaw 110*b* can include a circumferential recess that engages a circumferential ridge on the spacer ring 108 or the transition surface 254 of the jaw 110*b* can be formed without a circumferential recess. Again, the lateral portions of the jaws can be substantially parallel to each other and longitudinally spaced apart similar to the configuration shown in FIG. 8B. However, the lateral portions can alternatively engage each other in addition to the engagement of the tapered portions.

Figure 8D:
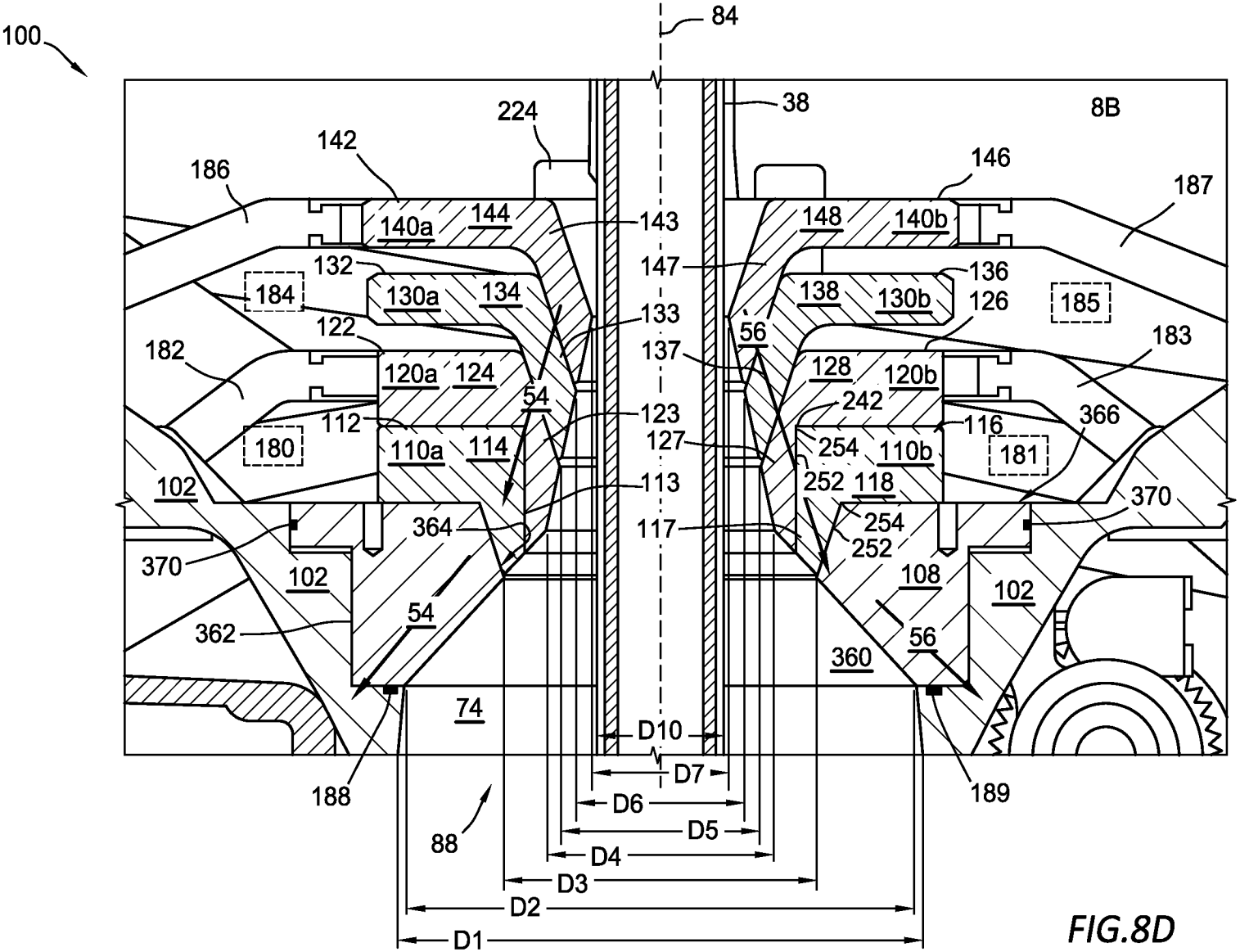
FIG. 8D is a representative cross-sectional view of an elevator with four latches for handling tubulars, the latches being in engaged positions, in accordance with certain embodiments.

FIG. 8D is similar to the elevator 100 shown in FIG. 8A, except that the latches 110, 120 can have a different configuration than those shown in FIG. 8A. The description regarding FIG. 8A above is applicable to FIG. 8D, except for the specific structural differences of the latches 110, 120. The latch 110 in FIG. 8A can be used to engage box ends 39 of tubulars 38, where the latch 110 forms a frustoconical shaped engagement portion that has tapered inner and outer surfaces 244, 252. However, with flanged casing tubulars 38, the top end of the tubular 38 can include a right-angle flange that is not tapered (or at least has a significantly reduced taper compared to drilling tubulars 38) relative to the body of the tubular 38. Therefore, the latch 110 shown in FIG. 8D can be used to engage a right-angle flange of a casing tubular 38. Please note that the surface 242 of the jaw 110*b* is shown as a substantially right-angle transition between the top surface of the jaw 110*b* and the inner surface 244. When the latch 110 is in the engaged position it can form a cylindrically shaped engagement portion with the inner surfaces 244 of the jaws 110*a*, 110*b* forming a cylindrical surface that is generally parallel with a tubular 38 when the tubular 38 is engaged with the elevator 100. An outer surface 252 of the engagement portion can be tapered as shown to interface with the inclined inner surface 364 of the spacer ring 108. The surface 254 of the jaw 110*b* transitions the outer surface 252 to the lower surface of the jaw 110*b*. The latch 110 can be used to engage a casing tubular 38 with a right-angle flange, and the latches 120, 130, 140 can be configured to engage tubulars 38 with a box end 39 having a tapered surface extending between the tubular 38 body and the box end 39. The latch 120 can be modified to accommodate the different structural configuration of the latch 110 by having surfaces 254, 252 of the jaws 120*a*, 120*b* complimentarily formed to engage with surfaces 242, 244, respectively, of jaws 110*a*, 110*b*. It should be understood that the other latches 120, 130, 140 can also be configured to accommodate tubulars 38 with right angled flanges at one end. The latches 110, 120, 130, 140 can operate as described above by being selectively rotated into and out of the engagement position. These latches 110, 120, 130, 140 can be configured with the engagement ridges and recesses as indicated and described regarding FIG. 8C with latch 110 configured to have right angle engagement surfaces without the ridge 242 and the latch 120 configured without the recess 254.

Figure 9:
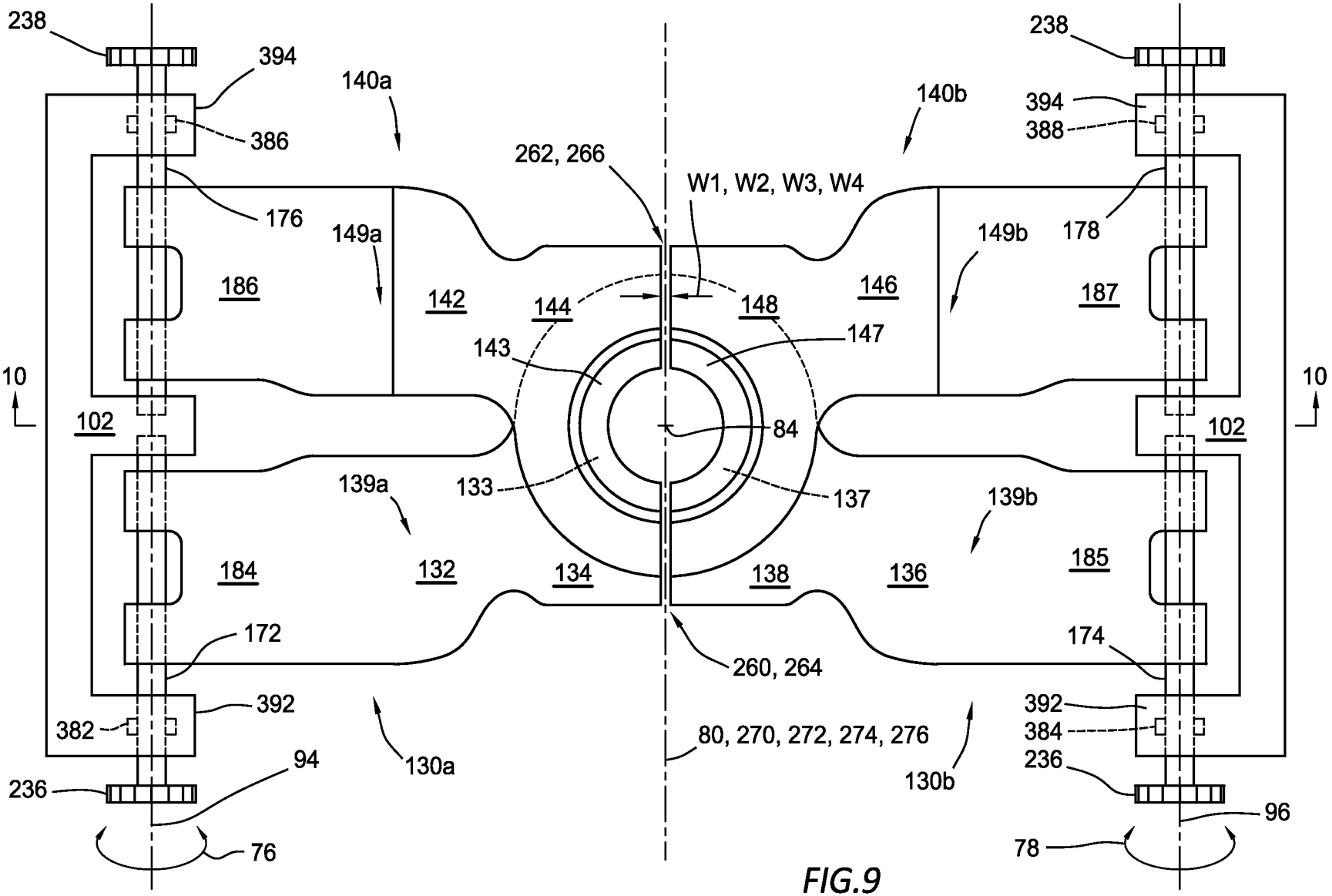
FIG. 9 is a representative top view of an elevator similar to the elevator in FIG. 7, in accordance with certain embodiments.

FIG. 9 is a top view of an elevator similar to the elevator in FIG. 7, except that FIG. 9 shows only the top two latches 130, 140 in an engaged position. The lower latches 110, 120 are removed for clarity, except that a few references that are made to latches 110, 120. The discussion regarding latches 130, 140 can also apply similarly to latches 110, 120. A portion of the housing 102 is shown on both sides of FIG. 9 which indicates rotational attachment points of the latches 130, 140 to the housing 102.

The latch 130 comprises jaws 130*a*, 130*b*, with each jaw 130*a*, 130*b* fixedly attached to a drive shaft 172, 174, respectively, which is rotationally attached to the housing 102. The drive shafts 172, 174 can be rotated 76, 78 about axes 94, 96 by the coupling 236 which can be coupled to a rotary actuator to rotate the drive shafts 172, 174 together, but in opposite directions, as described above. It should be understood that the drive shafts 172, 174 can rotate independently of the drive shafts 176, 178. The drive shafts 172, 174 each extend through a wall 392 of the housing 102 where seals 382, 384, respectively, minimize (or prevent) fluids and/or debris from entering the chamber 106 within the housing 102 where the actuators, couplings and controllers can be contained. Jaw 130*a* includes an attachment portion 184, a joint 139*a*, a lateral portion 132, and a tapered portion 133. Jaw 130*b* includes an attachment portion 185, a joint 139*b*, a lateral portion 136, and a tapered portion 137. When the latch 130 is rotated to the engaged position, the tapered portions 133, 137 form a frusticonically shaped portion, with each of the tapered portions 133, 137 forming a circumferential portion of the frusticonically shaped portion with a gap 264 formed between the portions 133, 137. This gap 264 can have a width W3, which can be approximately 10 mm. It should be understood that the width W3 can be near zero at times if the tapered portions 133, 137 abut each other during operation of the elevator 100. However, the gap 264 can provide clearances during rotation of the latch 130 between engaged and disengaged positions and clearances to allow mud and other fluids to drain through the elevator 100 when the latches are engaged with a tubular 38. The gap 264 can lie in a plane 274 that bisects the frusticonically shaped portion of the latch 130. The plane 274 can be defined by both axes 80 and 84. It should be understood that the plane 274 that bisects the frusticonically shaped portion of the latch 130 can be parallel to the axis 80 and angled relative to the axis 84. This can result in an angled face of the tapered portions 133, 137 relative to the axis 84.

It should also be understood that the gap 264 can have a width W3 that increases or decreases along the longitudinal length of the gap 274.

The latch 140 comprises jaws 140*a*, 140*b*, with each jaw 140*a*, 140*b* fixedly attached to a drive shaft 176, 178, respectively, which is rotationally attached to the housing 102. The drive shafts 176, 178 are rotated 76, 78 about axes 94, 96 by the coupling 238 which can be coupled to a rotary actuator to rotate the drive shafts 176, 178 together, but in opposite directions, as described above. The drive shafts 176, 178 each extend through a wall 394 of the housing 102 where seals 386, 388, respectively, minimize (or prevent) fluids and/or debris from entering the chamber 106 within the housing 102 where the actuators, couplings and controllers can be contained. Jaw 140*a* includes an attachment portion 186, a joint 149*a*, a lateral portion 142, and a tapered portion 143. Jaw 140*b* includes an attachment portion 187, a joint 149*b*, a lateral portion 146, and a tapered portion 147. When the latch 140 is rotated to the engaged position, the tapered portions 143, 147 form a frusticonically shaped portion, with each of the tapered portions 143, 147 forming a circumferential portion of the frusticonically shaped portion with a gap 266 formed between the portions 143, 147. This gap 266 can have a width W4, which can be approximately 10 mm. It should be understood that the width W4 can be near zero at times if the tapered portions 144, 148 abut each other during operation of the elevator 100. However, the gap 266 can also provide clearances during rotation of the latch 140 between engaged and disengaged positions. The gap 266 can lie in a plane 276 that bisects the frusticonically shaped portion of the latch 140. The plane 276 can be defined by both axes 80 and 84. It should be understood that the plane 276 that bisects the frusticonically shaped portion of the latch 140 can be parallel to the axis 80 and angled relative to the axis 84. This can result in an angled face of the tapered portions 143, 147 relative to the axis 84. It should also be understood that the gap 266 can have a width W4 that increases or decreases along the longitudinal length of the gap 276.

It should be understood that the latches 110, 120, which are not shown, may include gaps 260, 262 with widths W1, W2, respectively, and can lie in planes 270, 272, respectively. The widths W1, W2 can be approximately 10 mm. It should be understood that the widths W1 or W2 can be near zero at times if the tapered portions 113, 117 or 123, 127 abut each other during operation of the elevator 100. However, the gaps 260 and 262 can provide clearances during rotation of the respective latches 110, 120 between engaged and disengaged positions and clearances to allow mud and other fluids to drain through the elevator 100 when the latches are engaged with a tubular 38. The planes 270, 272 can be defined by both axes 80, 84 or they can be parallel to the axis 80 and angled relative to the axis 84. This can result in an angled face of the tapered portions 113, 117 and 123, 127 relative to the axis 84. It should also be understood that the gap 260 can have a width W1 that increases or decreases along the longitudinal length of the plane 270. It should also be understood that the gap 262 can have a width W2 that increases or decreases along the longitudinal length of the plane 272.

Figure 10:
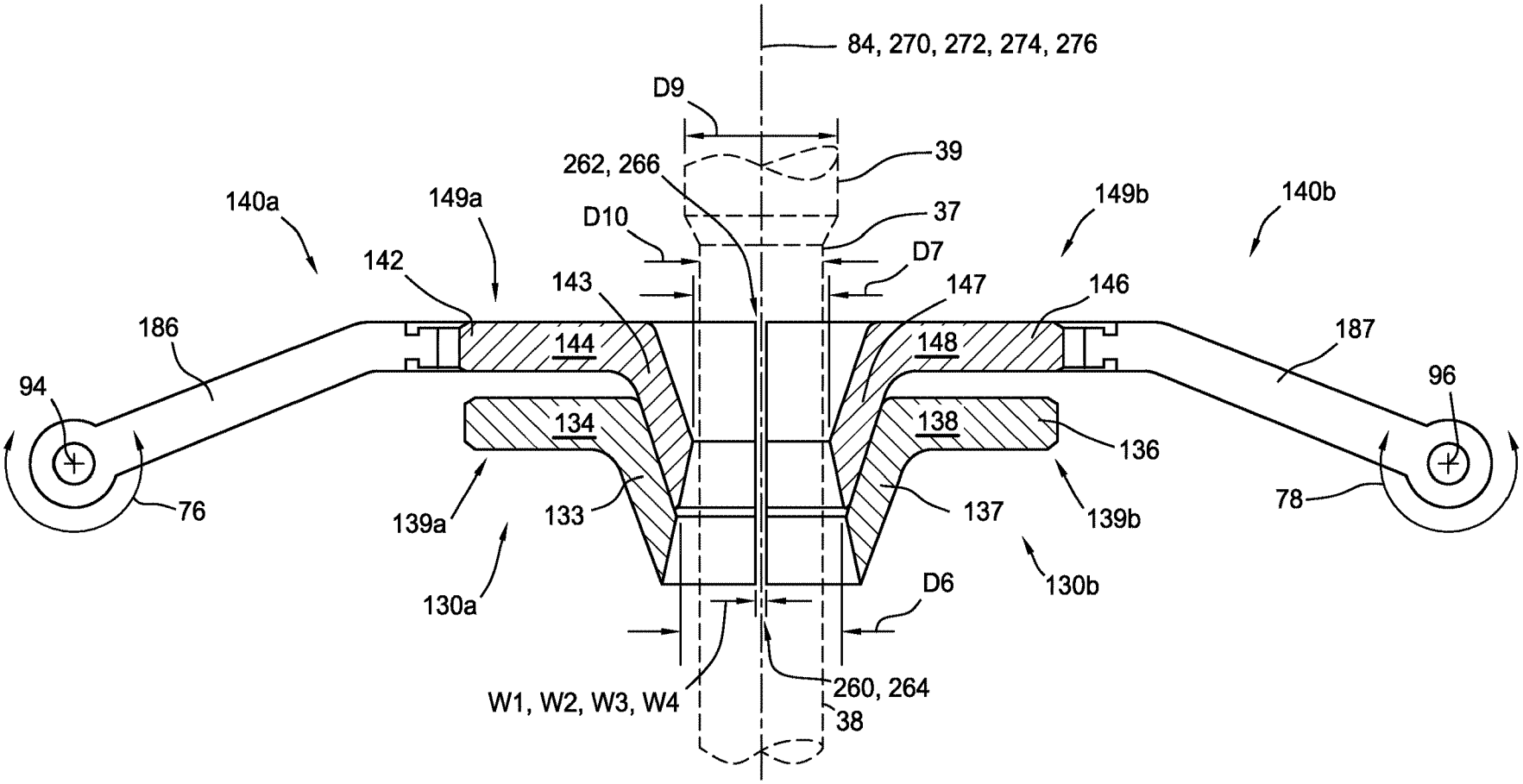
FIG. 10 is a representative cross-sectional view 10-10 of an elevator with at least two latches for handling tubulars, the latches being in engaged positions, in accordance with certain embodiments.

FIG. 10 is a cross-sectional view of the elevator 100 of FIG. 9 with the latches 130, 140 being in engaged positions. As can be seen, the tapered portions 143, 147 of the latch 140 engage the tapered portions 133, 137 of the latch 130 when these latches 130, 140 are in the engaged positions. The tapered portions 133, 137 form a frusticonically shaped portion of the latch 130 with a gap 264 having a width W3. The tapered portions 143, 147 form a frusticonically shaped portion of the latch 140 with a gap 266 having a width W4. In this configuration, the gaps 264, 266 are aligned with each other and lie in a respective plane 274, 276, which are both defined by axes 80, 84. The frusticonically shaped portion of the latch 130 has a minimum diameter D6. The frusticonically shaped portion of the latch 140 has a minimum diameter D7.

Figure 11:
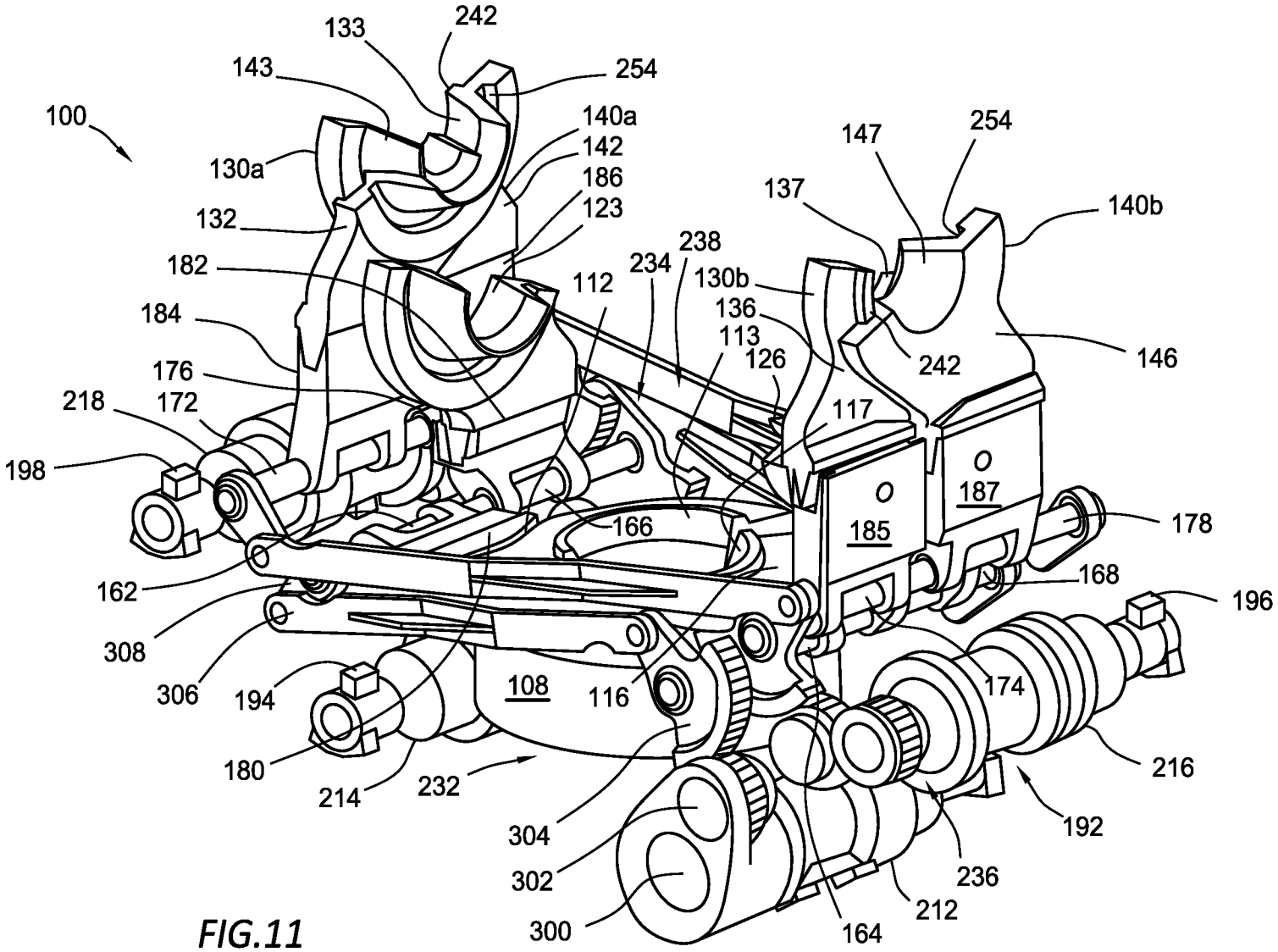
FIG. 11 is a representative cut-away perspective view of an elevator with four latches, including rotary actuators, for handling tubulars, the latches being in various engaged or disengaged positions, in accordance with certain embodiments.

FIG. 11 is a cut-away perspective view of an elevator 100 with four latches 110, 120, 130, 140 operated by rotary actuators 212, 214, 216, 218, respectively. The actuator 212 has been operated to rotate the latch jaws 110*a*, 110*b* into an engaged position. Therefore, the actuator 212 rotated, via the coupling 232, the drive shafts 162, 164 thereby rotating the jaws 110*a*, 110*b* into the engaged position. The tapered portions 113, 117 form the frusticonically shaped portion of the latch 110. The coupling 232 can include a drive gear 300 fixedly connected to a rotor of the rotary actuator, the gear 300 can be coupled to a gear 302 that couples to a gear 304. The gear 304 can be fixedly attached to the drive shaft 164 which is rotated when the gear 304 is rotated. The gear 304 can also be coupled to a lever arm 308 via a link 306. The lever arm 308 can be fixedly attached to the drive shaft 162. When the gear 304 is rotated in one direction, the link 306 operates to move the lever arm 308 such that is rotates the drive shaft 162 in an opposite direction.

Couplings 234, 236, 238 that couple the other rotary actuators 214, 216, 218 to the latches 120, 130, 140, respectively, can be similar to the coupling 232, or they can be different as needed to rotate the jaws in each jaw pair 120*a,b*, 130*a,b*, 140*a,b* in opposite directions to rotate the jaw pairs between engaged and disengaged positions. The jaw pairs 120*a,b*, 130*a,b*, 140*a,b* are shown in a disengaged position in FIG. 11. It can also be seen in FIG. 11, how the extended circumferential ridge 242 on one jaw (e.g., 130*b*) engages a circumferential recess 254 on an adjacent jaw (e.g., 140*b*).

Additionally, the rotary actuators 212, 214, 216, 218 can include sensors 192, 194, 196, 198 attached the respective actuator that provides the rotational position of the rotary actuator at any time. Therefore, by sending the positional information to a controller (e.g., 50) the position of the latches 110, 120, 130, 140 can be determined with a high degree of certainty. Because the drive shafts that drive the latches are sealed to the housing 102 where they extend through a wall of the housing 102, then the position sensors 192, 194, 196, 198 are protected from the harsh fluids and debris present outside the sealed chamber 106 of the housing 102.

The elevator 100 of FIG. 11 is similar to the elevator 100 in FIG. 6, except that the gaps in the frusticonically shaped portions of the latches 110, 120, 130, 140, are not aligned with gaps in the frusticonically shaped portions of adjacent latches. As can be seen, the gap when the latch 140 is engaged between the frusticonically shaped portions 143, 147 will be circumferentially offset from the gap between the frusticonically shaped portions 133, 137 in an engaged position. The other latches 110, 120 have respective gaps 160, 162 which can also be circumferentially offset from other gaps of the latches.

Figure 12:
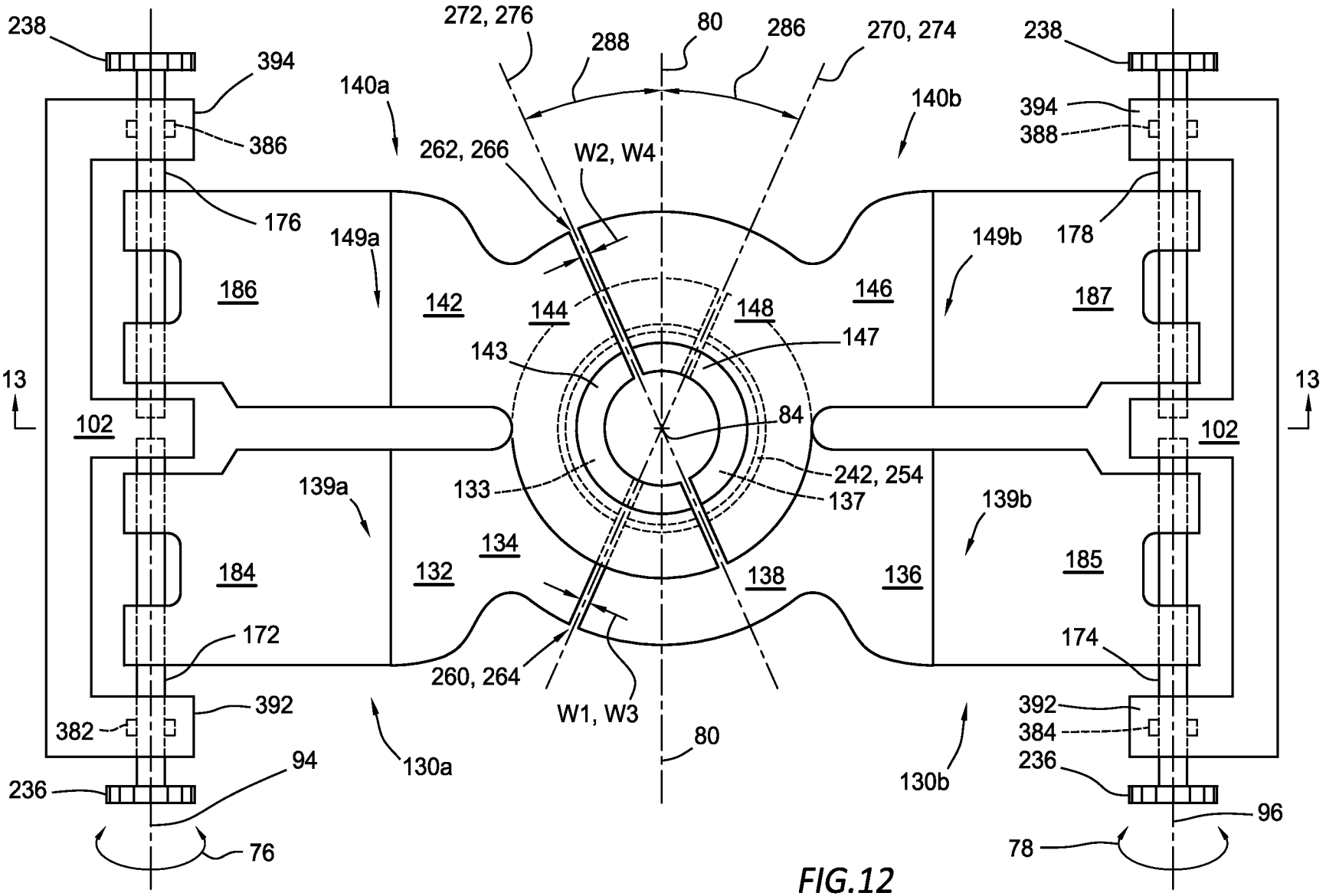
FIG. 12 is a representative top view of an elevator similar to the elevator in FIG. 11 for handling tubulars, the latches being in engaged positions, in accordance with certain embodiments.

FIG. 12 is a top view of an elevator 100 similar to the elevator in FIG. 11 for handling tubulars, the latches 130, 140 being in an engaged position. The lower latches 110, 120 are removed for clarity, except that a few references that are made to latches 110, 120. The discussion regarding latches 130, 140 can also apply similarly to latches 110, 120. A portion of the housing 102 is shown on both sides of FIG.

12 which indicates rotational attachment points of the latches 130, 140 to the housing 102.

The latch 130 comprises jaws 130*a*, 130*b*, with each jaw 130*a*, 130*b* fixedly attached to a drive shaft 172, 174, respectively, which is rotationally attached to the housing 102. The drive shafts 172, 174 can be rotated 76, 78 about axes 94, 96 by the coupling 236 which can be coupled to a rotary actuator to rotate the drive shafts 172, 174 together, but in opposite directions, as described above. It should be understood that the drive shafts 172, 174 can rotate independently of the drive shafts 176, 178. The drive shafts 172, 174 each extend through a wall 392 of the housing 102 where seals 382, 384, respectively, minimize (or prevent) fluids and/or debris from entering the chamber 106 within the housing 102 where the actuators, couplings and controllers can be contained. Jaw 130*a* includes an attachment portion 184, a joint 139*a*, a lateral portion 132, and a tapered portion 133. Jaw 130*b* includes an attachment portion 185, a joint 139*b*, a lateral portion 136, and a tapered portion 137. When the latch 130 is rotated to the engaged position, the tapered portions 133, 137 form a frusticonically shaped portion, with each of the tapered portions 133, 137 forming a circumferential portion of the frusticonically shaped portion with a gap 264 formed between the portions 133, 137. This gap 264 can have a width W3. It should be understood that the width W3 can be near zero at times if the tapered portions 133, 137 abut each other during operation of the elevator 100. However, the gap 264 can also provide clearances during rotation of the latch 130 between engaged and disengaged positions. The gap 264 can lie in a plane 274 that bisects the frusticonically shaped portion of the latch 130. The plane 274 can be parallel to the axis 84 and angled relative to the axis 80 by a circumferential offset 286. It should be understood that the plane 274 that bisects the frusticonically shaped portion of the latch 130 can be angled relative to the axis 80 and angled relative to the axis 84. This can result in an angled face of the tapered portions 133, 137 relative to the axis 84 and circumferentially offset from the axis 80. It should also be understood that the gap 264 can have a width W3 that increases or decreases along the longitudinal length of the gap 274.

The latch 140 comprises jaws 140*a*, 140*b*, with each jaw 140*a*, 140*b* fixedly attached to a drive shaft 176, 178, respectively, which is rotationally attached to the housing 102. The drive shafts 176, 178 are rotated 76, 78 about axes 94, 96 by the coupling 238 which can be coupled to a rotary actuator to rotate the drive shafts 176, 178 together, but in opposite directions, as described above. The drive shafts 176, 178 each extend through a wall 394 of the housing 102 where seals 386, 388, respectively, minimize (or prevent) fluids and/or debris from entering the chamber 106 within the housing 102 where the actuators, couplings and controllers can be contained. Jaw 140*a* includes an attachment portion 186, a joint 149*a*, a lateral portion 142, and a tapered portion 143. Jaw 140*b* includes an attachment portion 187, a joint 149*b*, a lateral portion 146, and a tapered portion 147. When the latch 140 is rotated to the engaged position, the tapered portions 143, 147 form a frusticonically shaped portion, with each of the tapered portions 143, 147 forming a circumferential portion of the frusticonically shaped portion with a gap 266 formed between the portions 143, 147. This gap 266 can have a width W4. It should be understood that the width W4 can be near zero at times if the tapered portions 144, 148 abut each other during operation of the elevator 100. However, the gap 266 can also provide clearances during rotation of the latch 140 between engaged and disengaged positions. The gap 266 can lie in a plane 276 that bisects the frusticonically shaped portion of the latch 140. The plane 276 can be parallel to the axis 84 and angled relative to the axis 80 by a circumferential offset 288. It should be understood that the plane 276 that bisects the frusticonically shaped portion of the latch 140 can be angled relative to the axis 80 and angled relative to the axis 84. This can result in an angled face of the tapered portions 143, 147 relative to the axis 84 and circumferentially offset from the axis 80. It should also be understood that the gap 266 can have a width W4 that increases or decreases along the longitudinal length of the gap 276.

It should be understood that the latches 110, 120, which are not shown, may include gaps 260, 262 with widths W1, W2, respectively, and can lie in planes 270, 272, respectively. The planes 270, 272 can be parallel to the axis 84 and angled relative to the axis 80 by a circumferential offset 286, 288, respectively, or the planes 270, 272 can be angled relative to the axis 80 and angled relative to the axis 84. This can result in an angled face of the tapered portions 113, 117 and 123, 127 relative to the axis 84 and circumferentially offset from the axis 80. It should also be understood that the gap 260 can have a width W1 that increases or decreases along the longitudinal length of the plane 270. It should also be understood that the gap 262 can have a width W2 that increases or decreases along the longitudinal length of the plane 272.

Figure 13:
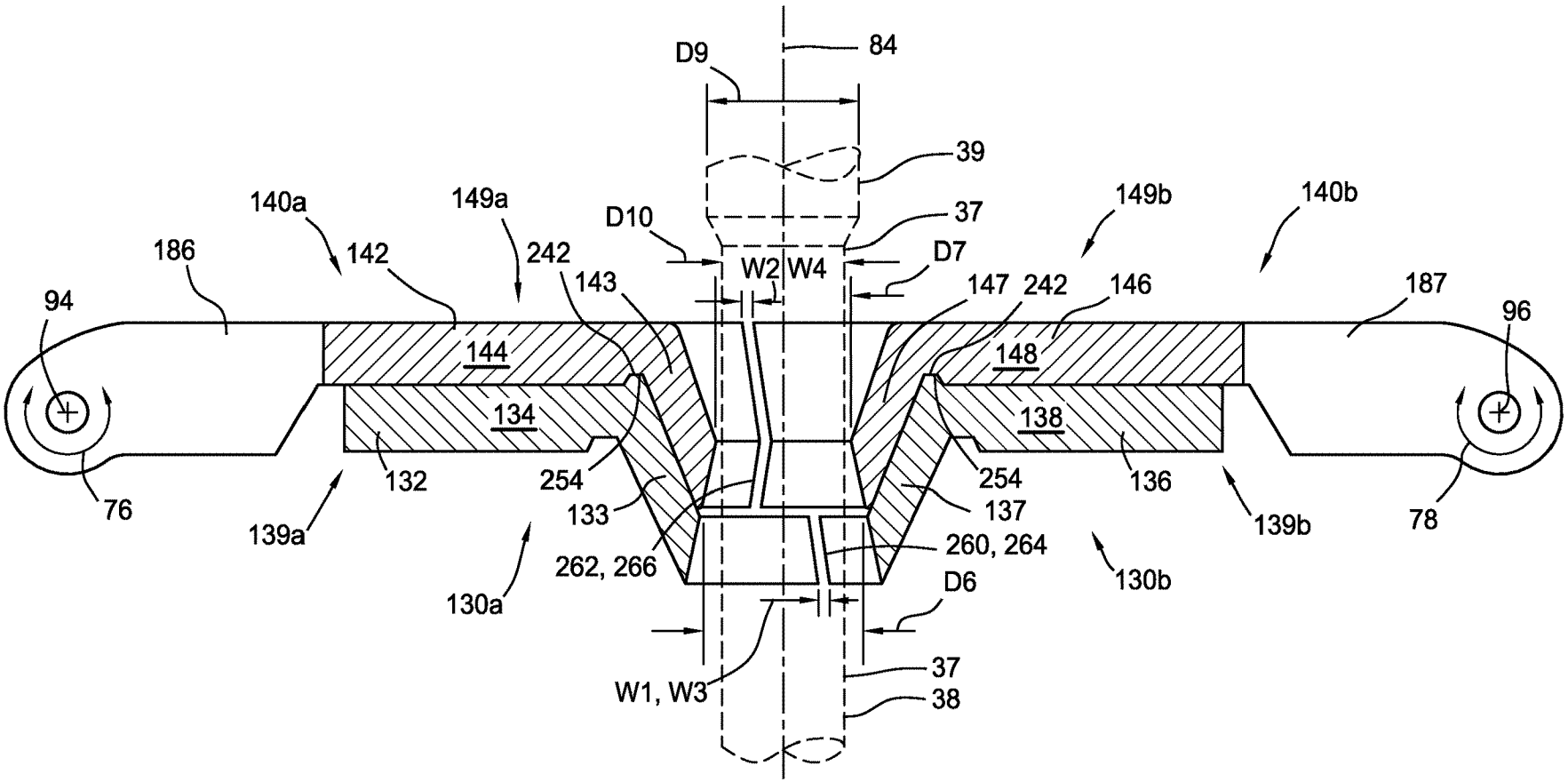
FIG. 13 is a representative cross-sectional view 13-13 of an elevator with at least two latches for handling tubulars, the latches being in engaged positions, in accordance with certain embodiments.

FIG. 13 is a cross-sectional view of the elevator 100 of FIG. 9 with the latches 130, 140 being in engaged positions. As can be seen, the tapered portions 143, 147 of the latch 140 engage the tapered portions 133, 137 of the latch 130 when these latches 130, 140 are in the engaged positions. The tapered portions 133, 137 form a frusticonically shaped portion of the latch 130 with a gap 264 having a width W3. The tapered portions 143, 147 form a frusticonically shaped portion of the latch 140 with a gap 266 having a width W4. In this configuration, the gaps 264, 266 are circumferentially offset from each other. The frusticonically shaped portion of the latch 130 has a minimum diameter D6. The frusticonically shaped portion of the latch 140 has a minimum diameter D7.

The jaws 130*a*, 130*b*, 140*a*, 140*b* are configured similar to the jaws 130*b*, 140*b* in the cross-sectional view of FIG. 8C with the circumferential recess 242 of jaws 140*a*, 140*b* engaging the circumferential ridge 254 of jaws 130*a*, 130*b*. The configuration of the jaws in FIG. 13 also includes a minimal gap (if any at all) between the lateral portions 142, 132, and between the lateral portions 146, 136. However, there can be a gap between the lateral portions if desired.

Also, the configuration of the jaws 130*a*, 130*b*, 140*a*, 140*b* in FIG. 13 illustrate that the attachment portions 184 (not shown) and 186 are parallel to each other and generally within a same plane, and that the attachment portions 185 (not shown) and 187 are parallel to each other and generally within a same plane. At a transition between the attachment portions and the lateral portions, the laws transition from a thicker attachment portion to a narrower lateral portion that allows adjacent lateral portions to overlap each other, as where the attachment portions 184, 186 and the attachment portions 185 and 187 do not overlap each other.

It should be understood that each pair of jaws, 110*a-b*, 120*a-b*, 130*a-b*, 140*a-b* can have a male/female mating feature with the male mating feature being on one of the jaws in the jaw pair and the female mating feature being on the other one of the jaws in the jaw pair. The male mating feature may engage the female mating feature when the jaw pair 110*a-b*, 120*a-b*, 130*a-b*, 140*a-b* is in the engaged position. The engagement of the male mating feature with the female mating feature can provide additional resistance to the jaw pair being pushed apart when a tubular 38 is being held by the elevator 100. For example, the male mating feature may be a bolt and the female mating feature may be a hole, with the bolt engaging the hole when the jaw pair is in the engaged (or closed) position. Additionally, the male mating feature may be a ridge and the female mating feature may be a groove, with the ridge engaging the groove when the jaw pair is in the engaged (or closed) position.

Figure 14A:
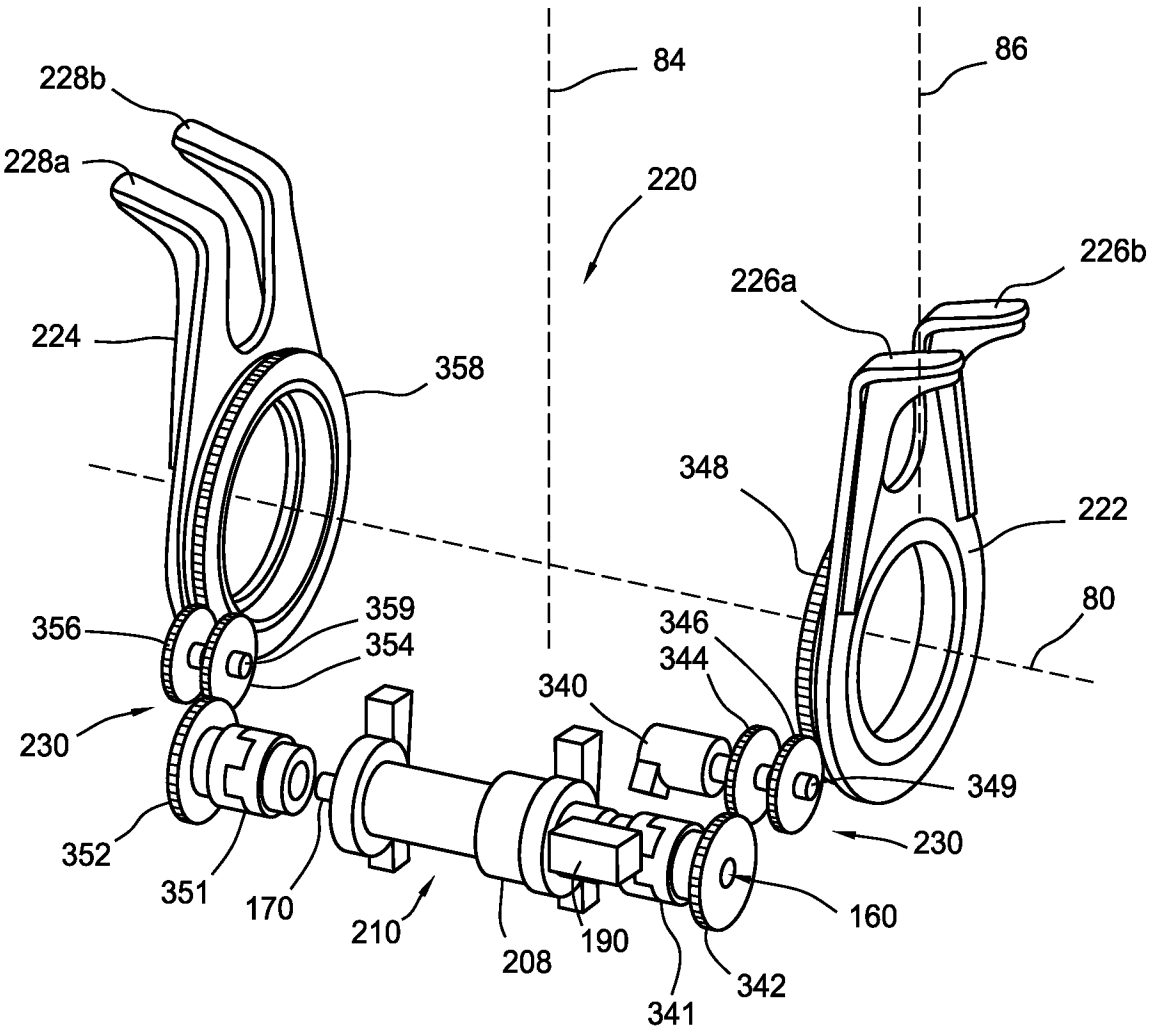
FIG. 14A is a representative cut-away perspective view of a link interface of an elevator for handling tubulars with components of the elevator other than the link interface components removed, in accordance with certain embodiments.

FIG. 14A is a cut-away perspective view of a link interface 220 of an elevator 100 for handling tubulars 38 with other components of the elevator removed for clarity. The link interface system 220 is used to rotate the housing 102 of the elevator 100 relative to the pair of links 44, which include a link axis 86. The link interface system 220 can include a rotary actuator 210 that includes a body 208 and drive shafts 160, 170. The drive shafts 160, 170 can be coupled to respective link interfaces 222, 224 via the coupling 230. Each of the link interfaces 222, 224 can be configured to retain one of the links 44 in a fixed azimuthal relationship with the respective link interface 222, 224 relative to the axis 80.

The link interface 222 can include angled flanges 226*a*, 226*b* that straddle the respective link 44 to prevent any substantially rotational movement between the link interface 222 and the respective link 44. Therefore, the link interface 222 is rotationally fixed at the azimuthal position of the link axis 86 relative to the axis 80, even though some minor rotation between the link interface 222 and the respective link 44 can occur. The engagement of the angled flanges 226*a*, 226*b* with the respective link 44 can cause the housing 102 to be rotated relative to the axis 80.

The link interface 224 can include angled flanges 228*a*, 228*b* that straddle the respective link 44 to prevent any substantially rotational movement between the link interface 224 and the respective link 44. Therefore, the link interface 224 is rotationally fixed at the azimuthal position of the link axis 86 relative to the axis 80, even though some minor rotation between the link interface 224 and the respective link 44 can occur. The engagement of the angled flanges 228*a*, 228*b* with the respective link 44 can cause the housing 102 to be rotated relative to the axis 80. The link interfaces 222, 224 are configured to rotate together to act on each link 44 of the pair of links 44 that couple the elevator 100 to a top drive 42 (or other hoisting mechanism) to rotate the housing 102 relative to the links 44.

The drive shaft 160 can be coupled to the link interface 222 via the drive shaft interface 341 and gear 342 that are fixed to the drive shaft 160. The gear 342 can be coupled to a gear 344 that is rotationally fixed to a gear 346 via shaft 349. The shaft 349 can be extended through a wall of the housing 102 and sealed at the wall to allow the rotary actuator 210 and the sensors 190, 340 to be disposed in a sealed chamber 106 to separate them from the harsh environment of the latches. The gears 344 and 346 can be connected to a position sensor 340 to can detect the rotation applied to the link interface 222 and send that position data to a controller for determining the azimuthal orientation of the housing 102 relative to the links 44. Alternatively, or in addition to, a position sensor 190 can be coupled to the drive shaft 160 to determine and report a rotational position of the drive shaft 160, which the controller (e.g., 50) can use to determine the orientation of the housing 102 relative to the links 44. The gear 346 can be coupled to a gear 348 that is rotationally fixed to the link interface 222. Therefore, rotating the drive shaft 160, causes the gear 348 to rotate, which causes the link interface 222 to rotate relative to the housing 102, and thereby rotates the housing 102 relative to the link axis 86. The direction of rotation of the drive shaft 160 determines the direction of rotation of the housing 102 relative to the link axis 86 due to the coupling 230.

The drive shaft 170 can be coupled to the link interface 224 via the drive shaft interface 351 and gear 352 that are fixed to the drive shaft 170. The gear 352 can be coupled to a gear 354 that is rotationally fixed to a gear 356 via shaft 359. The shaft 359 can be extended through a wall of the housing 102 and sealed at the wall to allow the rotary actuator 210 and the sensors 190, 340 to be disposed in a sealed chamber 106 to separate them from the harsh environment of the latches. The gear 356 can be coupled to a gear 358 that is rotationally fixed to the link interface 224. Therefore, rotating the drive shaft 170, causes the gear 358 to rotate, which causes the link interface 224 to rotate relative to the housing 102, and thereby rotates the housing 102 relative to the link axis 86. The direction of rotation of the drive shaft 170 determines the direction of rotation of the housing 102 relative to the link axis 86 due to the coupling 230. Since the rotation of the drive shafts 160 and 170 are the same, then the gears 348 and 358 rotate the link interfaces 222, 224 in the same direction.

Figure 14B:
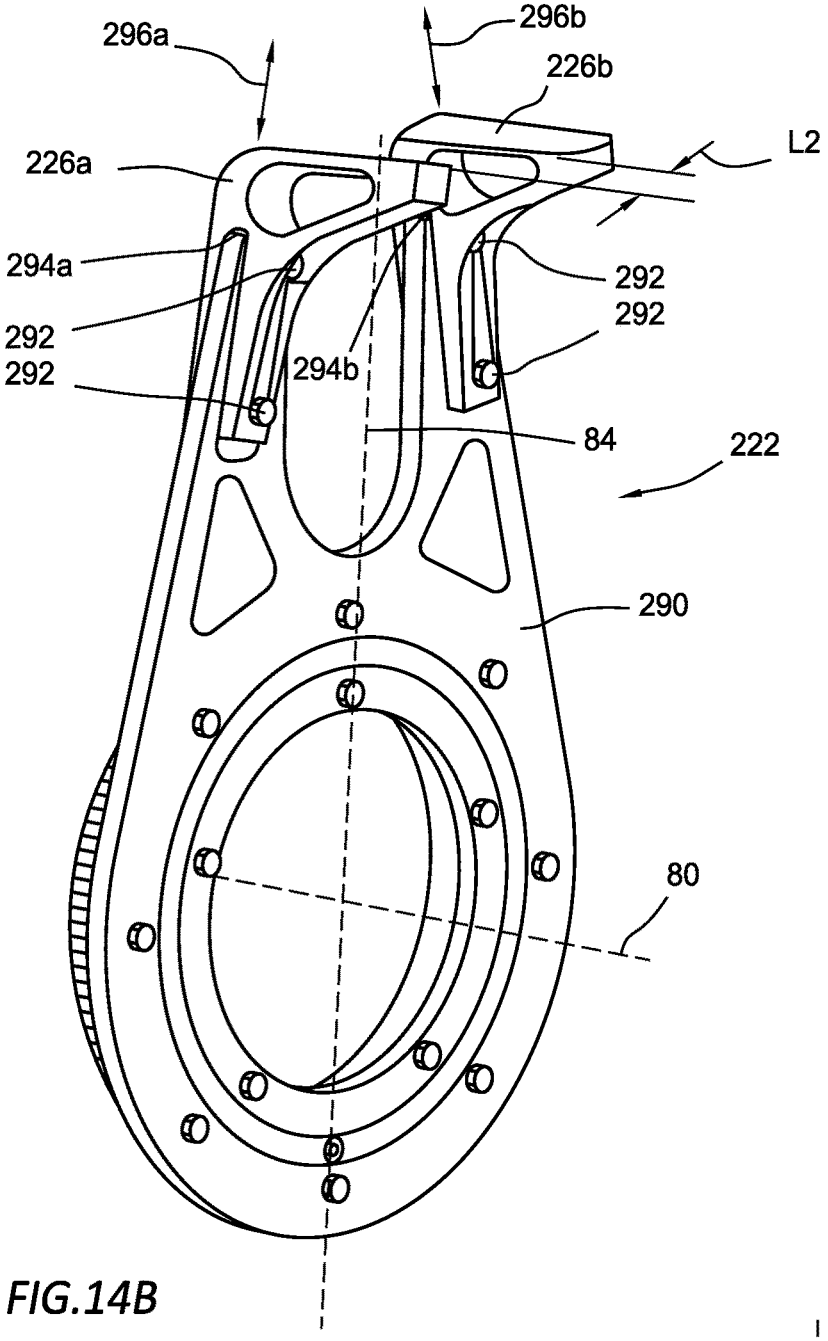
FIG. 14B is a representative perspective view of an adjustable link interface of an elevator, in accordance with certain embodiments.

FIG. 14B is a representative perspective view of a link interface 222, which is one of a pair of link interfaces 222, 224. The pair of link interfaces 222, 224 can engage the pair of links 44 to allow the elevator to be tilted relative to the links 44. The link interface 222 is configured to support various diameters of a link 44. By extending or retracting the angled flanges 226*a*, 226*b* (see arrows 296*a*, 296*b*, respectively), the clearance L2 can be adjusted to accommodate links 44 of various diameters. As shown in FIG. 7, the link 44 can engage the link retainer 400 at the end of the link 44. The angled flanges 226*a*, 226*b* can straddle a portion of the link 44 that is spaced away from the end of the link 44. This portion has a diameter that can vary between different links 44. By adjusting the clearance L2, the angled flanges 226*a*, 226*b* can snug up against the link 44 to minimize play between the link interface 220 and the link 44.

Each of the angled flanges 226*a*, 226*b* can include a recess 294*a*, 294*b*, respectively into which a portion of the body 290 can be inserted. The angled flanges 226*a*, 226*b* can be secured to the body 290 by tightening the fasteners 292, which can prevent moving (arrows 296*a*, 296*b*) the angled flanges 226*a*, 226*b* relative to the body 290. To reduce the clearance L2, the fasteners 292 can be loosened allowing the angled flanges 226*a*, 226*b* to be extended away from the body 290. Since the angled flanges 226*a*, 226*b* are angled toward each other, the extension will reduce the clearance L2 between the angled flanges 226*a*, 226*b*. To enlarge the clearance L2, the fasteners 292 can be loosened allowing the angled flanges 226*a*, 226*b* to be retracted toward the body 290. Since the angled flanges 226*a*, 226*b* are angled toward each other, the retraction will enlarge the clearance L2 between the angled flanges 226*a*, 226*b*. Similarly, the link interface 224 can also include moveable angled flanges 226*a*, 226*b*, 228*a*, 228*b*. As can be seen, the link interfaces 222, 224 can include moveable angled flanges 226*a*, 226*b*, 228*a*, 228*b*, respectively, as shown in FIG. 14B, or the link interfaces 222, 224 can include angled flanges 226*a*, 226*b*, 228*a*, 228*b*, respectively, that are integral to the link interfaces 222, 224, as shown in FIG. 14A.

Figure 15:
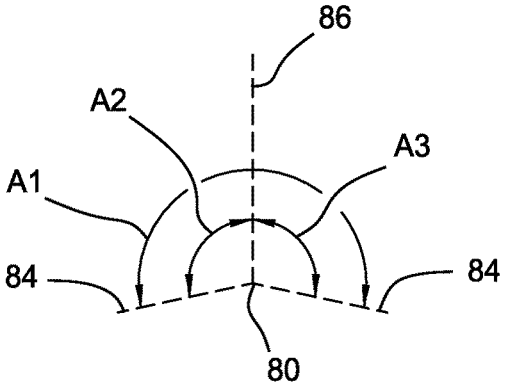
FIG. 15 is a representative diagram that illustrates rotation angles of the elevator relative to the links, in accordance with certain embodiments.

FIG. 15 shows the rotational movement of the housing 102 (and thus the elevator 100) relative to the link axis 86 (and thus the links 44). The central axis 84 of the housing 102 can be rotated counterclockwise about axis 80 relative to the link axis 86 by a rotational angle A2 and rotated clockwise about axis 80 relative to the link axis 86 by a rotational angle A3. A2 can be expressed in – (negative) degrees such a –102 degrees while A3 can be expressed in + (positive) degrees such as +102 degrees.

The angle A2 can be in the range of "0" degrees to –95 degrees. The angle A3 can be in the range of "0" degrees to +102 degrees. Therefore, the arc A1 can be in the range of 204 degrees (i.e., from –102 degrees to +102 degrees). Therefore, the housing 102 can rotate between –102 degrees and +102 degrees about the axis 80 relative to the link axis 86. The housing 102 can rotate +/–4 degrees, +/–8 degrees, +/–12 degrees, +/–16 degrees, +/–20 degrees, +/–24 degrees, +/–28 degrees, +/–32 degrees, +/–36 degrees, +/–40 degrees, +/–44 degrees, +/–48 degrees, +/–52 degrees, +/–56 degrees, +/–60 degrees, +/–64 degrees, +/–68 degrees, +/–72 degrees, +/–76 degrees, +/–80 degrees, +/–84 degrees, +/–88 degrees, +/–92 degrees, +/–95 degrees, +/–96 degrees, +/–100 degrees, and +/–102 degrees.

Figure 16:
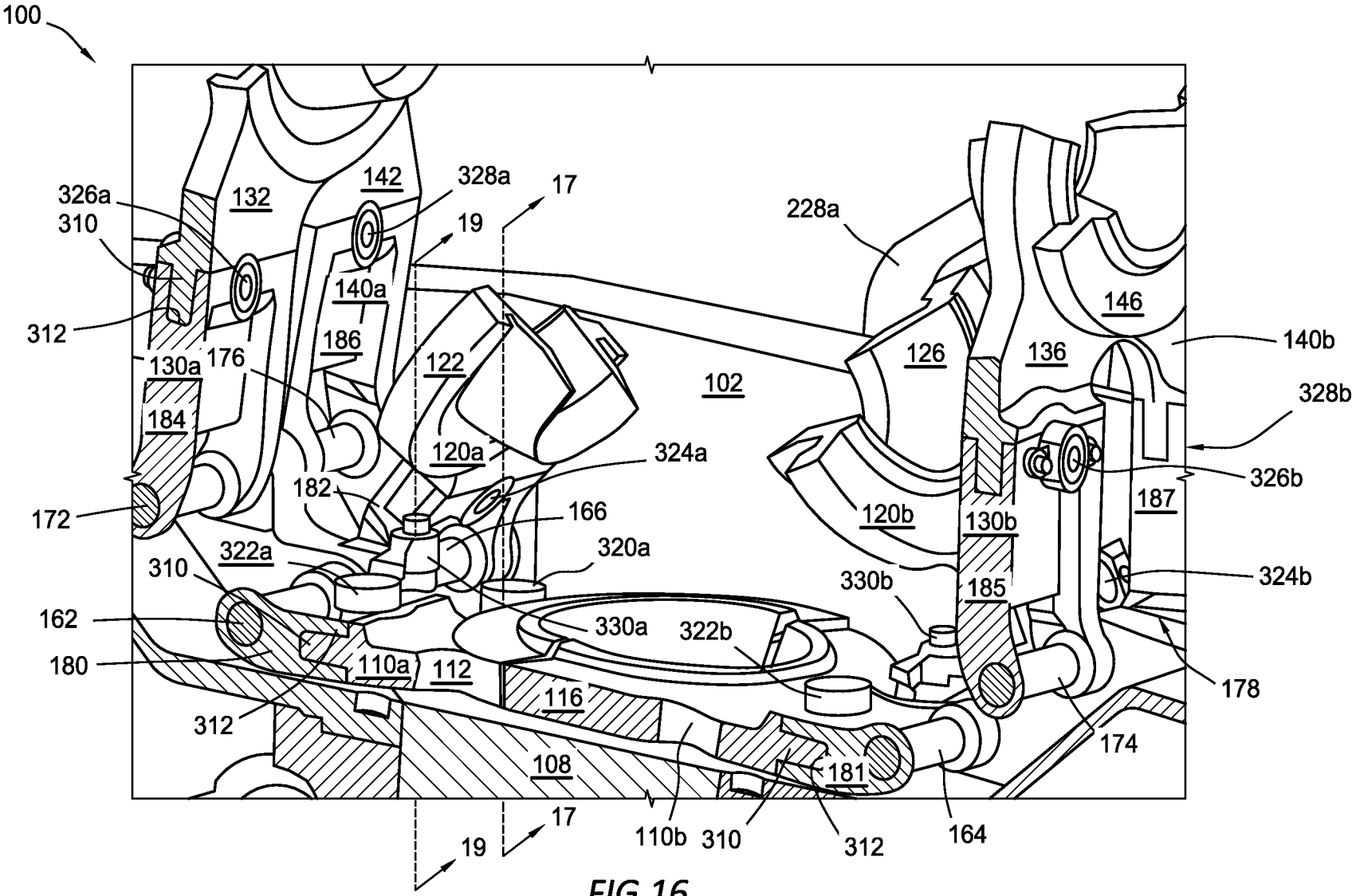
FIG. 16 is a representative detailed cross-sectional perspective view of an elevator with an alternative configuration of latches, in accordance with certain embodiments.

FIG. 16 shows a detailed cross-sectional perspective view of an elevator with latches generally configured as the latches 110, 120, 130, 140 in FIG. 11 with the extended ridges and recesses for engaging adjacent latches, and the rotationally offset gaps between adjacent latches. However, the elevator in FIG. 16 illustrates locks 322*a-b*, 324*a-b*, 326*a-b*, 328*a-b* for respective jaws 110*a-b*, 120*a-b*, 130*a-b*, 140*a-b* that retain the lateral portion 112, 116, 122, 126, 132, 136, 142, 146 of each jaw to the respective attachment portion 180, 181, 182, 183, 184, 185, 186, 187 of each jaw. The lock for the jaw 110*a* will now be described with its description being generally applicable to the other jaws 110*b*, 120*a-b*, 130*a-b*, 140*a-b*.

The jaw 110*a* includes a lateral portion 112 with a protruding lip 310 that can be inserted into a recess 312 in the attachment portion 180. A lock 322*a* can extend through the jaw where recess 312 straddles the lip 310. The lock can be rotated to secure the lateral portion 112 to the attachment portion 180 or rotated to release the lateral portion 112 from the attachment portion 180. The lock 322*a* can have a feature that has a smaller width in a first position and a wider width in second position. Rotating the lock 322*a* rotates the feature between first and second positions. When the feature is in the smaller width position, the lateral portion 112 can be removed from or inserted into the attachment portion 180. When the feature is in the wider width position, the lateral portion 112 can be secured to the attachment portion 180 to prevent removal of the lip 310 from the recess 312. However, the lock 322*a* can be configured to allow some relative axial motion between the lip 310 and the recess 312, such that forces applied to the latch 110 when it is in an engaged position and a tubular 38 is engaged with the latch 110 are prevented (or at least minimized) from being transmitted through the lateral portion 112 to the attachment portion 180 via engagement of the lip 310 with the recess 312. This can reduce forces experienced by the drive shaft 162 during operation of the elevator 100. To remove the lateral portion 112 (and thus the engagement portion 114) from the attachment portion 180, the lock 322*a* can be disengaged allowing the lip 310 to be removed from the recess 312.

Figure 17:
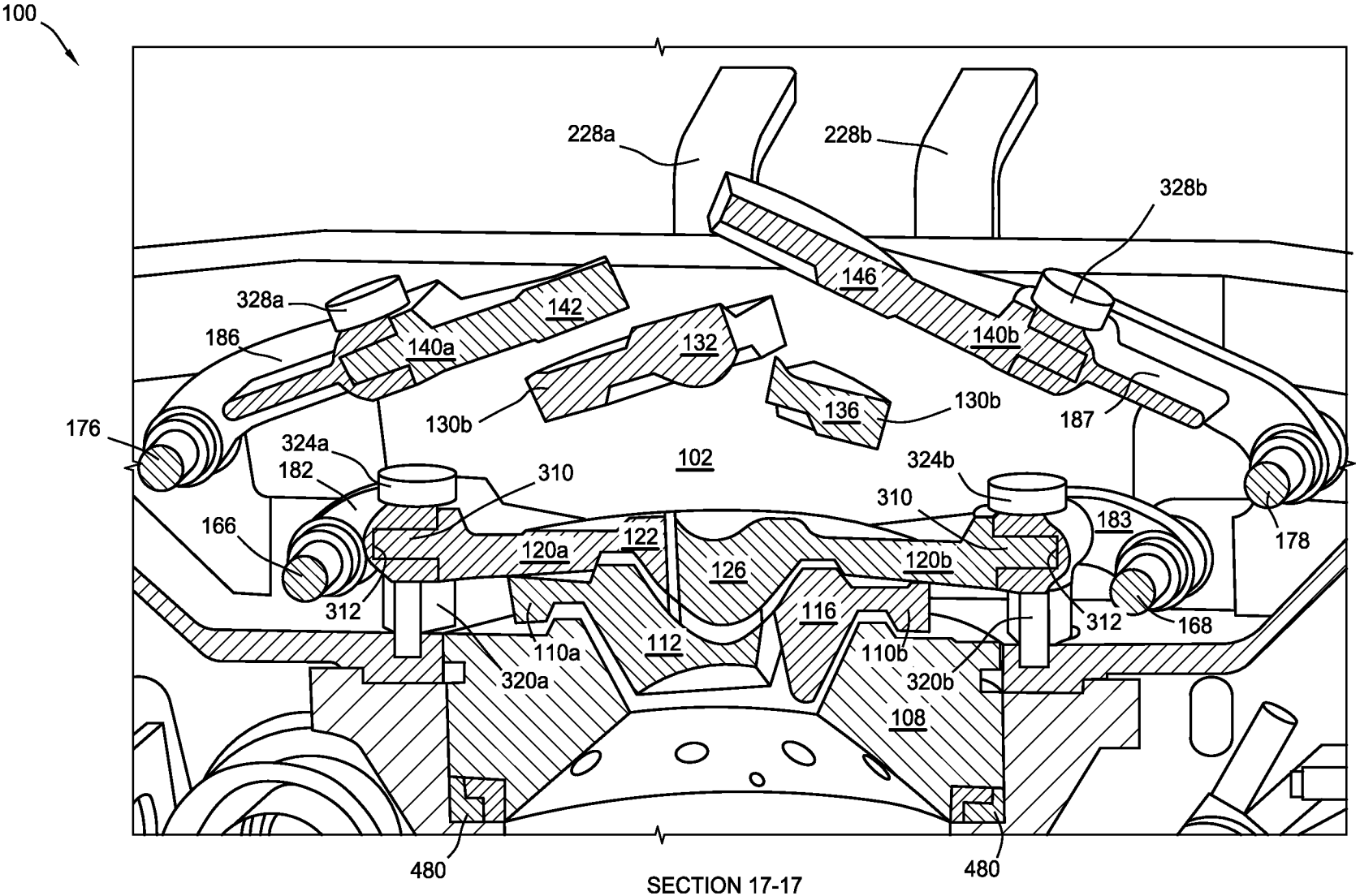
FIG. 17 is a representative detailed cross-sectional view 17-17 of the elevator of FIG. 16 with latches in various stages of engagement or disengagement, in accordance with certain embodiments.

FIG. 17 shows a cross-sectional view of the elevator 100 as indicated by the section lines 17-17 shown in FIG. 16. Section 17-17 is generally toward the back of the elevator 100 at about a center point of the drive shafts 166, 168, 176, 178. Therefore, most of the front latches 110, 130 are not shown with only about half of the attachment portions 182, 183, 186, 187 shown. However, FIG. 17 provides a view of the interaction of the locks 324*a-b* with stand offs 320*a-b* mounted to the housing 102 just outside of the space ring 108. When the latches are rotated about their respective axes to the engaged position, a rotational force applied by the rotary actuators on the latches can be up to 10 metric tons (i.e., ~11 US short tons). This sustained force on the latches when they are in the engaged position can cause issues with a weight measurement of an engaged tubular 38 (such as a drill string) by the elevator 100. Stand-offs 320*a-b* can be installed in the elevator 100. The stand-offs can be positioned outside of the spacer ring 108 and attached to the housing 102. The height of each stand-off 320*a-b* can be adjusted such that when the latch 120 is engaged, the locks 322*a-b* engage the stand-offs 320*a-b*, respectively, such that the 10 metric ton rotational forces can be transmitted to the housing 102 through the stand-offs 320*a-b* and not through the spacer ring 108. Therefore, any additional weight applied to the engaged latches by the engaged tubular 38 can be transmitted to the housing through the spacer ring 108 and a more accurate measurement of the tubular 38 weight can be determined. A circular weight sensor 480 can be used, instead of the compression sensors 188, 189, to measure the weight of the tubular 38 being held by the elevator 100. The circular weight sensor 480 will be described in more detail below regarding FIGS. 25-28B.

Figure 18:
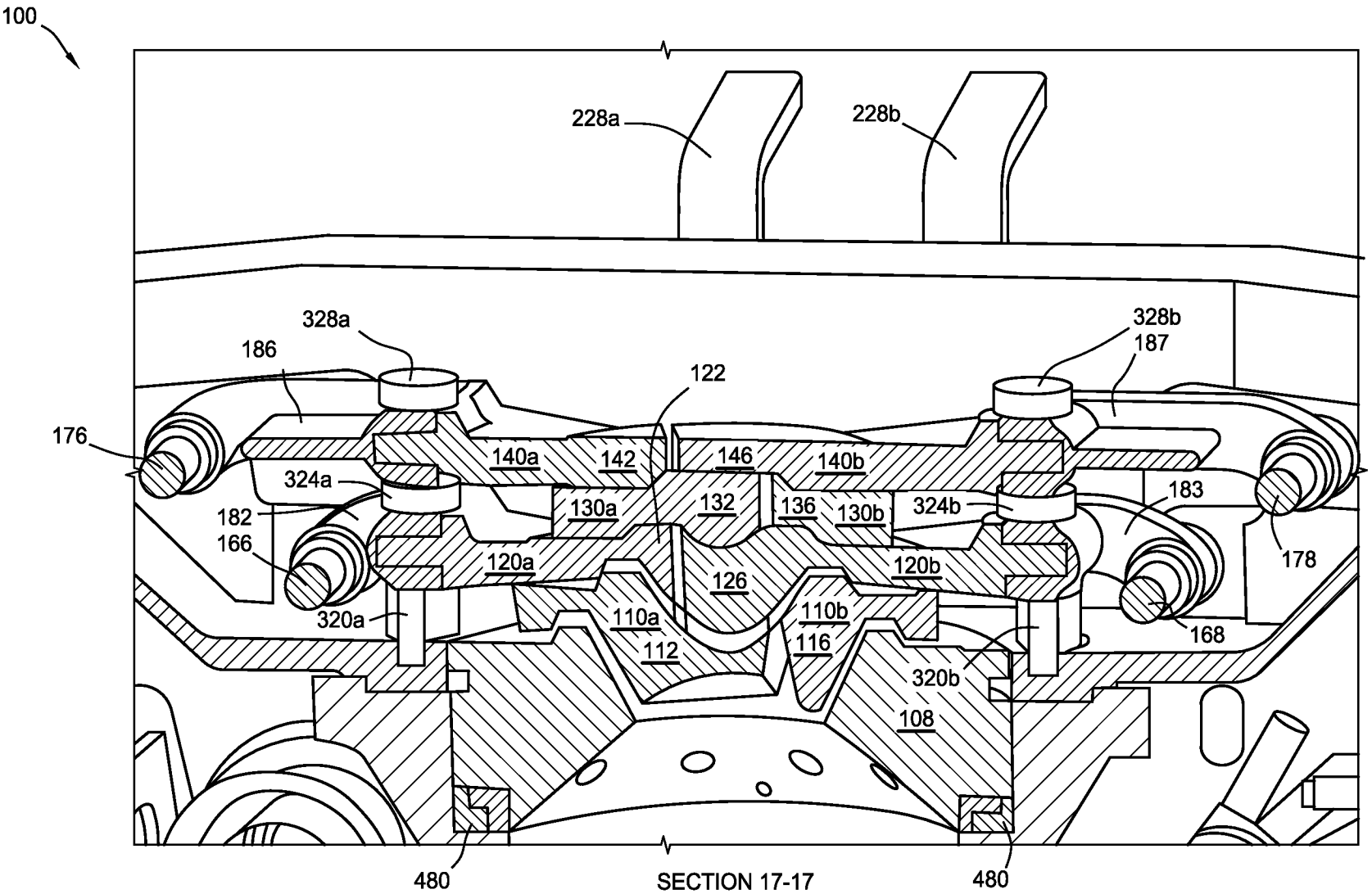
FIG. 18 is a representative detailed cross-sectional view 17-17 of the elevator of FIG. 16 with latches in an engaged position, in accordance with certain embodiments.

FIG. 18 shows another cross-sectional view of the elevator 100 as indicated by the section lines 17-17 shown in FIG. 16. However, in this configuration, all latches 110, 120, 130, 140 are in the engaged position. The rotational forces applied to the latches 120, 140 can be transmitted through the locks 328*a-b* to the locks 324*a-b* to the stand-offs 320*a-b*, respectively. Not shown, but similar to latches 120, 140, the rotational forces applied to the latches 110, 130 can be transmitted through the locks 326*a-b* to the locks 322*a-b* to stand-offs attached to the housing similar to stand-offs 320*a-b*, respectively.

Figure 19:
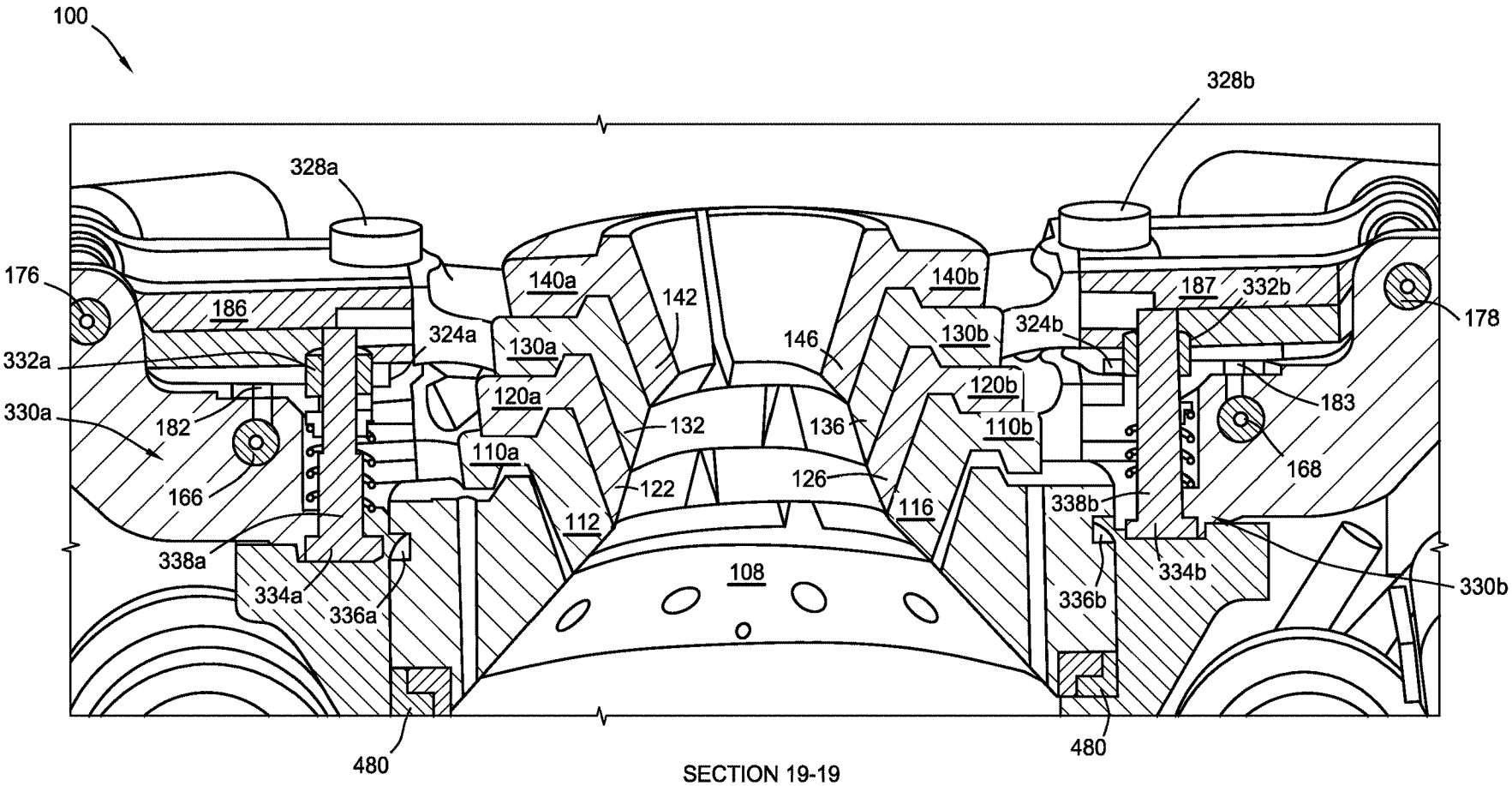
FIG. 19 is a representative detailed cross-sectional view 19-19 of the elevator of FIG. 16 with latches in an engaged position, in accordance with certain embodiments.

FIG. 19 shows a cross-sectional view of the elevator 100 as indicated by the section lines 19-19 shown in FIG. 16. Section 19-19 is generally at the center of the elevator 100. This view shows a retention mechanism 330*a*. A lever 332*a* can be connected to one end of a shaft 338*a* with a cam 334*a* attached at an opposite end of the shaft 338*a*. When the lever 332*a* is rotated the cam 334*a* is rotated to engage or disengage the cam 334*a* with a groove 336*a* in the spacer ring 108. When the cam 334*a* is engaged with the groove 336*a*, the spacer ring is prevented from being removed from the elevator 100. When the cam 334*a* is disengaged from the groove 336*a*, the spacer ring is permitted to be removed from the elevator 100. A second retention mechanism 330*b* can also be used to permit or prevent removal of the spacer ring 108 from the elevator 100. A lever 332*b* can be connected to one end of a shaft 338*b* with a cam 334*b* attached at an opposite end of the shaft 338*b*. Rotating the lever 332*b* rotates the cam 334*b* and causes the cam 334*b* to engage or disengage a groove 336*b* in the spacer ring 108. When the cam 334*b* is engaged with the groove 336*b*, the spacer ring is prevented from being removed from the elevator 100. When the cam 334*b* is disengaged from the groove 336*b*, the spacer ring is permitted to be removed from the elevator 100.

It should be understood that the cams 334*a,b* can be rotated into the engaged or disengaged positions by rotating the respective shafts 338*a,b*. The shafts 338*a,b* can be rotated manually by using a tool to apply a rotational force to the shafts 338*a,b*. Alternatively, or in addition to, the cams 334*a,b* can be rotated into the engaged position by the respective levers 332*a,b* when an adjacent jaw is rotated to their engaged position. Therefore, if the cam 334*a* has not yet been rotated into its engaged position when the elevator 100 is deployed, rotating either of the jaws 110*a*, 120*a* into its engaged position can engage the lever 332*a* and rotate the cam 334*a* into its engaged position. Additionally, if the cam 334*b* has not yet been rotated into its engaged position when the elevator 100 is deployed, rotating either of the jaws 110*b*, 120*b* into its engaged position can engage the lever 332*b* and rotate the cam 334*b* into its engaged position. In this way, the cams 334*a,b* can be forced into their engaged position by engaging the jaws to ensure retention of the locking ring 108 during elevator 100 operation.

Figure 20:
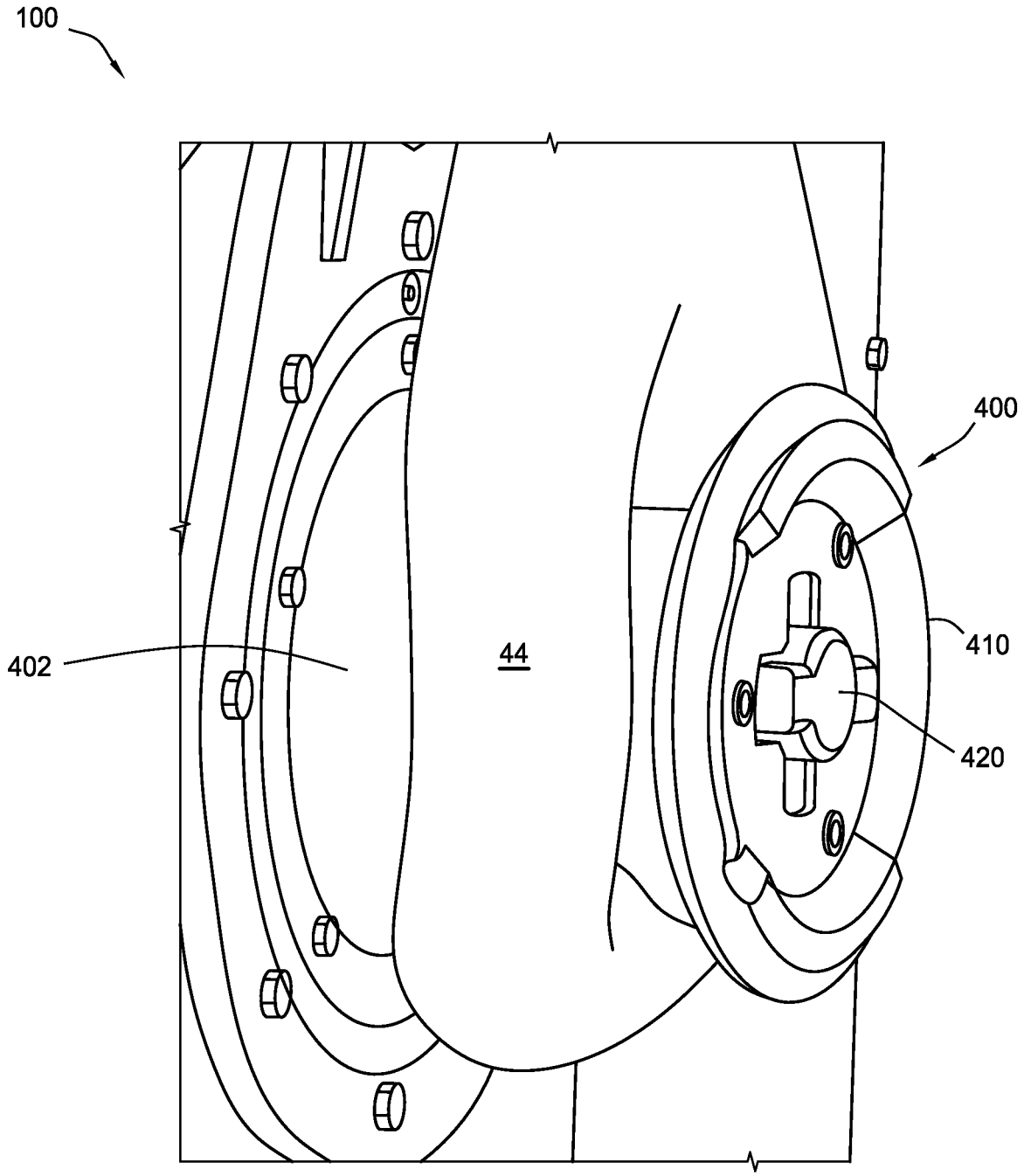
FIG. 20 is a representative enlarged perspective view of a link interface of an elevator with a removable retainer, in accordance with certain embodiments.

FIG. 20 is an enlarged perspective view of a portion of the elevator 100 that interfaces to one of the links 44. A link retainer 400 can be removably attached to retain the link 44 to an elevator support 402 once the elevator support 402 has been inserted through an opening in the link 44. When installed, the link retainer 400 can prevent removal of the link from the elevator 100 until the link retainer is disengaged.

Figure 21:
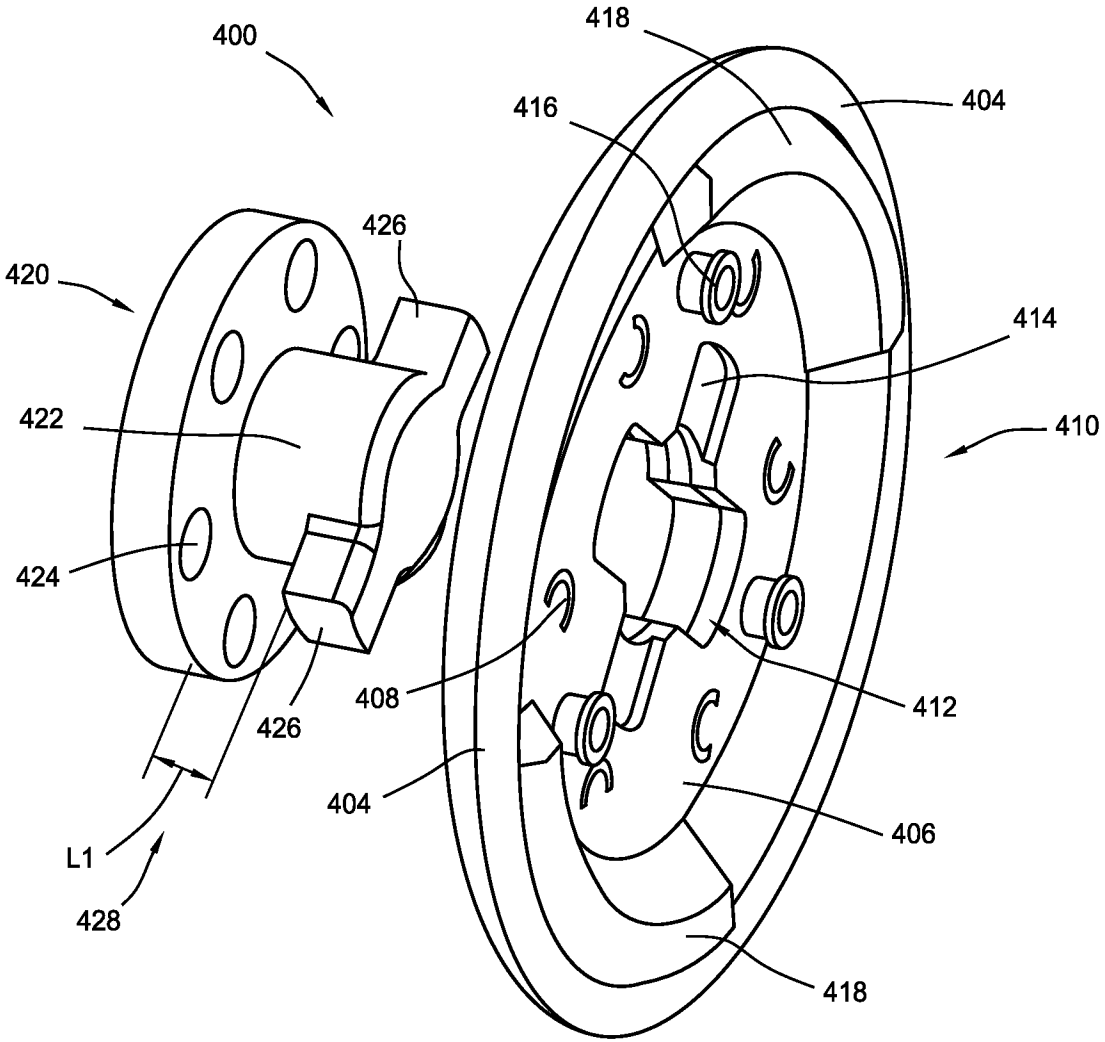
FIG. 21 is a representative exploded perspective view of the removable retainer of FIG. 20, in accordance with certain embodiments.
Figure 22:
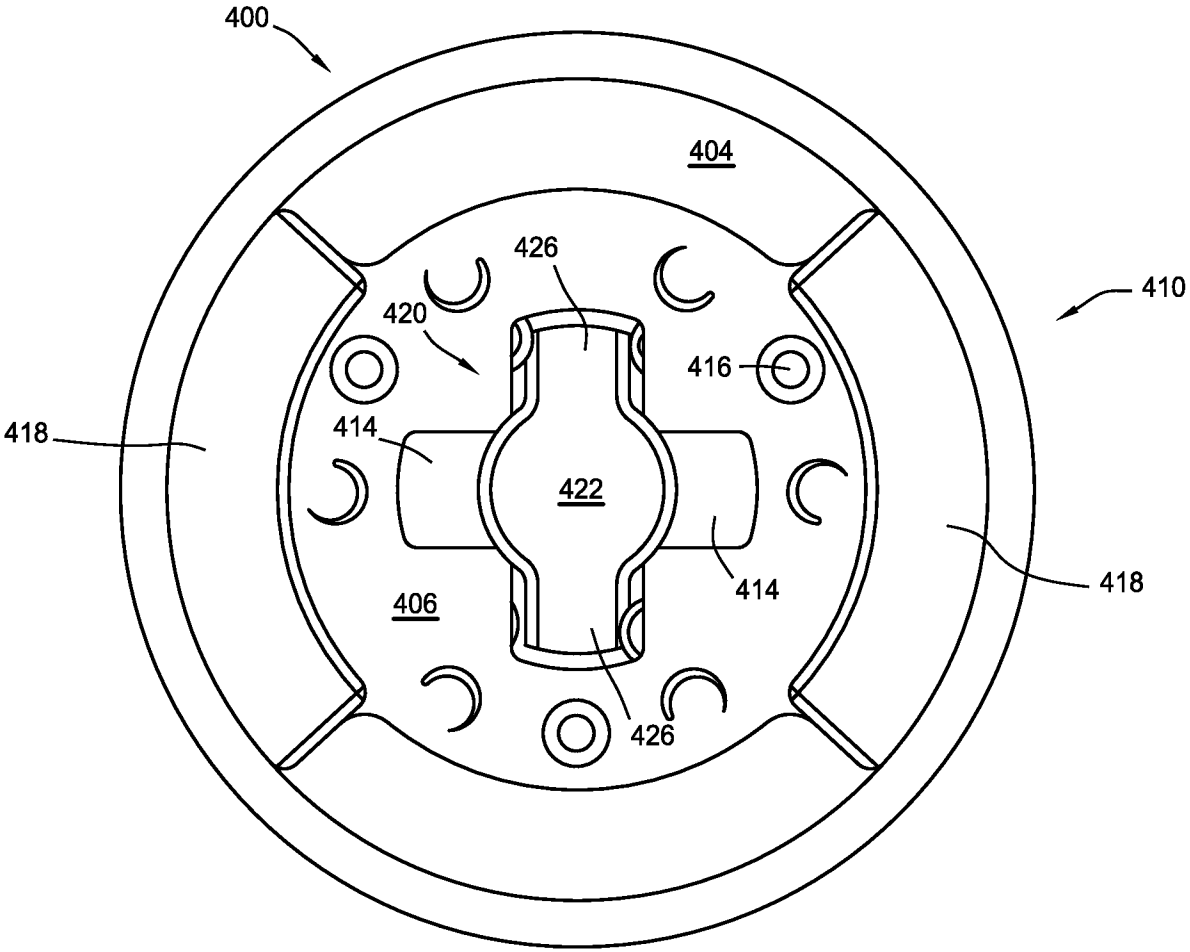
FIG. 22 is a representative front view of a removable retainer aligned with a retainer mount, in accordance with certain embodiments.

FIG. 21 is a perspective view of a link retainer 400 that can be removably attached to the elevator 100 at a support 402 as indicated in FIG. 5. An example of the link retainer 400 shown in FIG. 21 includes a retainer mount 420 and a removable device 410. The retainer mount 420 can include a mounting flange 425 with mounting holes 424 for securing the retainer mount 420 to the support 402 with fasteners (not shown). However, the retainer support 420 can be attached to the support 402 by other attachment means, such as welding, bonding, etc. as long as the attachment means secures the retainer support 420 to the support 402 and does not interfere with the operation of the link retainer 400. The retainer mount 420 can include a retention feature 422 that extends from the mounting flange with protrusions 426 that extend from opposite sides of the retention feature 422. A gap 428 between the protrusions 426 and the mounting flange 425 can have a length L1 that provides a necessary clearance for operating the link retainer 400.

The removable device 410 can include a first plate 404, and a second plate 406 slidably connected to the first plate 404 by fasteners 416. The first plate 404 and the second plate 406 can be biased apart from each other by biasing devices 408 disposed between them. The biasing devices 408 urge the second plate 406 to the ends of the fasteners 416. The first and second plates 404, 406 can have an opening 412 that is complimentarily shaped to allow the protrusions 426 of the retainer mount 420 to pass through the openings 412. The openings 412 require the removable device 410 to be aligned with the shape of the protrusions 426 to allow the removable device 410 to receive the protrusions 426 into the openings 412 (see FIG. 22). When the protrusions 426 and the openings 412 are aligned, the first plate 404 can engage the mounting flange 425. However, since the biasing devices 408 urge the first and second plates 404, 406 away from each other, the removable device 410 cannot be rotated relative to the protrusions 426 (and retention feature 422) because the distance the mounting flange 425 to the opposite side of the second plate 406 is larger than the gap 428.

Figure 23:
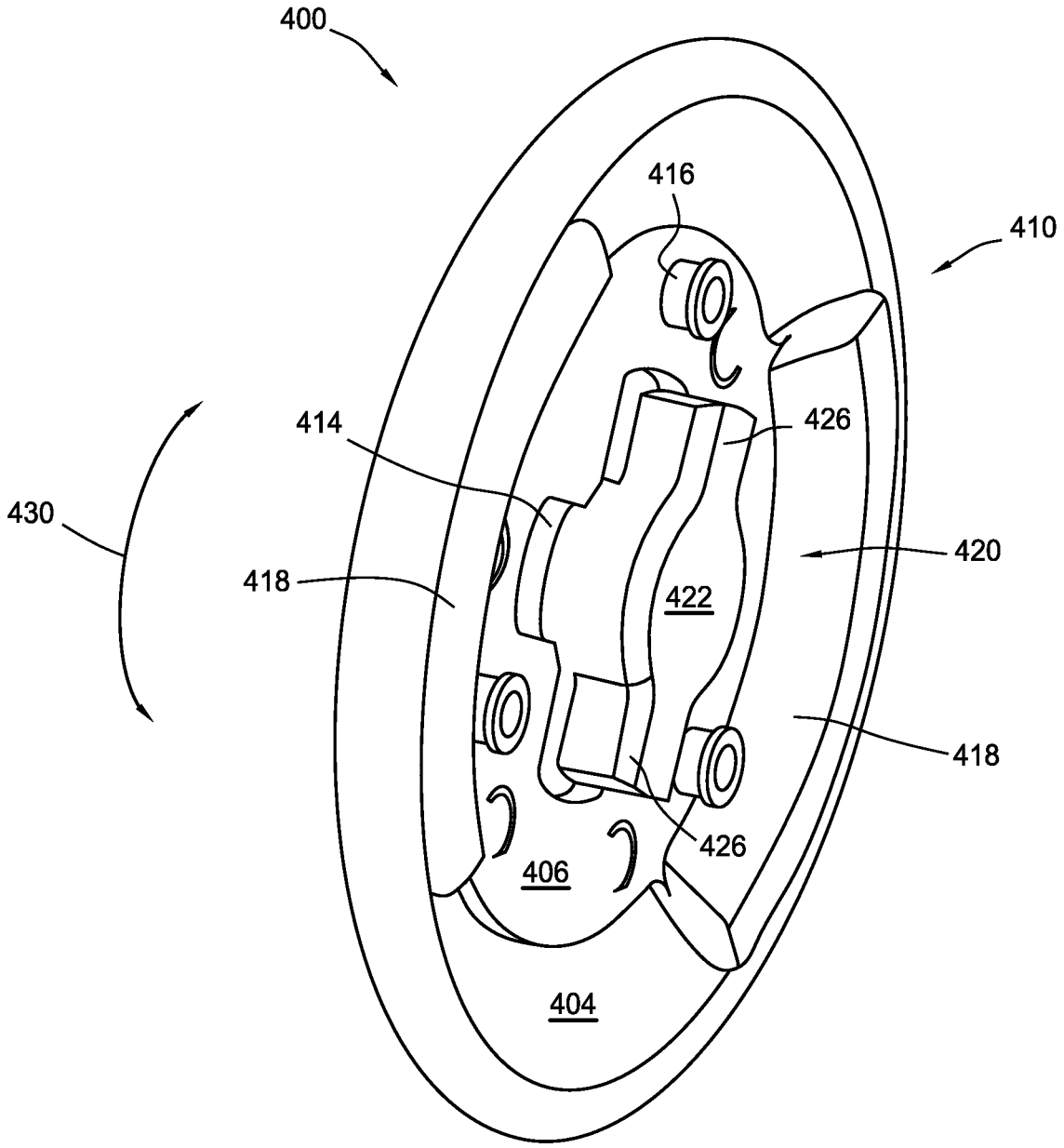
FIG. 23 is a representative perspective view of a removable retainer aligned with a retainer mount with the retainer mount inserted through a center opening in the removable retainer, in accordance with certain embodiments.

FIG. 23 shows the removable device 410 mounted onto the retainer mount 420 with a compression force applied to the second plate 406 via the compression handles 418, thereby compressing the springs 418 and reducing the distance from the mounting flange 425 to the opposite side of the second plate 406 to be less than the gap 428. In this configuration, the protrusions 426 are above the opposite side of the second plate 406 and the removable retainer 410 can be rotated as shown by arrows 430 to align the protrusions 426 with the recesses 414. With the protrusions 426 aligned with the recesses 414, the compression force applied to the compression handles 418 can be released and the biasing devices 408 will again urge the first and second plates 404, 406 away from each other forcing the protrusions 426 into the recesses 414. With the protrusions 426 seated in the recesses 414, the removable device 410 is prevented from rotating further and thereby secures the removable device 410 to the retainer mount 420.

Figure 24:
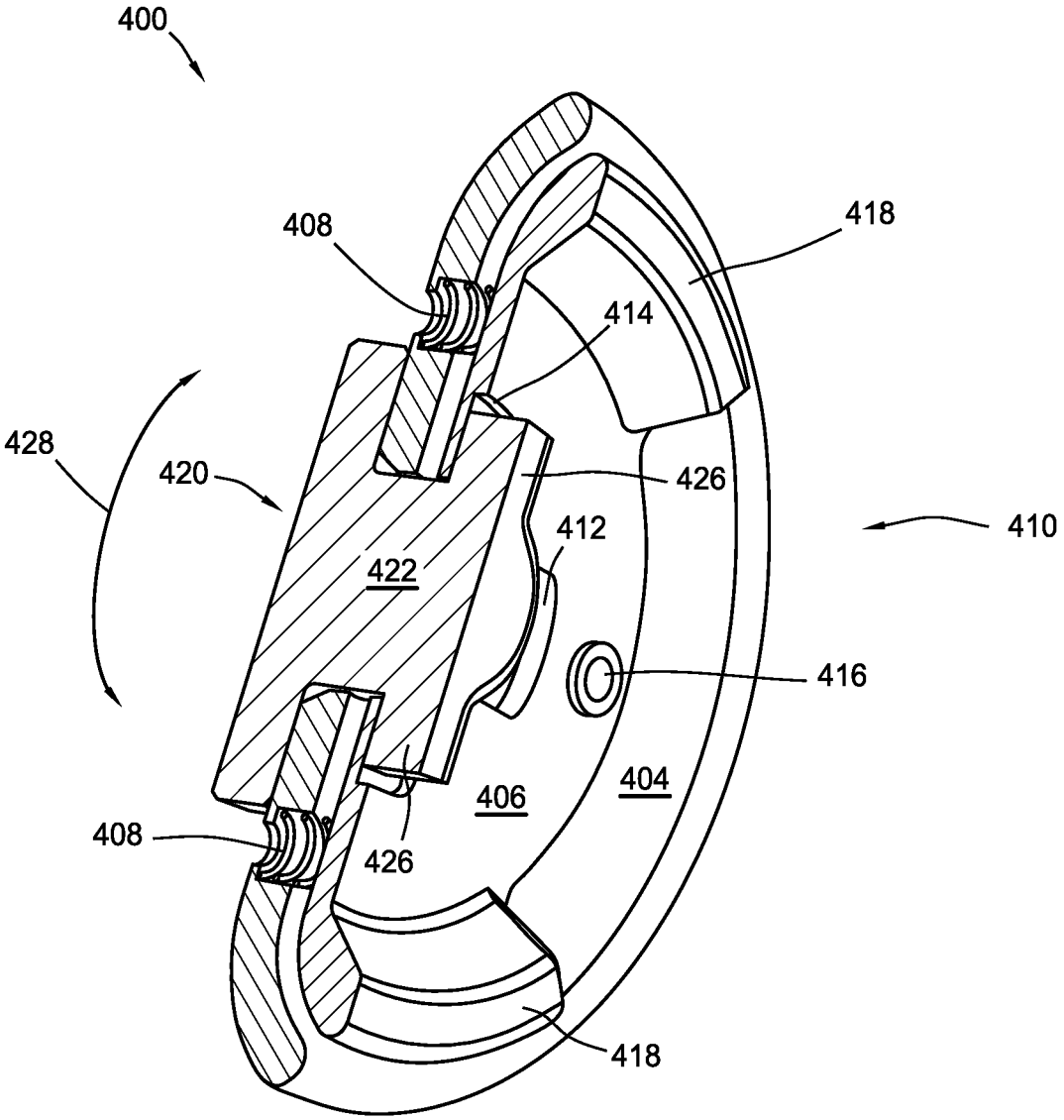
FIG. 24 is a representative cross-section perspective view of a removable retainer aligned with a retainer mount with the retainer mount inserted through a center opening in the removable retainer and rotated to engage the removable retainer, in accordance with certain embodiments.

FIG. 24 is a cross-sectional view of the link retainer 400 with the protrusions 426 seated in the recesses 414. It should be understood that the protrusions can be various shapes and sizes as long as the openings 412 match those shapes and sizes with appropriate clearances, and that the rotation into the secured position is possible.

Figure 25:
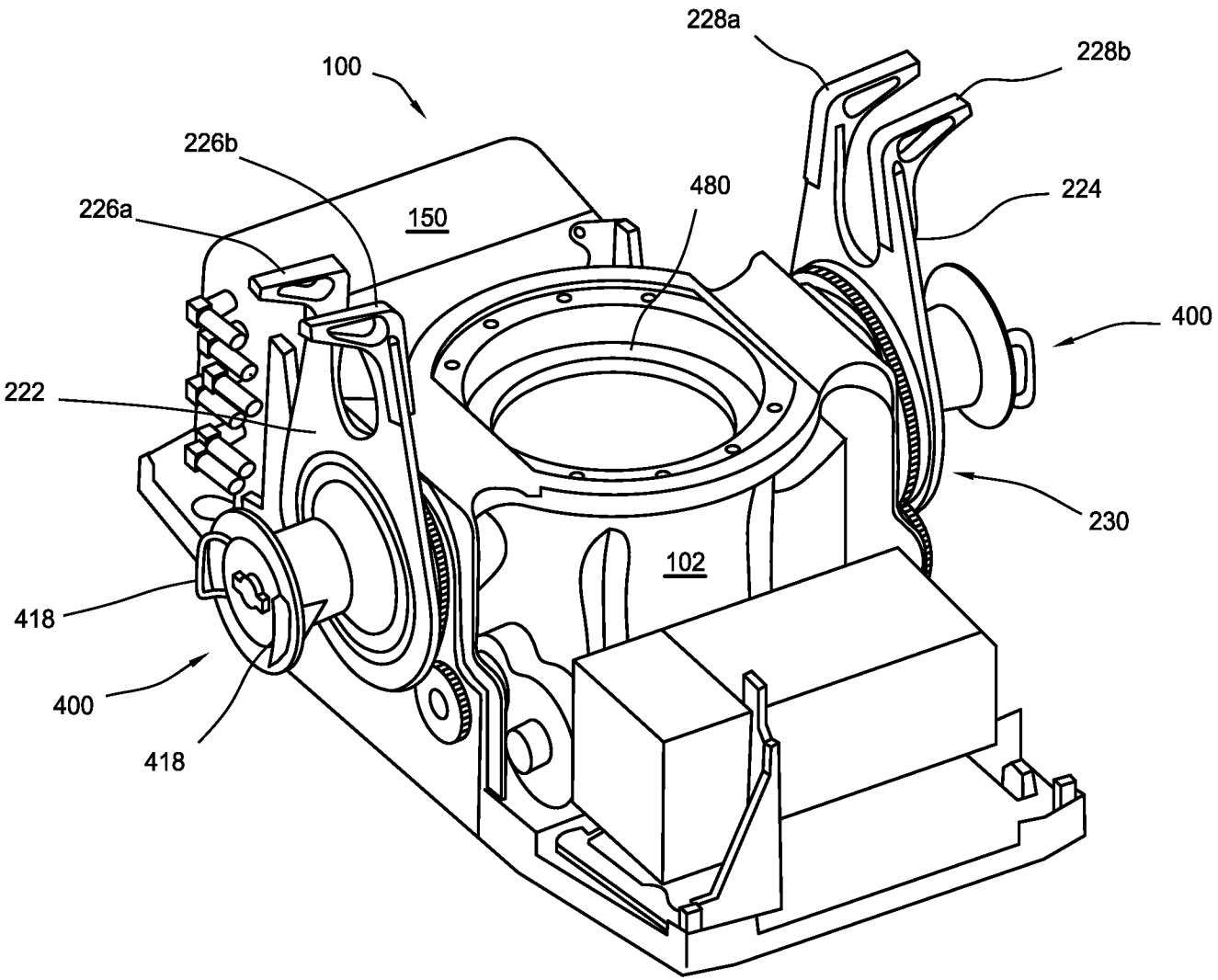
FIG. 25 is a representative perspective view a housing of an elevator with latch assemblies removed to show a circular weight sensor, according to certain embodiments.

FIG. 25 shows an elevator with a link interface system 230 that can include link interfaces 222, 224 which are similar to the link interface 222 shown in FIG. 14B that has adjustable angled flanges 226*a*, 226*b*. FIG. 25 also shows a link retainer 400 with extended handles 418 that can include an opening for improved operator grasping and manipulation of the handles 418.

FIG. 25 is a representative perspective view a housing 102 of an elevator 100 with latch assemblies of the elevator 100 removed to observe a circular weight sensor 480 positioned around a center of the elevator 100. A spacer ring 108 (not shown) can be mounted above it and transfer weight of a tubular 34 captured in the elevator 100 to the circular weight sensor 480. In operation of the elevator 100, the latches, when in a closed position, will engage the spacer ring 108 and, through the spacer ring 108, transfer the weight of a captured tubular 34 to the circular weight sensor 480.

Figure 26:
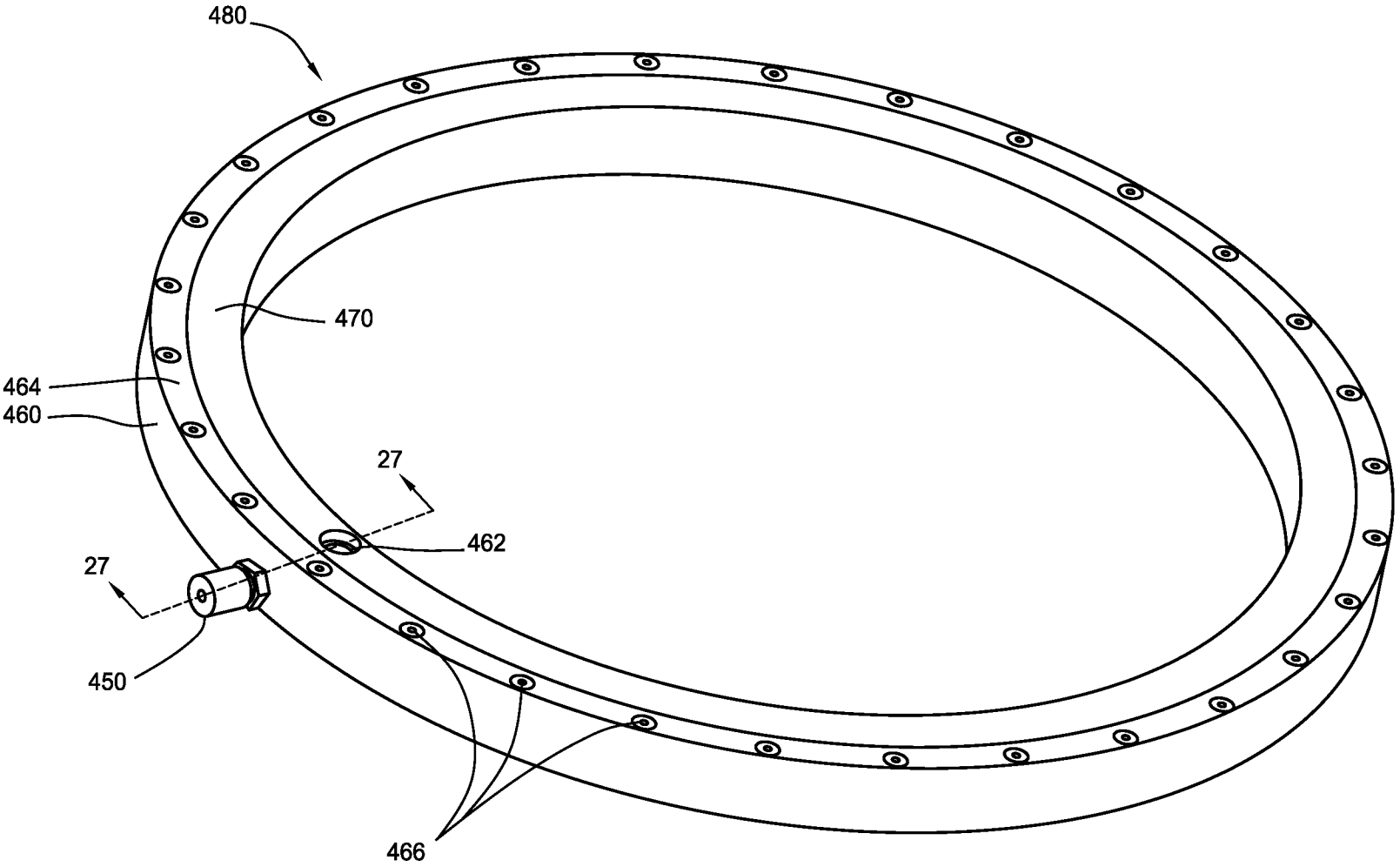
FIG. 26 is a representative perspective view of a circular weight sensor, according to certain embodiments.

FIG. 26 is a representative perspective view of a circular weight sensor 480. A support ring 460 engages the elevator housing 102 when the circular weight sensor 480 is installed in the elevator 100. An engagement ring 470 is slidably and sealingly engaged with the support ring 460 creating a sealed chamber 454 between them (see FIG. 27). A fill port 462 can be used to fill the sealed chamber 454 with an incompressible fluid (e.g., oil). A retainer ring 464 can be used to prevent disengagement of the engagement ring 470 from the support ring 460, with fasteners 466 being used to secure the retainer ring 464 to the support ring 460. The engagement ring 470 is allowed to float relative to the support ring 460 and the retainer ring 464. An outlet port 450 can be used to connect the circular weight sensor 480 to a reservoir 500 that can measure pressure applied to the sealed chamber 454 by the engagement ring 470.

Figure 27:
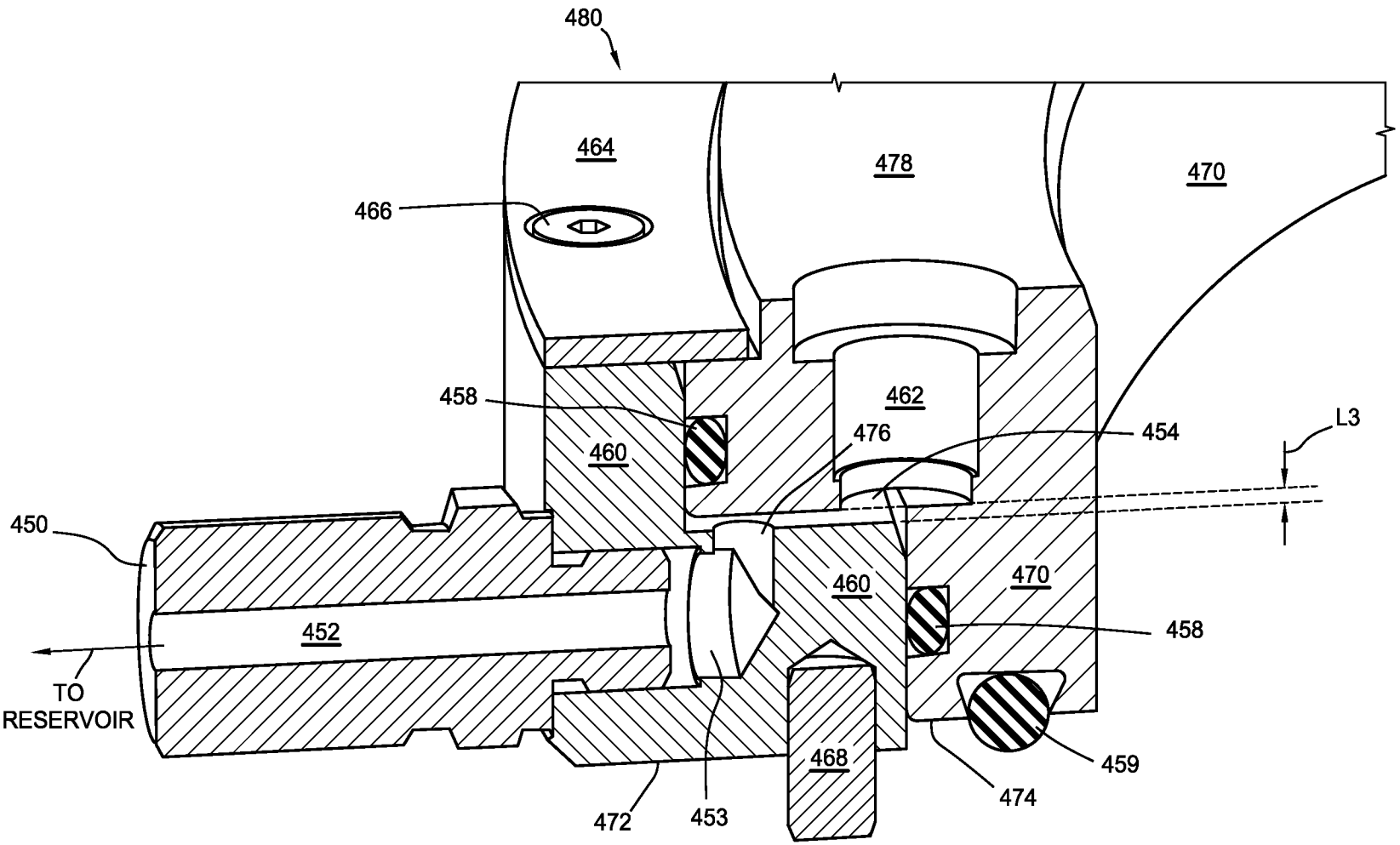
FIG. 27 is a representative partial cross-sectional view of the circular weight sensor of FIG. 26, according to certain embodiments.

FIG. 27 a representative partial cross-sectional view of the circular weight sensor 480 of FIG. 26 along section line 27-27. The outlet port 450 can include a pressure fitting with an internal flow passage 452 that provides fluid and pressure communication between the reservoir 500 and the sealed chamber 454. The pressure fitting of the outlet port 450 can be threaded into (or otherwise attached) to the borehole 453 of the support ring 460. A flow passage 476 can provide fluid and pressure communication between the borehole 453 and the sealed chamber 454. The fill port 462 can be used to fill the sealed chamber 454 with an incompressible fluid (e.g., oil). When the chamber 454 is filled with the incompressible fluid, a plug can be installed in the fill port 462 to prevent loss of the incompressible fluid.

When installed, the bottom surface 472 of the support ring 460 can engage the housing 102 of the elevator 100. One or more alignment pins 468 can be used to ensure proper alignment of the circular weight sensor 480 to the housing 102. The top surface 478 of the engagement ring 470 can engage the spacer ring 108. Therefore, when weight is transferred to the spacer ring 108 from the latches of the elevator, then the spacer ring 108 transfers that weight to the engagement ring 470 via the top surface 478. The fasteners 466 can be used to attach the retainer ring 464 to the support ring 460. When the sealed chamber 454 is filled, the engagement ring 470 is raised up away from the support ring 460 to engage the retainer ring 464. A gap L3 can be formed between a lower internal surface of the engagement ring 470 and an upper internal surface of the support ring 460. This creates a volume between the engagement ring 470 and the support ring 460 that is the sealed chamber 454. The seals 458 can be used to generally prevent fluid communication between the sealed chamber 454 and the external environment. However, fluid communication is allowed through the outlet port 450 to the reservoir 500. The seal 474 can be used to seal the circular weight sensor 480 to the housing 102, thereby preventing (or at least minimizing) ingress of operational fluids and debris when the elevator 100 is operating.

Figure 28A:
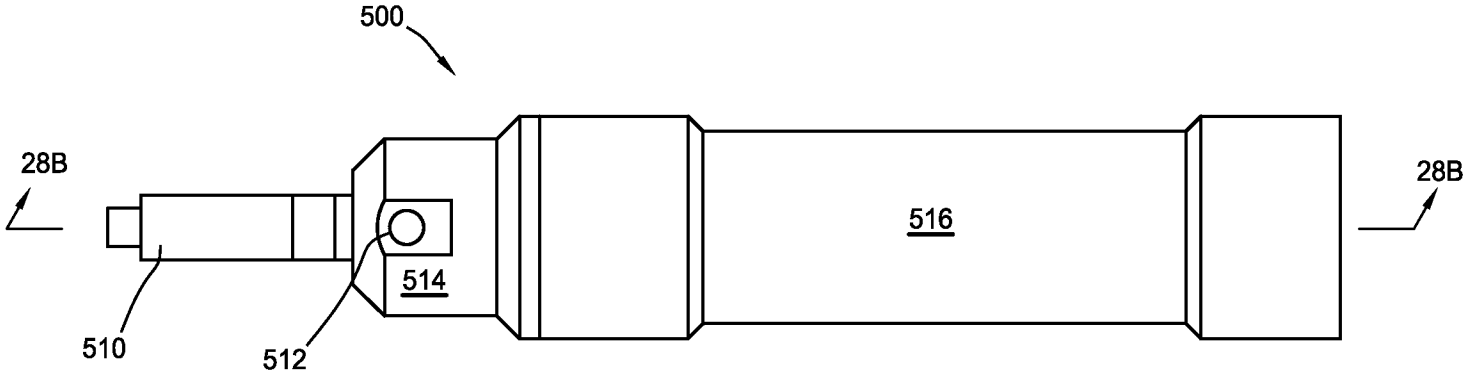
FIG. 28A is a representative side view of a reservoir with a pressure sensor, according to certain embodiments.
Figure 28B:
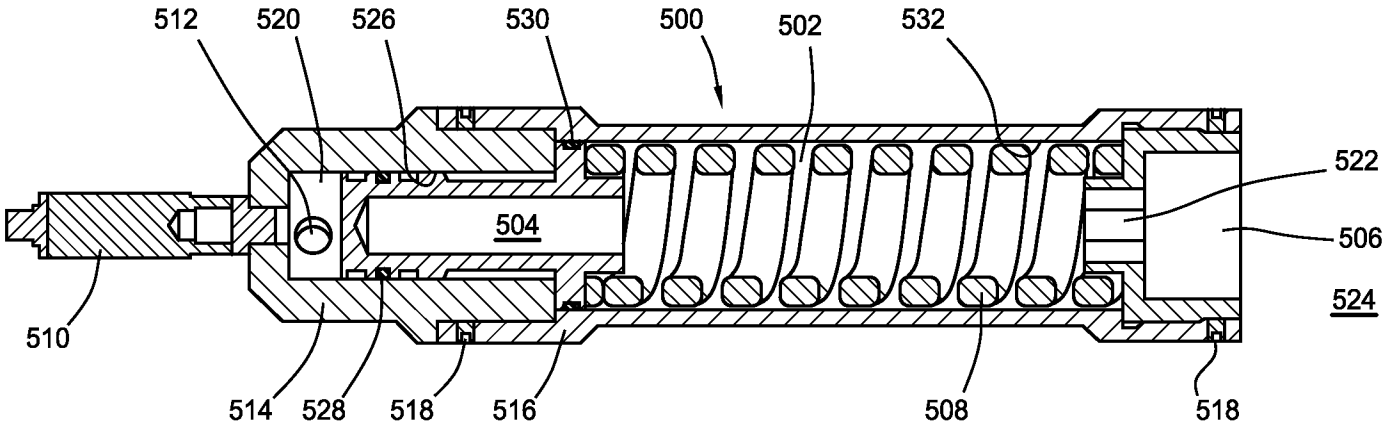
FIG. 28B is a representative cross-sectional view of the reservoir of FIG. 28A, according to certain embodiments.

FIG. 28A is a representative side view of a reservoir 500 with a pressure sensor 510. FIG. 28B is a representative cross-sectional view of the reservoir 500 shown in FIG. 28A. The reservoir 500 can be in fluid and pressure communication with the sealed chamber 454 of the circular weight sensor 480 via a flow passage (not shown) connected between an inlet port 512 of the reservoir 500 and the outlet port 450 of the circular weight sensor 480. Therefore, when compression forces act on the top surface 478 of the circular weight sensor 480, pressure on the incompressible fluid contained within the sealed chamber 454 can vary. Increased compression forces can increase pressure in the sealed chamber 454, and decreased compression forces can decrease pressure in the sealed chamber 454. The incompressible fluid contained with the sealed chamber 454 can communicate pressure changes in the sealed chamber 454 to a chamber 520 in the reservoir 500. The reservoir 500 can include a pressure sensor 510 that is in pressure communication with the chamber 520.

The reservoir 500 can include a body section 516 that can be sealed on each end by a top cap 514, a bottom cap 506, and seals 518. The top cap 514 can include a borehole 526 with a piston 504 that sealingly engages the borehole 526 via the seal 528. One end of the piston 504 can be in pressure and fluid communication with the chamber 520 with the other end of the piston 504 being in pressure and fluid communication with a chamber 502. The piston 504 can also sealing engage, via a seal 530, an inner surface 532 of the body 516. A biasing device 508 can be disposed between the piston 504 and the bottom end cap 506 to provide a biasing force against the piston 504. The chamber 502 can be in fluid communication with an external environment 524 via the flow passage 522. Therefore, when the piston 504 compresses the biasing device 508, pressure in the chamber 502 remains equalized with the external environment 524 because of the flow passage 522. The biasing device 508 allows the piston 504 to move along the inner surface 532 toward the bottom cap 506 when pressure in the chamber 520 in increased and allows the piston 504 to move along the inner surface 532 toward the top cap 514 when pressure in the chamber 520 decreases.

In operation, when the circular weight sensor 480 is installed in the elevator 100, the bottom surface 472 of the support ring 460 can engage the housing 102 and the top surface 478 of the engagement ring 470 can engage the spacer ring 108. When a tubular 34 is captured by the elevator 100 the weight of the tubular 34 can be transferred from the latches of the elevator 100 to the spacer ring 108, which can then transfer the weight of the tubular to the housing 102 (see FIG. 8A) through the circular weight sensor 480. The weight acting on the top surface 478 can increase pressure on the incompressible fluid in the sealed chamber 454. The increased pressure can be communicated to the chamber 520 in the reservoir 500 where the increase pressure can act on the piston 504 moving the piston 504 toward the bottom end cap 506, thereby increasing a volume of the chamber 520. The pressure sensor 510 can sense the pressure (continuously, or randomly, or periodically, etc.) in the chamber and communicate the pressure sensor data to a rig controller via wired or wireless communication. If the weight acting on the top surface 478 is decreased, then pressure on the incompressible fluid in the sealed chamber 454 can decrease. This pressure change can be communicated to the chamber 520 in the reservoir 500 causing the biasing device 508 to move the piston 504 toward the top cap 514, thereby decreasing the volume of the chamber 520. Again, the pressure sensor 510 can sense the pressure (continuously, or randomly, or periodically, etc.) in the chamber and communicate the pressure sensor data to a rig controller 50 via wired or wireless communication. Additionally, the pressure sensor 510 can communicate the pressure sensor data to a local controller in the enclosure 150 via wired or wireless communication, which can communicate to the rig controller 50 via wired or wireless communication.

Various Embodiments

One general aspect includes a system for conducting subterranean operations including: an elevator configured to move a tubular, the elevator including: a housing defining a central bore configured to receive the tubular therein; a first latch including first and second jaws, with each of the first and second jaws being coupled to the housing and configured to be moveable between an engaged position and a disengaged position, and when the first and second jaws are in the engaged position, engagement portions of the first and second jaws are positioned in the central bore on opposite sides of, with respect to each other, a central axis of the central bore and define an opening of a first diameter; and a second latch including third and fourth jaws, with each of the third and fourth jaws coupled to the housing and configured to be moveable between an engaged position and a disengaged position, and when the third and fourth jaws are in the engaged position, engagement portions of the third and fourth jaws are positioned in the central bore on opposite sides of, with respect to each other, the central axis of the central bore and define an opening of a second diameter which is different than the first diameter, where the first jaw is fixedly attached to a first drive shaft and the first drive shaft is rotationally attached to the housing, where the third jaw is fixedly attached to a third drive shaft and the third drive shaft is rotationally attached to the housing, and where the first and third drive shafts independently rotate the first and third jaws, respectively, about a first axis.

Embodiments may include one or more of the following features. The system where the second jaw is fixedly attached to a second drive shaft and the second drive shaft is rotationally attached to the housing. The system may also include where the fourth jaw is fixedly attached to a fourth drive shaft and the fourth drive shaft is rotationally attached to the housing. The system may also include where the second and fourth drive shafts independently rotate the second and fourth jaws, respectively, about a second axis. The system where the first and second jaws are positioned on opposite sides of the central axis, and when the first and second jaws rotate to the engaged position the first and second jaws rotate toward each other, and when the first and second jaws rotate to the disengaged position the first and second jaws rotate away from each other. The system where the third and fourth jaws are positioned on opposite sides of the central axis, and when the third and fourth jaws rotate to the engaged position the third and fourth jaws rotate toward each other, and when the third and fourth jaws rotate to the disengaged position the third and fourth jaws rotate away from each other. The system where each of the engagement portions of the first and second jaws has a lateral portion and a tapered portion, with the tapered portion extending from the lateral portion at an angle. The system where the lateral portion of the first jaw is substantially parallel to the lateral portion of the second jaw when the first and second jaws are in the engaged position. The system where the tapered portions of the first and second jaws are configured to form a first frustoconically shaped portion of the first latch when the first and second jaws are in the engaged position, with each of the tapered portions including: an inner surface having a concave contour and being joined to a top surface of respective ones of the first and second jaws; a distal surface joined to the inner surface at an engagement edge; and an outer surface joined to the distal surface at a bottom edge and joined to a bottom surface of the respective ones of the first and second jaws.

The system where the inner and distal surfaces are tapered and angled relative to the central axis. The system where the inner surface is angled from the top surface of the respective jaw toward the central axis to the engagement edge, and the distal surface is angled from the engagement edge away from the central axis to the bottom edge. The system where the engagement edge or the inner surface is configured to engage a portion of the tubular when the first and second jaws are in the engaged position. The system where the elevator is configured to be EX-certified according to EX zone 1 (ATEX/IECEx), and an electronics controller configured to control the elevator is disposed within a chamber of the housing. The system where a rotary actuator is coupled to the first and second drive shafts and simultaneously rotates the first and second drive shafts in opposite directions, thereby rotating the first and second jaws between engaged and disengaged positions. The system where the first and second drive shafts extend through a wall of the housing, and where each one of the first and second drive shafts engage one or more seals, thereby preventing fluid communication through the wall at either of the first and second drive shafts. The system where the rotary actuator is disposed in a chamber within the housing, the chamber being sealed to prevent environmental fluids or debris from entering the chamber. The system where the second latch engages the first latch when the first and second latches are in the engaged position. The system where the first and second jaws of the first latch are configured to form a first frustoconically shaped portion of the first latch when the first latch is in the engaged position. The system may also include where the third and fourth jaws of the first latch are configured to form a second frustoconically shaped portion of the second latch when the second latch is in the engaged position.

The system may also include where a majority of an outer surface of the second frustoconically shaped portion abuts an inner surface of the first frustoconically shaped portion when the first and second latches are in the engaged position. The system where the first frustoconically shaped portion includes a first gap between the first and second jaws when the first latch is in the engaged position, and where the second frustoconically shaped portion includes a second gap between the third and fourth jaws when the second latch is in the engaged position. The system where the first and second gaps are parallel to the central axis of the housing, and the first and second gaps are circumferentially aligned with each other relative to the central axis. The system where the first and second gaps are parallel to the central axis of the housing, and the first gap is circumferentially offset, relative to the central axis, from the second gap. The system where each of the engagement portions of the first, second, third, and fourth jaws has a lateral portion and a tapered portion, with the tapered portion extending from the lateral portion at an angle. The system where the lateral portion of the first jaw is parallel to the lateral portion of the second jaw when the first and second jaws are in the engaged position, where the lateral portion of the third jaw is parallel to the lateral portion of the fourth jaw when the third and fourth jaws are in the engaged position, and where a majority of the engagement portions of the third and fourth jaws overlie the engagement portions of the first and second jaws when the first, second, third, and fourth jaws are in the engaged position.

The system where the tapered portions of the first and second jaws are configured to form a first frustoconically shaped portion of the first latch when the first and second jaws are in the engaged position, and where the tapered portions of the third and fourth jaws are configured to form a second frustoconically shaped portion of the second latch when the third and fourth jaws are in the engaged position, with each of the tapered portions including: an inner surface having a concave contour and being joined to a top surface of respective ones of the jaws; a distal surface joined to the inner surface at an engagement edge; and an outer surface joined to the distal surface at a bottom edge and joined to a bottom surface of the respective ones of the jaws. The system where the inner and distal surfaces are tapered and angled relative to the central axis.

The system where the inner surface is angled from the top surface of the respective jaw toward the central axis to the engagement edge, and the distal surface is angled from the engagement edge away from the central axis to the bottom edge. The system where at least one of the engagement edges or the inner surfaces is configured to engage a portion of the tubular when the jaws are in the engaged position. The system where a minimum diameter of the second frustoconically shaped portion is smaller than a minimum diameter of the first frustoconically shaped portion. The system where the tapered portions of the third and fourth jaws engage the tapered portions of the first and second jaws and the lateral portions of the third and fourth jaws engage the lateral portions of the first and second jaws when the jaws are in the engaged position. The system may also include where a perimeter ridge at a top of the tapered portions of the first and second jaws extends into a perimeter recess in a surface of the lateral portions of the third and fourth jaws that engage the first and second jaws when the jaws are in the engaged position. The system where a first rotary actuator is coupled to the first and second drive shafts and simultaneously rotates the first and second drive shafts in opposite directions, thereby rotating the first and second jaws between engaged and disengaged positions.

The system may also include where a second rotary actuator is coupled to the third and fourth drive shafts and simultaneously rotates the third and fourth drive shafts in opposite directions, thereby rotating the third and fourth jaws between engaged and disengaged positions. The system where the first and second drive shafts extend through a wall of the housing, and where each one of the first and second drive shafts engage one or more seals, thereby preventing fluid communication through the wall at either of the first and second drive shafts. The system may also include where the third and fourth drive shafts extend through a wall of the housing, and where each one of the third and fourth drive shafts engage one or more seals, thereby preventing fluid communication through the wall at either of the third and fourth drive shafts. The system where the rotary actuators are disposed in a chamber within the housing, the chamber being sealed to prevent environmental fluids or debris from entering the chamber.

The system further including: a third latch including fifth and sixth jaws, with each of the fifth and sixth jaws coupled to the housing and configured to be moveable between an engaged position and a disengaged position, and when the fifth and sixth jaws are in the engaged position, engagement portions of the fifth and sixth jaws are positioned in the central bore on opposite sides of, with respect to each other, the central axis of the central bore and define an opening of a third diameter which is different than the first and second diameters, and a fourth latch including seventh and eighth jaws, with each of the seventh and eighth jaws coupled to the housing and configured to be moveable between an engaged position and a disengaged position, and when the seventh and eighth jaws are in the engaged position, engagement portions of the seventh and eighth jaws are positioned in the central bore on opposite sides of, with respect to each other, the central axis of the central bore and define an opening of a fourth diameter which is different than the first, second, and third diameters where the engagement portions of the fifth and sixth jaws are configured to be nested in the engagement portions of the third and fourth jaws when the fifth and sixth jaws are in the engaged position, and where the engagement portions of the seventh and eighth jaws are configured to be nested in the engagement portions of the fifth and sixth jaws when the seventh and eighth jaws are in the engaged position. The system where the fifth jaw is fixedly attached to a fifth drive shaft and the fifth drive shaft is rotationally attached to the housing.

The system may also include where the sixth jaw is fixedly attached to a sixth drive shaft and the sixth drive shaft is rotationally attached to the housing. The system may also include where the seventh jaw is fixedly attached to a seventh drive shaft and the seventh drive shaft is rotationally attached to the housing. The system may also include where the eighth jaw is fixedly attached to an eighth drive shaft and the eighth drive shaft is rotationally attached to the housing. The system may also include where the fifth and seventh drive shafts independently rotate the fifth and seventh jaws, respectively, about a third axis. The system may also include where the sixth and eighth drive shafts independently rotate the sixth and eighth jaws, respectively, about a fourth axis. The system where the first and second axes are disposed on opposite sides of the central axis of the housing and at a same longitudinal position along the central axis, where the third and fourth axes are disposed on opposite sides of the central axis and at a same longitudinal position along the central axis, and where the first and second axes are positioned radially inward from the third and fourth axes. The system where when the first latch rotates to the engaged position the first and second jaws rotate toward each other, and when the first latch rotates to the disengaged position the first and second jaws rotate away from each other.

The system may also include where when the second latch rotates to the engaged position the third and fourth jaws rotate toward each other, and when the second latch rotates to the disengaged position the third and fourth jaws rotate away from each other. The system where when the third latch rotates to the engaged position the fifth and sixth jaws rotate toward each other, and when the third latch rotates to the disengaged position the fifth and sixth jaws rotate away from each other. The system may also include where when the fourth latch rotates to the engaged position the seventh and eighth jaws rotate toward each other, and when the fourth latch rotates to the disengaged position the seventh and eighth jaws rotate away from each other. The system where each of the engagement portions of the first, second, third, fourth, fifth, sixth, seventh, and eighth jaws has a lateral portion and a tapered portion, with the tapered portion extending from the lateral portion at an angle. The system may also include where the lateral portion of the first jaw is parallel to the lateral portion of the second jaw when the first latch is in the engaged position. The system may also include where the lateral portion of the third jaw is parallel to the lateral portion of the fourth jaw when the second latch is in the engaged position. The system may also include where the lateral portion of the fifth jaw is parallel to the lateral portion of the sixth jaw when the third latch is in the engaged position. The system may also include where the lateral portion of the seventh jaw is parallel to the lateral portion of the eighth jaw when the fourth latch is in the engaged position.

The system may also include where the tapered portions of the first and second jaws are configured to form a first frustoconically shaped portion when the first latch is in the engaged position. The system may also include where the tapered portions of the third and fourth jaws are configured to form a second frustoconically shaped portion when the second latch is in the engaged position. The system may also include where the tapered portions of the fifth and sixth jaws are configured to form a third frustoconically shaped portion when the third latch is in the engaged position. The system may also include where the tapered portions of the seventh and eighth jaws are configured to form a fourth frustoconically shaped portion when the fourth latch is in the engaged position, with each of the tapered portions including: an inner surface having a concave contour and being joined to a top surface of respective ones of the jaws, a distal surface joined to the inner surface at an engagement edge, and an outer surface joined to the distal surface at a bottom edge and joined to a bottom surface of the respective ones of the jaws. The system where the inner and distal surfaces are tapered and angled relative to the central axis. The system where the inner surface is angled from the top surface of the respective jaw toward the central axis to the engagement edge, and the distal surface is angled from the engagement edge away from the central axis to the bottom edge. The system where the engagement edge or the inner surface is configured to engage a portion of the tubular when at least one of the latches is in the engaged position. The system may also include the first jaw is fixedly attached to a first drive shaft that is rotationally attached to the housing.

The system may also include the second jaw is fixedly attached to a second drive shaft that is rotationally attached to the housing. The system may also include the third jaw is fixedly attached to a third drive shaft that is rotationally attached to the housing. The system may also include the fourth jaw is fixedly attached to a fourth drive shaft that is rotationally attached to the housing. The system may also include where a first rotary actuator is coupled to the first and second drive shafts and simultaneously rotates the first and second drive shafts in opposite directions, thereby rotating the first and second jaws between engaged and disengaged positions. The system may also include where a second rotary actuator is coupled to the third and fourth drive shafts and simultaneously rotates the third and fourth drive shafts in opposite directions, thereby rotating the third and fourth jaws between engaged and disengaged positions. The system may also include the fifth jaw is fixedly attached to a fifth drive shaft that is rotationally attached to the housing. The system may also include the sixth jaw is fixedly attached to a sixth drive shaft that is rotationally attached to the housing. The system may also include the seventh jaw is fixedly attached to a seventh drive shaft that is rotationally attached to the housing. The system may also include the eighth jaw is fixedly attached to an eighth drive shaft that is rotationally attached to the housing.

The system may also include where a third rotary actuator is coupled to the fifth and sixth drive shafts and simultaneously rotates the fifth and sixth drive shafts in opposite directions, thereby rotating the fifth and sixth jaws between engaged and disengaged positions. The system may also include where a fourth rotary actuator is coupled to the seventh and eighth drive shafts and simultaneously rotates the seventh and eighth drive shafts in opposite directions, thereby rotating the seventh and eighth jaws between engaged and disengaged positions. The system where each one of the drive shafts extend through a wall of the housing, and where each one of the drive shafts engage one or more seals, thereby preventing fluid communication through the wall at any of the drive shafts. The system where the rotary actuators are disposed in a chamber within the housing, the chamber being sealed to prevent environmental fluids or debris from entering the chamber. The system where the second latch engages the first latch when the first and second latches are in the engaged position. The system where the third latch engages the second latch when the second and third latches are in the engaged position. The system where the fourth latch engages the third latch when the third and fourth latches are in the engaged position. The system where the first and second jaws of the first latch are configured to form a first frustoconically shaped portion of the first latch when the first latch is in the engaged position.

The system may also include where the third and fourth jaws of the first latch are configured to form a second frustoconically shaped portion of the second latch when the second latch is in the engaged position. The system may also include where a majority of an outer surface of the second frustoconically shaped portion abuts an inner surface of the first frustoconically shaped portion when the first and second latches are in the engaged position. The system where the first frustoconically shaped portion includes a first gap between the first and second jaws when the first latch is in the engaged position. The system may also include where the second frustoconically shaped portion includes a second gap between the third and fourth jaws when the second latch is in the engaged position. The system where the first and second gaps are parallel to the central axis of the housing, and the first and second gaps are circumferentially aligned with each other relative to the central axis. The system where the first and second gaps are parallel to the central axis of the housing, and the first gap is circumferentially offset, relative to the central axis, from the second gap. The system where the fifth and sixth jaws of the third latch are configured to form a third frustoconically shaped portion of the third latch when the third latch is in the engaged position. The system may also include where a majority of an outer surface of the third frustoconically shaped portion abuts an inner surface of the second frustoconically shaped portion when the second and third latches are in the engaged position. The system where the seventh and eighth jaws of the fourth latch are configured to form a fourth frustoconically shaped portion of the fourth latch when the fourth latch is in the engaged position.

The system may also include where a majority of an outer surface of the fourth frustoconically shaped portion abuts an inner surface of the third frustoconically shaped portion when the third and fourth latches are in the engaged position. The system where the third frustoconically shaped portion includes a third gap between the fifth and sixth jaws when the third latch is in the engaged position. The system may also include where the fourth frustoconically shaped portion includes a fourth gap between the seventh and eighth jaws when the fourth latch is in the engaged position. The system where the third and fourth gaps are parallel to the central axis of the housing, and the third and fourth gaps are circumferentially aligned with each other relative to the central axis. The system where the third and fourth gaps are parallel to the central axis of the housing, and the third gap is circumferentially offset, relative to the central axis, from the fourth gap.

The system further including a link interface system configured to rotate the housing up to greater than 90 degrees about a housing axis, the housing axis being perpendicular to the central axis, the link interface system including a rotary actuator, the rotary actuator including a body and a drive shaft, where the body is fixedly attached to the housing and the drive shaft is coupled to a link interface that is rotationally attached to the housing, and where when the drive shaft is rotated by the rotary actuator, the link interface is rotated about the housing axis. The system further including a link interface system configured to rotate the housing about a housing axis, the housing axis being perpendicular to the central axis, where the link interface is configured to engage a pair of links and rotate the housing relative to the links within a range of +/−4 degrees, +/−8 degrees, +/−12 degrees, +/−16 degrees, +/−20 degrees, +/−24 degrees, +/−28 degrees, +/−32 degrees, +/−36 degrees, +/−40 degrees, +/−44 degrees, +/−48 degrees, +/−52 degrees, +/−56 degrees, +/−60 degrees, +/−64 degrees, +/−68 degrees, +/−72 degrees, +/−76 degrees, +/−80 degrees, +/−84 degrees, +/−88 degrees, +/−92 degrees, +/−95 degrees, +/−96 degrees, +/−100 degrees, and +/−102 degrees, relative to an axis of at least one of the links. The system further including a hydraulic generator and an energy storage device, where the hydraulic generator generates electrical energy for operation of the elevator and stores a portion of the electrical energy in the energy storage device. The system where the storage device is a capacitor assembly. The system where the elevator is configured to be ATEX certified or IECEx certified according to ex zone 1 requirements. The system where the elevator, with the housing in a substantially horizontal orientation, is configured to support a tubular that weighs up to 1180 metric tons (~1300 short tons), or up to 1134 metric tons (~1250 short tons), or up to 1189 metric tons (~1200 short tons), or up to 907 metric tons (~1000 short tons), or up to 680 metric tons (~750 short tons), or up to 454 metric tons (~500 short tons), or up to 318 metric tons (~350 short tons), or up to 227 metric tons (~250 short tons). The system further including a top drive coupled to the elevator housing via a pair of links, with each of the links rotationally attached to the top drive at one end and rotationally attached to the housing at an opposite end.

The system further including a first lock for the first jaw, where the first lock retains a lateral portion of the first jaw to an attachment portion of the first jaw, and where the attachment portion of the first jaw is fixedly attached to the first drive shaft. The system further including a third lock for the third jaw, where the third lock retains a lateral portion of the third jaw to an attachment portion of the third jaw, and where the attachment portion of the third jaw is fixedly attached to the third drive shaft. The first lock engages a portion of the housing adjacent a spacer ring in the elevator when the first jaw is in the engaged position, and the third lock engages the first lock when the third jaw is in the engaged position, and where hydraulic force applied to the first and third jaws by rotary actuators is transferred through the first and third locks to the housing, thereby bypassing the spacer ring.

The system further including a spacer ring that engages the first and second jaws when the first and second jaws are in the engaged position, a shaft in the housing with a lever on one end and a cam on an opposite end, where rotation of the shaft engages the cam with a recess in the spacer ring, such that removal of the spacer ring from the housing is prevented. The shaft is rotated when the first jaw is rotated into the engaged position.

The system further including a pair of link interfaces configured to rotatably attach a pair of links to respective supports of the elevator that extend from opposite sides of the elevator, wherein each link is retained on the respective support by a removable device, and where the removable device can be installed by aligning an opening through the removable device with a retention feature of a retainer mount, receiving the retention feature within the opening, compressing two plates of the removable device together, rotating the removable device relative to the retention feature, and releasing the two plates to expand away from each other when the retention feature aligns with recesses on the removable device, thereby securing the removable device on the support.

One general aspect includes a system for conducting subterranean operations including: an elevator configured to move a tubular, the elevator including: a housing defining a central bore configured to receive the tubular therein, the central bore having a central axis; and a link interface system configured to rotate the housing up to greater than 90 degrees about a housing axis.

Embodiments may include one or more of the following features. The system where the link interface system is configured to engage a pair of links and rotate the housing relative to the links within a range of +/−4 degrees, +/−8 degrees, +/−12 degrees, +/−16 degrees, +/−20 degrees, +/−24 degrees, +/−28 degrees, +/−32 degrees, +/−36 degrees, +/−40 degrees, +/−44 degrees, +/−48 degrees, +/−52 degrees, +/−56 degrees, +/−60 degrees, +/−64 degrees, +/−68 degrees, +/−72 degrees, +/−76 degrees, +/−80 degrees, +/−84 degrees, +/−88 degrees, +/−92 degrees, +/−95 degrees, +/−96 degrees, +/−100 degrees, and +/−102 degrees relative to an axis of at least one of the links. The system further including a hydraulic generator and an energy storage device, where the hydraulic generator generates electrical energy for operation of the elevator and stores a portion of the electrical energy in the energy storage device. The system where the storage device is a capacitive assembly. The system where the elevator is configured to be ATEX certified or IECEx certified according to EX Zone 1 requirements. The system where the elevator, with the housing in a substantially horizontal orientation, is configured to support a tubular that weighs up to 1180 metric tons (~1300 short tons), or up to 1134 metric tons (~1250 short tons), or up to 1189 metric tons (~1200 short tons), or up to 907 metric tons (~1000 short tons), or up to 680 metric tons (~750 short tons), or up to 454 metric tons (~500 short tons), or up to 318 metric tons (~350 short tons), or up to 227 metric tons (~250 short tons). The system where the elevator is configured to manipulate the tubular between horizontal and vertical orientations, and where the tubular weighs up to 3000 kg (~3 short tons). The system where the elevator further includes one or more sensors disposed between a spacer ring and the housing, and a controller, where the sensors detect a force applied between the spacer ring and the housing, and the controller is configured to determine a weight of the tubular supported by the elevator.

The system further including a top drive coupled to the elevator housing via a pair of links, with each of the links rotationally attached to the top drive at one end and rotationally attached to the housing at an opposite end. The system where the housing axis is perpendicular to the central axis, where the link interface system includes a rotary actuator having a body and a drive shaft, with the body fixedly attached to the housing and the drive shaft coupled to a link interface that is rotationally attached to the housing, and where when the drive shaft is rotated by the rotary actuator, the link interface is rotated about the housing axis. The system further including a sensor that detects an angular position of the housing relative to the link interface, where the sensor is disposed within a sealed chamber of the housing that prevents a portion of environmental fluids from entering the sealed chamber during the subterranean operations. The system further including a rotary actuator coupled to each pair of jaws of the elevator and a sensor coupled to each rotary actuator, where the sensor detects an angular position of the rotary actuator, and a controller is configured to determine whether one or more of the jaws are in an engaged or disengaged position. The system further including: a rig; a top drive supported by the rig; a pair of links rotatably attached to the top drive; and the elevator rotatably attached to the pair of links. The system further including a link interface system configured to interface with any one of a plurality of links with at least one of the plurality of links having a first diameter, another one of the plurality of links having a second diameter, with the first diameter being different than the second diameter.

The link interface system further including at least one pair of angled flanges that are configured to vary a clearance between angled flanges of the at least one pair of angle flanges from a first clearance to a second clearance, where the first clearance allows the angled flanges of the at least one pair of angled flanges to straddle a link with the first diameter and prevents the angled flanges of the at least one pair of angled flanges from straddling a link with the second diameter.

One general aspect includes a system for conducting subterranean operations including: an elevator configured to move a tubular, the elevator including: a housing defining a central bore configured to receive the tubular therein; a first latch including first and second jaws, with each of the first and second jaws being coupled to the housing and configured to be moveable between an engaged position and a disengaged position, and when the first and second jaws are in the engaged position, engagement portions of the first and second jaws are positioned in the central bore; a second latch including third and fourth jaws, with each of the third and fourth jaws coupled to the housing and configured to be moveable between an engaged position and a disengaged position, and when the third and fourth jaws are in the engaged position, engagement portions of the third and fourth jaws are positioned in the central bore; and an electronics enclosure within the housing, with the electronics enclosure configured to be ATEX certified or IECEx certified according to EX Zone 1 requirements.

Embodiments may include one or more of the following features. The system further including an electronics controller disposed in the enclosure and configured to control the elevator to handle the tubular. The system further including a hydraulic generator and an energy storage device, where the hydraulic generator generates electrical energy for operation of the elevator and stores a portion of the electrical energy in the energy storage device. The system where the storage device is a capacitive assembly or a battery, and where the storage device is disposed within the electronics enclosure.

One general aspect includes a system for conducting subterranean operations including: an elevator configured to move a tubular, the elevator including: a housing defining a central bore configured to receive the tubular therein; a first latch including first and second jaws, with each of the first and second jaws being coupled to the housing and configured to be moveable between an engaged position and a disengaged position, and when the first and second jaws are in the engaged position, engagement portions of the first and second jaws are positioned in the central bore on opposite sides of, with respect to each other, a central axis of the central bore and define an opening of a first diameter; a second latch including third and fourth jaws, with each of the third and fourth jaws coupled to the housing and configured to be moveable between an engaged position and a disengaged position, and when the third and fourth jaws are in the engaged position, engagement portions of the third and fourth jaws are positioned in the central bore on opposite sides of, with respect to each other, the central axis of the central bore and define an opening of a second diameter which is different than the first diameter; and an electronics controller disposed in an electronics enclosure within the housing and configured to control the elevator to handle the tubular.

Embodiments may include one or more of the following features. The system where the electronics enclosure is configured to be ATEX certified or IECEx certified according to EX Zone 1 requirements.

One general aspect includes a system for conducting subterranean operations including: an elevator configured to move a tubular, the elevator including: a housing defining a central bore configured to receive the tubular therein; a first latch including first and second jaws, with each of the first and second jaws being coupled to the housing and configured to be moveable between an engaged position and a disengaged position, and when the first and second jaws are in the engaged position, engagement portions of the first and second jaws are configured to form a first frustoconically shaped portion positioned in the central bore and surrounding a central axis of the central bore, where the first frustoconically shaped portion defines an opening of a first diameter; and a second latch including third and fourth jaws, with each of the third and fourth jaws coupled to the housing and configured to be moveable between an engaged position and a disengaged position, and when the third and fourth jaws are in the engaged position, engagement portions of the third and fourth jaws are configured to form a second frustoconically shaped portion positioned in the central bore and surrounding the central axis of the central bore, where the second frustoconically shaped portion defines an opening of a second diameter which is different than the first diameter, where the first frustoconically shaped portion includes a first gap between the first and second jaws when the first latch is in the engaged position, and where the second frustoconically shaped portion includes a second gap between the third and fourth jaws when the second latch is in the engaged position, and where the first and second gaps are parallel to the central axis, and the first gap is circumferentially offset, relative to the central axis, from the second gap.

Embodiments may include one or more of the following features. The system further including: a third latch including fifth and sixth jaws, with each of the fifth and sixth jaws coupled to the housing and configured to be moveable between an engaged position and a disengaged position, and when the fifth and sixth jaws are configured to form a third frustoconically shaped portion positioned in the central bore and surrounding the central axis of the central bore, where the third frustoconically shaped portion defines an opening of a third diameter which is different than the first and second diameters, and a fourth latch including seventh and eighth jaws, with each of the seventh and eighth jaws coupled to the housing and configured to be moveable between an engaged position and a disengaged position, and when the seventh and eighth jaws are configured to form a fourth frustoconically shaped portion positioned in the central bore and surrounding the central axis of the central bore, where the fourth frustoconically shaped portion defines an opening of a fourth diameter which is different than the first, second, and third diameters, where the third frustoconically shaped portion includes a third gap between the fifth and sixth jaws when the third latch is in the engaged position, and where the fourth frustoconically shaped portion includes a fourth gap between the seventh and eighth jaws when the fourth latch is in the engaged position, and where the third and fourth gaps are parallel to the central axis, and the third gap is circumferentially offset, relative to the central axis, from the fourth gap. The system where the first and third gaps are circumferentially aligned relative to the central axis. The system where the second and fourth gaps are circumferentially aligned relative to the central axis.

Embodiment 1. A system for conducting subterranean operations comprising:

an elevator configured to move a tubular, the elevator comprising:

a housing defining a central bore configured to receive the tubular therein; and a first latch comprising a first jaw with a first lock, the first jaw configured to be rotated between an engaged position and a disengaged position, wherein the first lock engages a portion of the housing when the first jaw is in the engaged position.

Embodiment 2. The system of embodiment 1, wherein the first jaw comprises a lateral portion with a first protrusion along an end and an attachment portion with a first recess along an end, wherein the first protrusion is configured to be received by the first recess.

Embodiment 3. The system of embodiment 2, wherein the first lock rotated to a first position allows insertion of the first protrusion in the first recess or removal of the first protrusion from the first recess.

Embodiment 4. The system of embodiment 3, wherein the first lock rotated to a second position retains the first protrusion in the first recess.

Embodiment 5. The system of embodiment 3, wherein the first lock rotated to a second position allows movement of the first protrusion within the first recess and retains the first protrusion within the first recess.

Embodiment 6. The system of embodiment 5, wherein the attachment portion is rotatably attached to the housing, wherein rotation of the attachment portion rotates the lateral portion, and wherein lateral movement of the lateral portion causes lateral movement of the first protrusion in the first recess, which prevents lateral movement of the attachment portion in response to the lateral movement of the first protrusion.

Embodiment 7. The system of embodiment 1, further comprising a spacer ring disposed between the first latch and the housing and a circular weight sensor disposed between the spacer ring and the housing, wherein the portion of the housing is adjacent the spacer ring.

Embodiment 8. The system of embodiment 7, wherein the first latch engages the spacer ring and the first lock engages the portion of the housing when the first latch is in the engaged position.

Embodiment 9. The system of embodiment 8, wherein the spacer ring transfers weight from the first latch to the housing through the spacer ring and the circular weight sensor, when the first latch is in the engaged position.

Embodiment 10. The system of embodiment 8, wherein the first lock transfers a rotational force applied to the first jaw to the portion of the housing, when the first latch is in the engaged position.

Embodiment 11. The system of embodiment 10, further comprising a second latch comprising a second jaw with a second lock, the second jaw configured to be rotated between an engaged position and a disengaged position, wherein the second lock engages the first lock when the second jaw is in the engaged position.

Embodiment 12. The system of embodiment 11, wherein the second latch transfers weight to the housing through the first latch, the spacer ring, and the circular weight sensor, when the first latch and the second latch are in the engaged positions.

Embodiment 13. The system of embodiment 11, wherein the second lock transfers a rotational force applied to the second jaw through the first lock and to the portion of the housing, when the first latch and the second latch are in the engaged positions.

Embodiment 14. A system for conducting subterranean operations comprising:

an elevator configured to move a tubular, the elevator comprising:

a housing defining a central bore configured to receive the tubular therein; and a first latch comprising a first jaw, the first jaw configured to be moveable between an engaged position and a disengaged position;

a first shaft disposed in the housing, with a first cam attached to one end of the first shaft and a first lever attached to an opposite end of the first shaft; and a spacer ring at least partially surrounding a central axis of the central bore, the spacer ring having a first recess configured to receive the first cam, wherein the first lever is configured to engage the first jaw when the first jaw is rotated to the engaged position.

Embodiment 15. The system of embodiment 14, wherein engagement of the first lever rotates the first cam into engagement with the first recess, such that removal of the spacer ring from the housing is prevented when the first jaw is in the engaged position.

Embodiment 16. The system of embodiment 15, further comprising:

a second latch comprising a second jaw, the second jaw configured to be moveable between an engaged position and a disengaged position;

a second shaft with a second cam attached to one end and a second lever attached to an opposite end; and the spacer ring having a second recess configured to receive the second cam, wherein the second lever is configured to engage the second jaw when the second jaw is rotated to the engaged position, wherein engagement of the second lever rotates the second cam into engagement with the second recess, such that removal of the spacer ring from the housing is prevented when the second cam is engaged with the second recess.

Embodiment 17. The system of embodiment 16, wherein the first and second levers can be operated manually, automatically, remotely, or combinations thereof.

Embodiment 18. A system for conducting subterranean operations comprising:

an elevator configured to move a tubular, the elevator comprising:

a housing defining a central bore configured to receive the tubular therein; and a circular weight sensor surrounding the central bore, wherein a weight of the tubular is transferred to the circular weight sensor, which measures a pressure that is proportional to the weight of the tubular.

Embodiment 19. The system of embodiment 18, wherein the measured pressure is communicated to a controller that is configured to determine the weight of the tubular in response to the measured pressure.

Embodiment 20. The system of embodiment 18, wherein the circular weight sensor comprises:

a support ring;

an engagement ring slidably attached to the support ring;

a sealed chamber disposed between the support ring and the engagement ring;

a reservoir in pressure communication with the sealed chamber; and a pressure sensor in pressure communication with the reservoir.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

What is claimed is:

1. A system for conducting subterranean operations comprising:

an elevator configured to move a tubular, the elevator comprising:

a housing defining a central bore configured to receive the tubular therein; and a first latch comprising a first jaw, the first jaw configured to be moveable between an engaged position and a disengaged position;

a first shaft disposed in the housing, with a first cam attached to one end of the first shaft and a first lever attached to an opposite end of the first shaft; and a spacer ring at least partially surrounding a central axis of the central bore, the spacer ring having a first recess configured to receive the first cam, wherein the first lever is configured to engage the first jaw when the first jaw is rotated to the engaged position.

2. The system of claim 1, wherein engagement of the first lever rotates the first cam into engagement with the first recess, such that removal of the spacer ring from the housing is prevented when the first jaw is in the engaged position.

3. The system of claim 2, further comprising:

a second latch comprising a second jaw, the second jaw configured to be moveable between an engaged position and a disengaged position;

a second shaft with a second cam attached to one end and a second lever attached to an opposite end; and the spacer ring having a second recess configured to receive the second cam, wherein the second lever is configured to engage the second jaw when the second jaw is rotated to the engaged position, wherein engagement of the second lever rotates the second cam into engagement with the second recess, such that removal of the spacer ring from the housing is prevented when the second cam is engaged with the second recess.

4. The system of claim 3, wherein the first and second levers can be operated manually, automatically, remotely, or combinations thereof.

* * * * *